US010914541B2

(12) United States Patent
Oross

(10) Patent No.: US 10,914,541 B2
(45) Date of Patent: Feb. 9, 2021

(54) MAGAZINE LOADER SYSTEM

(71) Applicant: Daniel Jason Oross, Jupiter, FL (US)

(72) Inventor: Daniel Jason Oross, Jupiter, FL (US)

( * ) Notice: Subject to any disclaimer, the term of this patent is extended or adjusted under 35 U.S.C. 154(b) by 0 days.

(21) Appl. No.: 16/685,401

(22) Filed: Nov. 15, 2019

(65) Prior Publication Data

US 2020/0158454 A1 May 21, 2020

Related U.S. Application Data

(60) Provisional application No. 62/768,053, filed on Nov. 15, 2018.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84; F41A 9/86
USPC ..... 42/87
See application file for complete search history.

(56) References Cited

U.S. PATENT DOCUMENTS

| | | | | |
|---|---|---|---|---|
| 7,503,138 | B2 * | 3/2009 | Tal | F41A 9/83 42/50 |
| 7,637,048 | B2 * | 12/2009 | Tal | F41A 9/83 42/87 |
| 9,618,286 | B1 | 4/2017 | Plate | |
| 9,689,633 | B1 | 6/2017 | Plate | |
| 9,739,552 | B1 | 8/2017 | Plate | |
| 9,797,669 | B1 | 10/2017 | Plate | |
| 9,933,220 | B1 | 4/2018 | Plate | |
| 9,976,826 | B2 * | 5/2018 | Hefer | F41A 9/83 |
| 10,175,017 | B2 * | 1/2019 | Cottrell | F41A 9/83 |
| 10,317,154 | B1 | 6/2019 | Loveday, IV et al. | |
| 10,330,411 | B2 * | 6/2019 | Cottrell | F41A 9/79 |
| 10,641,566 | B2 * | 5/2020 | Cottrell | F41A 9/83 |
| 2010/0175294 | A1 * | 7/2010 | Meinel | F41A 9/83 42/87 |
| 2017/0051991 | A1 * | 2/2017 | Cottrell | F41A 9/83 |
| 2017/0051992 | A1 * | 2/2017 | Cottrell | F41A 9/83 |
| 2017/0067707 | A1 * | 3/2017 | Zivic | F41A 9/83 |
| 2018/0058785 | A1 * | 3/2018 | Hefer | F41A 9/83 |

OTHER PUBLICATIONS

MakerShot Custom 9mm Caliber Magazine Speedloader, https://www.amazon.com/dp/B07CYXPS5K.
Raeind Magazine Speed Loader for FN Five-Seven 5.7x28mm Handgun, Original, gen1 & MK2, Loads 7 Rounds in one Push!, https://www.amazon.com/dp/B01FVC3PNK.
Bianchi, 580 Speed Strip Pair.44/.45 Caliber, Black, https://www.amazon.com/dpB002FP3PLY.

* cited by examiner

*Primary Examiner* — Joshua E Freeman
(74) *Attorney, Agent, or Firm* — Akerman LLP; Ryan L. Harding

(57) ABSTRACT

A loader system may include a loader including at least two pistons, each piston being translatable along a respective translation path and comprising a respective engagement surface for engaging a cartridge when translated along its respective translation path to thereby cooperatively urge the cartridge into a magazine such that the cartridge is loaded within the magazine and retained therein by feed lips of the magazine.

20 Claims, 39 Drawing Sheets

MAGAZINE LOADER SYSTEM

CROSS-REFERENCE TO RELATED APPLICATIONS

The application claims the benefit of U.S. Provisional Patent Application No. 62/768,052, filed Nov. 15, 2018, the contents of which is hereby incorporated herein by reference.

TECHNICAL FIELD

The present application is directed to loaders for loading ammunition. More specifically, the present application is directed to systems and devices for loading magazines.

BACKGROUND

Many firearms are equipped for use with magazines that hold ammunition cartridges. A typical magazine includes a magazine tube of suitable dimensions for holding a plurality of particular caliber of cartridges. A spring extends from a floor plate of the tube and attaches to a follower. Cartridges stack within the tube on top of the follower. The spring biases the follower toward a top opening of the tube thereby positioning the stacked cartridges toward the top opening. Feed lips are formed along the top opening. One or more feed lips typically contact the top cartridge to prevent the top cartridge, and hence lower cartridges, from being ejected from the top opening of the magazine tube absent action of the bolt of the firearm. Magazines typically insert into a butt or other ammunition feed location of the firearm often referred to as magazine well or mag well for short, Small caliber pistols like .22 caliber will have bolts, because they don't have enough power to recoil a slide, whereas a 9 mm, .380, .40 and .45 caliber pistol will have a slide, which is a steel block that houses the barrel and will be recoiled after a cartridge is fired and then strip the top cartridge from the magazine and chamber it into the barrel.

While magazines are helpful in allowing multiple rounds to be sequentially fed to the firearm without individually loading each cartridge manually into the firearm, the process of loading a magazine is tedious. Fatigue from inserting cartridges into magazines is common and can quickly cause fingers to become raw and hands to become arthritic. Additionally, handling slippery cartridges in cold, wet or hot days, or while wearing gloves often results in dropped ammunition. Thus, reducing handling requirements and inevitable dropping of ammunition while also reduce pain and increasing speed and reliability is desirable.

Current devices to assist loading of cartridges into magazines are difficult to use and do not offer much in the way of increased loading speed. What is needed is improved loading devices that are easy to use and that significantly decrease loading time.

SUMMARY

In one aspect, a loader system for loading an ammunition magazine includes a loader including a first piston and a second piston. The first piston may include a first piston engagement surface translatable along a first translation path and configured to engage and urge a cartridge during translation from at least a first position to a second position of the first translation path. The second piston may include a second piston engagement surface translatable along a second translation path and configured to engage the cartridge during translation from at least a third position to a fourth position of the second translation path. The first piston engagement surface may be configured to urge the cartridge directly or indirectly against a magazine follower of a magazine. The second piston engagement surface may be configured to urge the cartridge to a back of the magazine such that the cartridge is retained within the magazine below feed lips of the magazine.

In one example, the first translation path extending between the first and second positions is approximately perpendicular to the second translation path extending between the third and fourth positions. In this or another example, the second translation path between the third position and the fourth position may extend within 10° of parallel relative to a magazine feed lip angle.

In one example, the first piston engagement surface translates from the first position to the second position before the second piston engagement surface translates from the third position to the fourth position. In another example, the first piston engagement surface translates from the first position to the second position before the second piston engagement surface translates from the third position toward the fourth position. In still another example, the first piston engagement surface translates from the first position to the second position before the second piston engagement surface engages the cartridge. In still yet another example, the first piston engagement surface translates from the first position to the second position before the second piston engagement surface translates along the second translation path.

In one example, after the first piston engagement surface translates along the first translation path from the first position to the second position, the first piston may remain at approximately the second position while the second piston engagement surface translates to the fourth position. When in the second position, the first piston engagement surface may be positioned to provide a guide surface along which the cartridge is guided when urged toward the back of the magazine by the translation of the second piston engagement surface from the third position to the fourth position.

In one example, the loader comprises a body that houses the first and second pistons. The body may include a magazine interface for interfacing a magazine to be loaded with the loader at a magazine fitting that positions the magazine in a loading position relative to the first and second piston engagement surfaces. The magazine interface may include an adapter interface for interchangeably coupling adapters comprising the magazine fitting to the body. In a further example, the system also includes a plurality of adapters, the adapters comprising magazine fittings specific to different magazine types and/or calibers. In one example, the loader further includes one or more drives housed by the body and operable to drive translation of the first and second piston engagement surfaces along the respective first and second translation paths. In one example, the one or more drives comprise a lever, crank, knob, slide bar, pneumatic solenoid, solenoid actuator, motorized linear actuator, stepper motor, servo motor, or combination thereof. In one configuration, the loader also includes one or more force translators to direct force provided by the operation of the one or more drives to translate the first and second piston engagement surfaces. The one or more force translators may be selected from a swing, ring and pinion gear, rack and pinion gear, worm gear, rocker arm, cam lobe, cam plate, or combination thereof.

In yet another embodiment, a method of loading an ammunition magazine includes causing translation of a first piston engagement surface of a first piston, and causing translation of a second piston engagement surface of a second piston. Each of the first and second piston engagement surfaces may engage and thereafter urge a cartridge toward a magazine opening during translation. The first piston engagement surface may urge the cartridge directly or indirectly against a magazine follower of the magazine when translated and the second piston engagement surface may urge the cartridge toward a back of the magazine to position the cartridge below feed lips of the magazine when translated.

In one example, the first piston engagement surface may urge the cartridge along a first translation path and the second piston engagement surface may urge the cartridge along a second translation path. The first translation path may be approximately perpendicular to the second translation path. In an above or another example, the second piston engagement surface urges the cartridge along a translation path that extends within 10° of parallel to an angle of the feed lips. In an above or another example, the first piston engagement surface urges the cartridge directly or indirectly against the magazine follower before the second piston engagement surface urges the cartridge below the follower.

In one embodiment, the method further comprises maintaining a position of the first piston engagement surface when the first piston engagement surface urges the cartridge is directly or indirectly against the magazine follower while the second piston engagement surface urges the cartridge toward the back of the magazine. According to one methodology, causing translation of the first and second piston engagement surfaces includes actuating a lever operatively coupled to the first and second pistons.

In one aspect, a magazine loader system includes a loader. The loader may include two or more pistons, each comprising an engagement surface translatable along a translation path and configured to engage an ammunition cartridge to urge the cartridge in one or more directions when translated along the translation path. At least one of the piston engagement surfaces may be configured to urge the cartridge into a magazine when translated along its path.

In one example, the loader may further include one or more drives configured to actuate and/or cause translation of the one or more piston engagement surfaces. The one or more drives may include a lever, crank, knob, slide bar, pneumatic solenoid, solenoid actuator, motorized linear actuator, stepper motor, servo motor, or combinations thereof operable to actuate the two or more pistons.

In one example, the loader further comprises one or more force translators to direct force provided by the one or more drives to translate the two or more pistons engagement surfaces. The one or more force translators may be selected from a swing, ring and pinion gear, rack and pinion gear, worm gear, rocker arm, cam lobe, cam plate, and combinations thereof. In one example, the loader further comprises a lever operably connected to the two or more pistons. The lever may be actuatable to cause translation of at least one of the one or more piston engagement surfaces.

The two or more pistons may include a first piston and a second piston. The first piston engagement surface may be configured to urge the cartridge in a first direction. Translation of the second piston engagement surface may be configured to urge the cartridge in a second direction different from the first.

In one example, the first engagement surface and the second engagement surface are configured to translate sequentially to urge the cartridge in a first direction and then in a second direction different from the first.

The loader may further include a lever operably connected to at least the first piston to cause translation of the first piston engagement surface. Actuation of the lever may cause translation of the first piston engagement surface before translation of the second piston engagement surface. Actuation of the lever may cause translation of the first piston engagement surface and the second piston engagement surface such that the first piston engagement surface engages the cartridge before the second piston engagement surface engages the cartridge. Actuation of the lever may cause translation of the first piston engagement surface and the second piston engagement surface into engagement with the cartridge such that the first piston engagement surface urges the cartridge in a first direction before the second piston engagement surface urges the cartridge in a second direction different from the first.

The loader may further comprise a cam movable to cause translation of the first piston engagement surface along its path. In a further example, the loader includes a rocker arm operably coupled to the first piston. The rocker arm may be configured to engage a cam surface of the cam and ride along the cam surface when the cam moves to thereby transfer the movement of the cam to the first piston to translate the first piston engagement surface along its path. The cam is coupled to the lever. In one example, the lever is biased to return to an initial pre-actuation position following actuation. In one example, the lever is biased by a spring. The loader may further include a hand grip to create leverage while actuation of the lever.

In one example, the first piston comprises a case piston configured to push the cartridge toward a bottom of the magazine when the first piston engagement surface is translated. When the first piston pushes the cartridge toward the bottom of the magazine, the cartridge may push the magazine follower down and compresses the magazine spring.

The second piston may include a projectile piston configured to push the cartridge toward a back of the magazine when the second piston engagement surface is translated to securely contain the cartridge within the magazine with feed lips.

In one example, the system further comprises an adapter configured to insert into the body to provide an interface with magazines of various calibers and stack styles.

In any of the above examples, the system may further include a feeder. The feeder may include a cartridge entrance for receiving cartridges; a cartridge exit for release of cartridges; and a cartridge path extending between the cartridge entrance and the cartridge exit for transporting cartridges between the cartridge entrance and the cartridge exit.

The feeder entrance may be configured to scoop cartridges. One or more rails may be defined along the cartridge path and be positioned to be received in extractor grooves of cartridges. One or more rails may be defined along the cartridge entrance and are positioned to be received in extractor grooves of cartridges.

In one example, the feeder includes a base for insertion into an adapter. In this or another example, the feeder includes a base for insertion into a body of the loader. The base may include a cartridge tunnel along the cartridge exit, wherein the tunnel comprises a sweep.

In one example, the feeder is configured to facilitate flow of cartridges to the adapter and feeder. The feeder may include rails that enable cartridges to slide along a channel in the feeder, orientating cartridges with projectiles facing in a single direction. The feeder may include a gate positioned at the cartridge entrance comprising a flexible arm catch configured to retain cartridges within the feeder. In one example, the feeder includes a gate positioned at the cartridge exit comprising a flexible arm that integrates with an adapter, wherein the flexible arm is configured to release the cartridge on demand.

In one example, the system includes a container configured to provide a flow of cartridges to the adapter. The container may include rails that enable cartridges to slide along a channel in the container to orientate cartridges with projectiles facing in a single direction. The container may include a gate at an opening in the container configured for retention of cartridges within the container via a flexible arm that integrates with a feeder for loading, or an adapter that releases a cartridge on demand. The opening may be a sole opening in the container.

The system may include an adapter configured to plug into a body of the loader to provide an interface with a magazine. The adapter may be configured to plug into a body of the loader to provide an interface with magazines of various calibers and stack styles.

In another aspect, an accessory for facilitating loading of cartridges into a firearm magazine includes a lever that may be squeezed and that is coupled to a cam plate having slots that move and/or guide one or more piston when the lever is squeezed. In one example, the accessory includes a spring to return the lever to its initial starting position. The accessory may also include a hand grip to create leverage while squeezing the rotating lever. The accessory may further include a case piston configured to push a cartridge toward the bottom of a magazine, pushing a magazine follower down and compressing a magazine spring. The accessory may also include a projectile piston configured to push a cartridge toward the back of a magazine, rendering the cartridge securely contained within a magazine with feed lips. The accessory may also include an adapter that can plug into the body, that provides interface with magazines of various calibers and stack style. The accessory may also include rails that enable cartridges to ride along a channel in the feeder in a uniform orientation. The accessory may also include a flexible catch that prevents a cartridge from further rolling into the adapter tunnel until the case piston pushes it through the catch into a magazine. In one example, the accessory also includes a feeder that facilitates the flow of cartridges to the loader. Rails may enable cartridges to slide along a channel in the feeder, orientating cartridges with projectiles facing in a single direction. A gate at the entrance side of the feeder may be configured for retention of cartridges within the feeder, via a flexible arm and catch. A gate at the exit side of the feeder may be configured for retention of cartridges within the feeder, via a flexible arm that integrates with an adapter that releases a cartridge on demand Optionally the accessory also includes a container that can be used in lieu of a feeder to provide the flow of cartridges to the adapter. Rails may enable cartridges to slide along a channel in the container, orientating cartridges with projectiles facing in a single direction. A gate at an opening in the container may be configured for retention of cartridges within the container, via a flexible arm that integrates with a feeder for loading, or an adapter that releases a cartridge on demand. In one example, the opening is a sole opening in the container.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

FIGS. 8A & 8B illustrate the lever shown in FIG. 5 wherein FIG. 8A is a top view and FIG. 8B is a bottom view according to various embodiments described herein;

FIGS. 9A & 9B illustrate the rocker arm shown in FIG. 5 wherein FIG. 9A is a top view and FIG. 9B is an exploded bottom view according to various embodiments described herein;

FIGS. 10A & 10B illustrate another embodiment of the rocker arm wherein FIG. 10A is a top view and FIG. 10B is a bottom view according to various embodiments described herein;

FIGS. 11A & 11B illustrate the case piston shown in FIG. 5 wherein FIG. 11A is a top view and FIG. 11B is a side view according to various embodiments described herein;

FIGS. 12A & 12B illustrate the projectile piston shown in FIG. 5 wherein FIG. 12A is a top view and FIG. 12B is a side view according to various embodiments described herein;

FIGS. 13A & 13B illustrate a feeder according to various embodiments described herein, wherein FIG. 13A is a view of a first side and FIG. 13B is a view of a second side;

FIGS. 14A & 14D illustrate various views of the feeder shown in FIGS. 13A & 13B retaining cartridges according to various embodiments described herein, wherein FIG. 14A is a view of the first side, FIG. 14D is a cross-section taken along line 14D in FIG. 14A;

FIGS. 19A & 19B illustrate an adapter according to various embodiments described herein, wherein FIG. 19A is a top perspective view and FIG. 19B is a top view;

DESCRIPTION

The present disclosure describes various embodiments of a loader system and related devices and methods thereof.

Figure 1A:
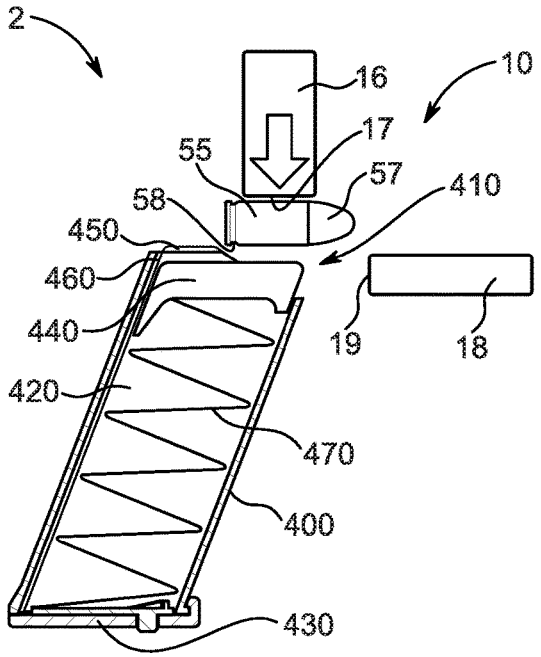
FIGS. 1A-1E illustrate a loader system and operation thereof according to various embodiments described herein.
Figure 1B:
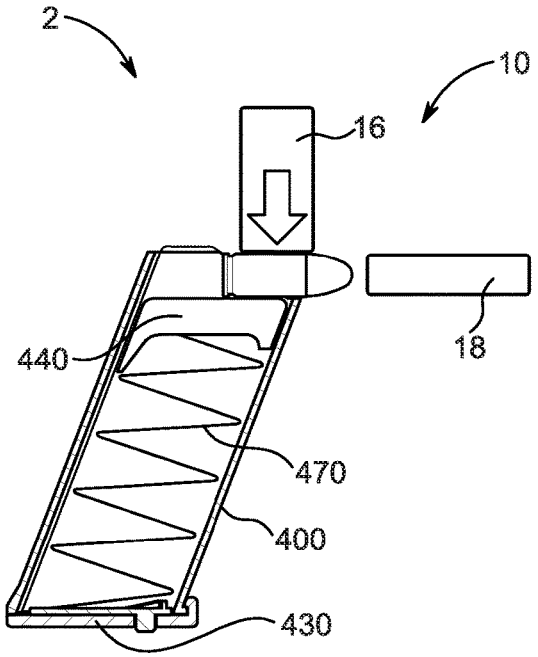
Figure 1C:
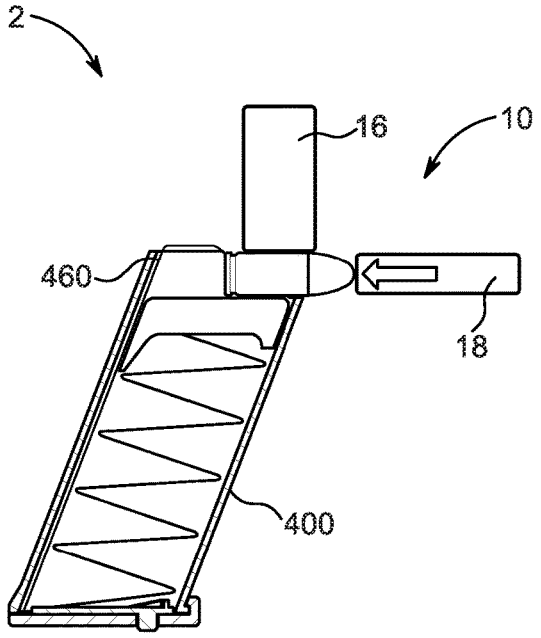
Figure 1D:
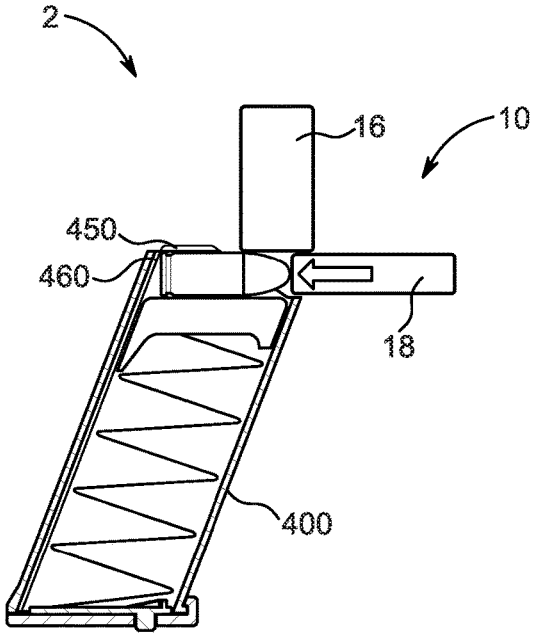
Figure 1E:
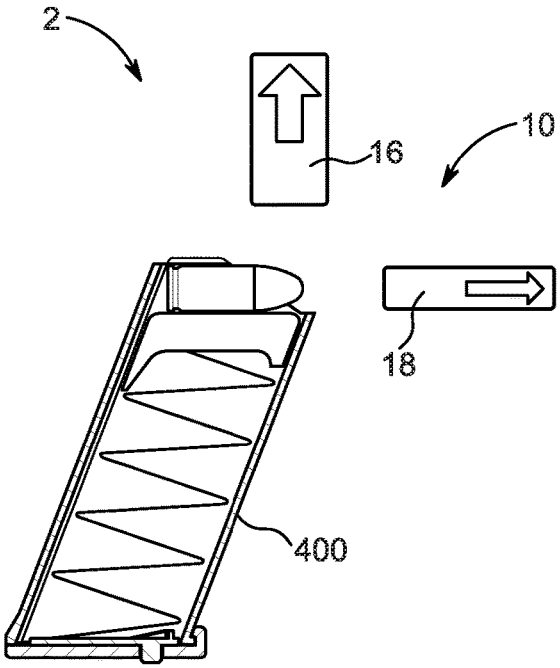
Figure 2:
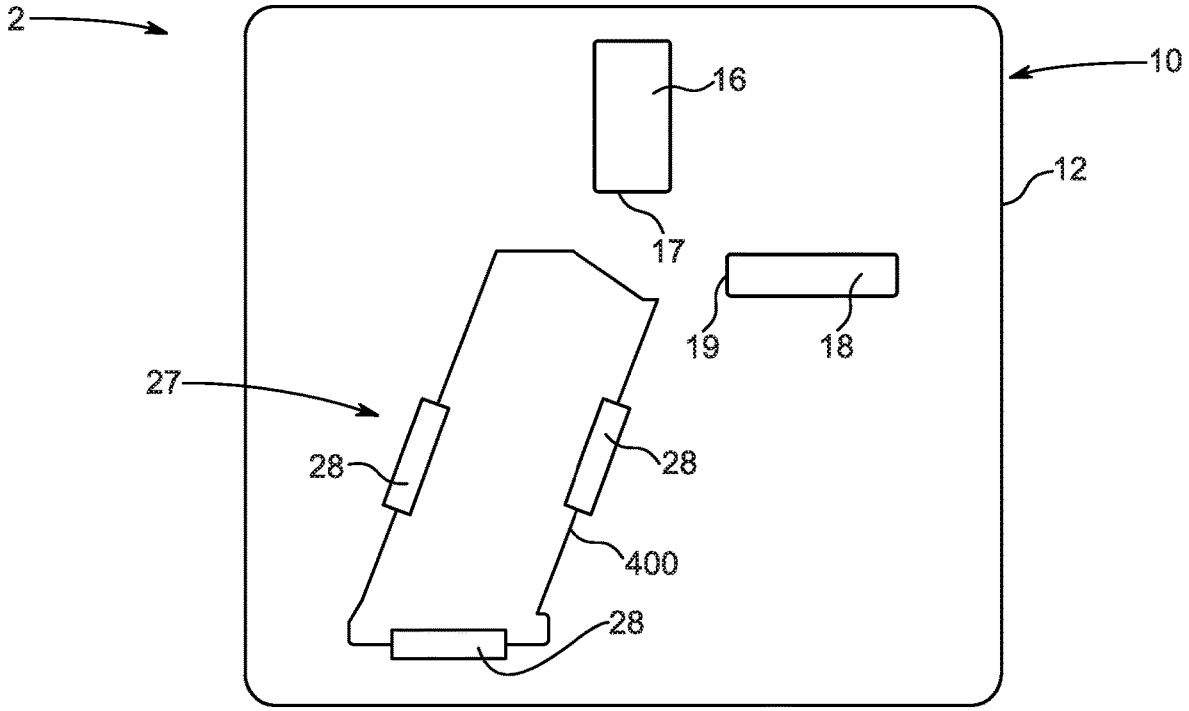
FIG. 2 illustrates a loader system including a body having a magazine coupled thereto according to various embodiments described herein.

With reference to FIGS. 1A-2 illustrating general embodiments of a loader system 2 and operation thereof, wherein like features are indicated by like numbers, in various embodiments, the loader system 2 includes a loader 10. The loader 10 may include two or more movable cartridge manipulation members, referred to as pistons 16, 18 herein. Pistons 16, 18 may generally include or couple to an engagement surface 17, 19 configured to engage cartridges 55 to move the same. For example, pistons 16, 18 may be configured to translate along respective translation paths and there along engage a cartridge 55 to move the cartridge 55 in one or more directions. Thus, translation or movement of a piston 16, 18 may generally refer to the translation or movement of the engagement surface 17, 19 along a linear, arcuate, curved, or combination path, as the case may be.

The translation of the engagement surfaces 17, 19 may be along respective translation paths. At least a portion of the translation path may be configured to include engagement and urging of a cartridge 55 with respect to a magazine 400. As described herein, the portion of the first transition path wherein the first engagement surface 17 is configured to be engaged with the cartridge 55 includes at least a first position and a second position, wherein the second position corresponds to the full extent of the translation path whereby the first engagement surface 17 is configured to be engaged with and urging the cartridge 55. For example, in FIG. 1A, the first piston engagement surface 17 is depicted engaged with the cartridge 55 at a first position of its translation path. In, FIG. 1B, the first engagement surface 17 is depicted engaged with the cartridge at the second position of its translation path where the first engagement surface 17 is not intended to urge the cartridge 55 further in this embodiment. In some embodiments, the first piston engagement surface 17 may translate along portions of the translation path that do not include engagement with a cartridge 55 under normal operations. For example, the first piston engagement surface 17 may translate, e.g., return or reverse translate, to a resting position following a translation. For instance, FIG. 1E shows an example of the first piston engagement surface 17 retracted to a resting position. In various embodiments, the first piston engagement surface 17 may be configured to engage a cartridge 55, when present, in the resting position. However, in the illustrated embodiment, the first position is between the resting position and the second position. Thus, a portion of the first translation path of the first piston engagement surface 17 may include a distance wherein the first piston engagement surface 17 is not intended to engage the cartridge 55. The portion of the second transition path wherein the second engagement surface 19 is configured to be engaged with the cartridge 55 includes at least a first and second position, which are referred to as third position and fourth position, respectively, herein to avoid confusion. The fourth position corresponds to the full extent of the translation path whereby the second engagement surface 19 is configured to be engaged with and urging the cartridge 55. For example, in FIG. 1C, the second piston engagement surface 19 is depicted engaged with the cartridge 55 at a third position of its translation path. In, FIG. 1D, the second engagement surface 19 is depicted engaged with the cartridge at the fourth position of its translation path where the second engagement surface 19 is not intended to urge the cartridge 55 further in this embodiment. In some embodiments, the second piston engagement surface 19 may translate along portions of the translation path that do not include engagement with a cartridge 55 under normal operations. For example, the second piston engagement surface 19 may translate, e.g., return or reverse translate, to a resting position following a translation. For instance, FIGS. 1B & 1E show an example of the second piston engagement surface 19 retracted to a resting position. In various embodiments, the second piston engagement surface 19 may be configured to engage a cartridge 55, when present, in the resting position. However, in the illustrated embodiment, the third position is between the resting position and the fourth position. Thus, a portion of the second translation path of the second piston engagement surface 19 may include a distance wherein the second piston engagement surface 19 is not intended to engage the cartridge 55.

In one embodiment, the loader system 2 includes a loader 10 comprising at least two pistons 16, 18, each piston 16, 18 being translatable along a respective translation path and comprising a respective engagement surface 17, 19 for engaging a cartridge 55 when translated along its respective translation path to thereby cooperatively urge the cartridge 55 into a magazine 400 such that the cartridge is loaded within the magazine 400 and retained therein by feed lips 450 of the magazine 450.

In one embodiment, the loader system 2 includes a loader 10 comprising at least a first piston 16 comprising a first piston engagement surface 17 and at least a second piston 18 comprising a second piston engagement surface 19. The first and second engagements surfaces 17, 19 may be translatable along respective first and second translation paths for engaging the cartridge 55 therealong to cooperatively urge the cartridge 55 into the magazine 400 below the feed lips 450.

Translation of the pistons 16, 18 may cooperate to urge a cartridge 55 into a magazine 400 to load the same. Accordingly, the loader system 2 may include a loader 10 comprising two or more pistons 16, 18 that may thereby cooperate to direct the cartridge 55 to load a magazine 400. Each piston 16, 18 comprises an engagement surface 17, 19 for engaging a cartridge 55 to move the same. For clarity, pistons 16, 18 are described herein as including an engagement surface 17, 19; however, it is to be understood that pistons 16, 18 may be configured in many ways, e.g., the larger structures identified herein as pistons 16, 18 with respect to the illustrated embodiments of the loader system may be provided as separate structures that operatively associate with the engagement surfaces 17, 19 to achieve the desired translation of such engagement surfaces 17, 19 to move and load cartridges 55.

Loading a cartridge 55 into a magazine 400 may include utilizing the loader 10 to urge the cartridge 55 in multiple directions. For example, a first piston 17 may be movable to urge the cartridge 55 in a first direction (see, e.g., FIG. 1A-FIG. 1B) and a second piston 18 may be movable to urge the cartridge 55 in a second direction (see, e.g., FIG. 1C-FIG. 1D). In a further example, another piston, multiple pistons, such as the first piston 16 and second piston 18 or the first and/or second piston 16, 18 and one or more additional pistons may cooperate to urge the cartridge 55 in one or more third directions. In an above or another example, one or more pistons 16, 18 may retain or block the cartridge with respect to movement in one or more directions while one or more other pistons 16, 18 urge the cartridge to move in another direction. In one configuration, a piston 16, 18 may provide a guide surface along which the cartridge 55 may be guided when moved by one or more other pistons 16, 18. In some examples, the piston 16, 18 may be stationary or moving when providing a guide surface for the cartridge 55. For example, FIG. 1C depicts the first piston 16 providing a guide surface along its engagement surface 17 for the cartridge 55 during translation of the second piston 18. In one example, the piston 16, 18 may also urge the cartridge while providing a guide surface for the cartridge 55 while the cartridge 55 is also being urged by one or more other pistons 16, 18 in another direction. The guide surface may be a same or different surface as an engagement surface 17, 19 of the piston 16, 18 that engages the cartridge 55 to move the cartridge 55 in one or more directions. The pistons 16, 18 may thus cooperate to move the cartridge 55 in a direction that results from a combination of multiple piston movements. As described in more detail elsewhere herein, the first piston 16 may engage a case 56 of a cartridge and the second piston may engage a projectile 57 of the cartridge 55.

In some embodiments, two or more pistons 16, 18 may be configured to sequentially move, e.g., extend and/or retract. In one example, two or more pistons 16, 18 may be configured to sequentially move to sequentially engage and/or urge the cartridge 55. The two or more pistons 16, 18 may, for example, cooperate to sequentially move the cartridge 55 in two or more directions. In one example, a piston 16, 18 may provide a guide as noted above before, during, or after the piston 16, 18 translates to urge the cartridge 55 in one or more directions, such as during movement of the cartridge 55 by another piston 16, 18.

In various embodiments, the first piston 16 may be positioned to engage a cartridge 55 with an engagement surface 17 and there against translate in one or more directions to urge the cartridge 55 to a magazine feed opening 410. At the feed opening 410, translation of the first piston 16 may urge the cartridge 55 toward a magazine base 430 in a manner that depresses a magazine follower 440, e.g., the first piston 16 may compress the cartridge 55 directly against the magazine follower 440 or compress the cartridge 55 against one or more cartridges 55 within the magazine 400 that are positioned above the magazine follower 440 and biased thereby toward the magazine opening 410 by the follower bias spring 470 to an extent that results in depression of the magazine follower 440, indirectly by the cartridge 55, on the bias spring 470 toward the base 430 (see, e.g., FIGS. 1A-1B). In one example, the first piston 16 drives at least a portion of the cartridge to a position below the feed lips 450 of the magazine 400 along or adjacent to the magazine feed opening 410. For example, an upper extent of the cartridge 55 may be positioned at a location corresponding to a location allowing the cartridge 55 to insert beneath the feed lips 410 if the cartridge 55 were further translated toward the back 460 of the magazine 400 along a translation path aligned with the longitudinal axis of the cartridge 55. In one example, the entire cartridge 55 may be initially driven to a position below the feed lips 450. In a further example, the first piston 16 may position the cartridge 55 such that subsequent movement of the cartridge toward the back 460 of the magazine 400 along a path aligned with the longitudinal axis of the cartridge 55 positions the cartridge 55 within the magazine 400, below the feed lips 450. In the illustrated embodiment, after the first piston 16 positions the cartridge 55 such that the cartridge depresses the follower 440 (FIGS. 1A-1B), the first piston 16 provides a guide surface against which the cartridge 55 is guided when being urged toward the back 460 of the magazine 400 by the second piston 18 such that the cartridge 55 is secured beneath the feed lips 450 (FIGS. 1C-1D). As shown in FIG. 1E, after the pistons 16, 18 have translated, loading the cartridge 55 in the magazine 400, the pistons 16, 18 may reverse translate along the translation path to return to their pre-translated, resting positions.

In one embodiment, the loader system 2 includes a loader 10 comprising at least a first piston 16 and a second piston 18. The first piston 16 may include a first piston engagement surface 17 and the second piston 18 may include a second piston engagement surface 19. The first piston engagement surface 17 is translatable from a first position to a second position to therealong engage the cartridge 55 and urge the cartridge 55 directly or indirectly against a magazine follower 440 of the magazine 400 when the first piston engagement surface 17 is in the second position. In one example, when the first piston engagement surface 17 is in the second position, the first piston engagement surface 17 compresses the cartridge 55 between the first piston engagement surface 17 and the magazine follower 440. In one example, the compression causes a magazine follower spring 470 to depress. The second piston engagement surface 19 is translatable from a third position to a fourth position to therealong engage the cartridge 55 and urge the cartridge 55 toward a back 460 of the magazine 400, below the feed lips 450.

In one embodiment, the loader system 2 includes at least a first piston 16 and a second piston 18, the first piston 16 comprising a first piston engagement surface 17 and the second piston 18 comprising a second piston engagement surface 19. The first piston engagement surface 17 is translatable along the first translation path to engage a cartridge 55 therealong and urge the cartridge 55 against the magazine follower 440 of the magazine 400. The first piston 16 engagement surface 17 may compress the cartridge 55 between the first piston engagement surface 17 and the magazine follower 440. In one example, the compression causes the magazine follower spring 470 to depress. When the first piston engagement surface 17 translates from the first position to the second position, the cartridge 55 is positioned against the magazine follower 440 at a location adjacent to and below the feed lips 450. As noted above, when a magazine is partially loaded, the cartridge 55 may be compressed against the top loaded cartridge and indirectly depress the magazine follower 440. The second piston engagement surface 19 is translatable along the second translation path to therealong engage the cartridge 55 and urge the cartridge 55 toward a back of the magazine, below feed lips 450 of the magazine when translating from the third position to the fourth position.

In some examples, the first piston engagement surface 17 translates along the first translation path to engage and thereafter urge the cartridge 55 from the first position to the second position, wherein when in the second position, the first piston engagement surface 17 compresses the cartridge 55 between the first piston engagement surface 17 and the magazine follower 440. In one example, the compression causes a magazine follower spring 470 to depress. The second piston engagement surface 19 may be translatable along the second translation path from the third position to the fourth position to engage and thereafter urge the cartridge 55 toward the back 460 of the magazine 400, below feed lips 450 of the magazine.

In some embodiments, the first piston engagement surface 17 and second piston engagement surface 19 translate sequentially such that the first piston engagement surface 17 positions the cartridge against the follower 440 before the second piston engagement surface 19 engages and/or urges the cartridge 55 toward the back of the magazine 400. In various embodiments, the second piston engagement surface 19 may initiate translation before or after first piston engagement surface 17 reaches full translation or the second position.

In some examples, the first piston engagement surface 17 acts as a guide to guide the cartridge 55 to the back 460 of the magazine 400 when the second piston engagement surface 19 urges the cartridge 55.

In some examples, the first and second piston engagement surfaces 17, 19 translate along approximately perpendicular paths. In one example, the first translation path extending between the first and second positions is approximately perpendicular to the second translation path extending between the third and fourth positions.

As noted above, pistons 16, 18 may be adapted to move in various directions. As shown, the two pistons 16, 18 are movable to translate in approximately perpendicular directions. The pistons 16, 18 include engagement surfaces 17, 19 for engaging cartridges 55 during translation to urge cartridges 55 for loading a magazine 400. In some embodiments, pistons engagement surfaces 17, 19 may translate along translation paths having axes that intersect at angles approximately 2°, approximately 4°, approximately 6°, approximately 8°, approximately 10°, or more from perpendicular. In one configuration, engagement surfaces of first and second pistons 16, 18 translate along paths having axes that intersect at angles less than approximately 10°, less than approximately 8°, less than approximately 6°, less than approximately 4°, or less than approximately 2° from perpendicular. In any of the above or another embodiment, the first piston 16 may translate along a translation path perpendicular to an angle of the feed lips 450. In another example, the first piston 16 may translate along a translation path that is approximately 2°, approximately 4°, approximately 6°, approximately 8°, approximately 10°, or more from perpendicular. In any of the above or another embodiment, the second piston 18 may translate along a translation path parallel to an angle of the feed lips 450. In another example, the second piston 18 may translate along a translation path that is approximately 2°, approximately 4°, approximately 6°, approximately 8°, approximately 10°, or more from parallel with respect to the feed lip angle. In the illustrated embodiment, the engagement surface 17, 19 are positioned at a perpendicular angle with respect to the translation path of the engagement surface 17, 19. However, in some embodiments, engagement surfaces 17, 19 may be positioned at a non-perpendicular relative to their direction of travel during translation. For example, an engagement surface may be positioned at approximately 2°, approximately 4°, approximately 6°, approximately 8°, approximately 10°, approximately 12°, approximately 14°, approximately 16°, approximately 18°, approximately 20°, or greater angle relative to its direction of travel during translation.

The pistons 16, 18 may also be configured to translate within approximately a same plane, as shown. However, it is contemplated that, in some embodiments, one or both of the pistons 16, 18 may translate in multiple planes and/or the pistons 16, 18 may translate in different planes.

The loader 10 may comprise a magazine interface 27 for interfacing with a magazine 400. For example, FIG. 2 illustrates a magazine interface 27 comprising one or more magazine fittings 28 including clips for securing a position of the magazine 400 with respect to the pistons 16, 18. In various embodiments, example magazine fitting 28 may include brackets, retainer clips, tongue and groove guides, slots, interference fit, tapered fit, slide joint, or other retention structure configurations to couple magazines 400. In some embodiments, the loader 10 may also comprise a feeder interface, when the loader 10 is configured to interface with a feeder, as described in more detail below. In various embodiments, the loader 10 may comprise an adapter interface wherein the adapter interface comprises one or both of the magazine or feeder interface.

In various embodiments, the loader comprises a body 12 (FIG. 2). The body 12 may house various internal components operable to engage and manipulate cartridges 55, such as movable, e.g., actuatable, projections or pistons 16, 18. The body 12 may provide one or more mounts for coupling components and/or magazines 400 to the body 12. Mounts may be utilized to anchor components, magazines 400, and/or movements of the same relative to the body 12. For example, mounts may fix components and/or magazines 400 in a stationary position or movably couple components and/or magazines 400 with respect to the body 12. In the illustrated embodiment of FIG. 2, the body 12 houses two pistons 16, 18 movable to translate respective engagement surfaces 17, 19 along respective translation paths. In one embodiment, the body 12 may house two or more pistons 16, 18 configured to move sequentially to load a cartridge into a magazine, e.g., as depicted in FIGS. 1A-1E or described elsewhere herein. For example, a first piston 16 may be configured to translate and drive a cartridge 55 toward a base 430 of the magazine 44 by depressing the magazine's spring-loaded follower 440. A second piston 18 may be configured to complete the loading process by translating and thereby pushing the cartridge 55 to a back 460 of the magazine 400 so that the cartridge 55 is contained within the magazine 400 by its feed lips 450. The body 12 may include various mounts from which movement of pistons 16, 18 and/or components configured to assist in piston movement may relatively move.

In some embodiments, the body 12 may include one or more guides, e.g., guide surfaces, for guiding movements of components and/or cartridges 55. Guides may be integral with the body 12 or may comprise components that couple to the body 12. In one embodiment, the body 12 may include mounts for mounting one or more guides or guide surfaces. For example, the loader system 2 may include a plurality of interchangeable guides that may be selected for modifying translation parameters of components and/or cartridges 55.

In various embodiments, the loader system 2 may include various biasing members to bias various components during operation. Biasing members, for example, may be attached between components to bias the components relative to each other or may attach between one or more components and the body 12. Example biasing members may include springs, elastic materials, elastomeric materials such as polymer bands, shape change materials, and reciprocal movement configurations. In some embodiments, biasing members may bias piston translation to a retracted or extended position.

While the body 12 is preferably a single unit from which pistons 16, 18 move, in some embodiments, the body 12 may comprise multiple units, e.g., a first unit from which a first piston 16 translates and a second unit from which a second piston translates 18, wherein the first and second units may be positioned relative to a magazine 400 and cartridge 55 such that the first piston 16 engages the cartridge 55 during a first loading stage and the second piston 18 engages the cartridge 55 during a second loading stage.

The loader system 2 described with respect to FIGS. 1A-2, or other loader system according to the present disclosure, may include various combination of drives for initiating force to drive pistons 16, 18 and/or force translators configured to direct the force from the drives to the pistons 16, 18.

For example, the loader system 2 may include one or more drives selected from a lever, crank, knob, sliding bar, pneumatic solenoid, solenoid actuator, motorized linear actuator, motor stepper motor, servo motor, or any other suitable drive. In an above or another embodiment, the loader system 2 may include one or more force translators selected from a swing arm, ring and pinion gear, rack and pinion gear, worm gear, rocker arm, cam lobe, cam plate, belt pulley, or any other suitable force translator for translating force provided by a drive to pistons 16, 18.

In various embodiments, an automated or electric loader configuration may include a pneumatic solenoid, solenoid actuator, motorized linear actuator, motor, stepper motor, and/or servo motor, for example. In one example, an electric version with actuators may exclude gears, levers and any secondary force translators, and utilize just two actuators as primary drives.

In one embodiment, the loader system 2 includes two motorized linear actuators or linear solenoid actuators (not shown) which control the sequential operation of the pistons 16, 18 to load a cartridge 55 into a magazine 400. In this configuration, a power source may be used to power and/or trigger the actuators. In one example, a first actuator plunger may drive the first piston 16. At full extension, the first actuator may trigger the second actuator to drive the second piston 18. Optionally, a time-delayed relay may be utilized to trigger the second actuator.

In another embodiment, the loader system 2 may include stepper or servo motors (not shown). In one example, a dedicated motor with limited rotation may be used to control each piston 16, 18 individually. In another example, a single motor may be used to drive both pistons 16, 18. A single motor implementation may utilize a combination of force translators to control each piston, whereas each motor in a dedicated, double-motor implementation may utilize its own force translator to control its dedicated piston.

In some embodiments, a power source may be utilized to run motor(s) and a manual switch may be incorporated to trigger the process. Activation of the switch may be used to load a single cartridge 55, or a counter may be used to set the number of desired cycles for the system to run with each triggering of the switch.

In various embodiments, the loader system 2 includes a manually driven system in which a user applies manual force to a lever, crank, knob or sliding bar to provide the force to translate one or more pistons 16, 18. In some such configurations, the drive device may utilize a combination of force translators to control each piston 16, 18 to load a cartridge 55 into a magazine 400.

Rotational drives such as a lever, crank or knob, may be used to attach to a swing arm, worm gear, cam plate or pinion gear, for example. The force translators may couple to pistons 16, 18 or utilize secondary levers, swing arms, or cam lobes to drive a piston 16, 18 or tertiary force translator.

Various embodiments employing a rack and pinion, the pinion gear of the drive may ride along a rack mounted to a piston. In an automated configuration, a stepper motor may have a pinion gear drive a rack gear mounted to the first piston 16, which may be configured to drive the piston 16 a predetermined distance and hold the piston 16 in place while the second piston 18 begins and completes its movement.

In a further embodiment, a rack gear can be substituted with a ring gear, in which the drive rotates a pinion gear, which turns a ring gear attached to a swing arm or cam lobe. The swing arm may couple, e.g., directly connect, to a piston, while a cam lobe may rotate and ride along a piston acting as a tappet.

In one automated configuration, two servo or stepper motors coupled, e.g., directly attached, to cam lobes may be used. The lobes may ride on the pistons 16, 18, which act as tappets and travel a specified distance to drive the cartridge 55 into the magazine 400.

In various embodiments, programmable stepper or servo motors may be programmed to run in sequence. A step counter, for example, may rotate a first motor a set number of times. A first motor shaft may be threaded and screwed into a plate in the back of the first piston 16. Counterclockwise motor rotation may slide the piston 16 away from the motor, while clockwise rotation may pull the piston 16 toward the motor. A second motor may not rotate until the step counter reaches a target number. At that point, the second motor rotates while the first motor remains stationary.

In a further example of the above or another embodiment, the loader system 2 may include an adapter configured to couple between the body 12 and a magazine 400 for loading the magazine 400 via operation of the loader 10. The adapter may be used to hold the magazine 400 during the loading operation. Typically the adapter will hold the magazine 400 in a stationary position relative to pistons 16, 18; however, it is contemplated that the loader 10 may be configured such that the magazine 400 may be moved relative to pistons 16, 18 or engagement surfaces 17, 19 during loading to urge cartridges 55 positioned between engagement surfaces 17, 19 and the feed lips 450 into the magazine 400. In some embodiments, the adapter may be specific to a magazine 400 and/or caliber cartridges 55 or may be suitable for multiple magazines 400 and/or caliber cartridges 55. In one example, the loader system 2 may include a plurality of interchangeable adapters configured to couple to the body 12 to allow a variety of magazines 400 to be loaded via operation of the pistons 16, 18, including single and double stack pistol magazines 400, as well as specific caliber cartridges 55, including, but not limited to, .45 ACP, .40 S&W, 9 mm Luger and .380 ACP centerfire ammunition.

Further to any of the above embodiments or in another embodiment, the loader system 2 may include a feeder apparatus configured to feed cartridges to the loader 10 for loading of a magazine 400. In some embodiments, the feeder may be specific to a caliber of cartridges 55 or may be suitable for multiple caliber cartridges 55. In one example, the feeder may attach to an adapter, which may be an adapter of like caliber, and hold cartridges 55 in queue, allowing them to be loaded into a magazine 400 as needed. In some configurations, the feeder may be configured to scoop cartridges 55 from an industry-standard ammunition tray within a box of ammunition without physically handling the cartridges 55. For example, a user may utilize the feeder to efficiently scoop such cartridges.

Figure 3:
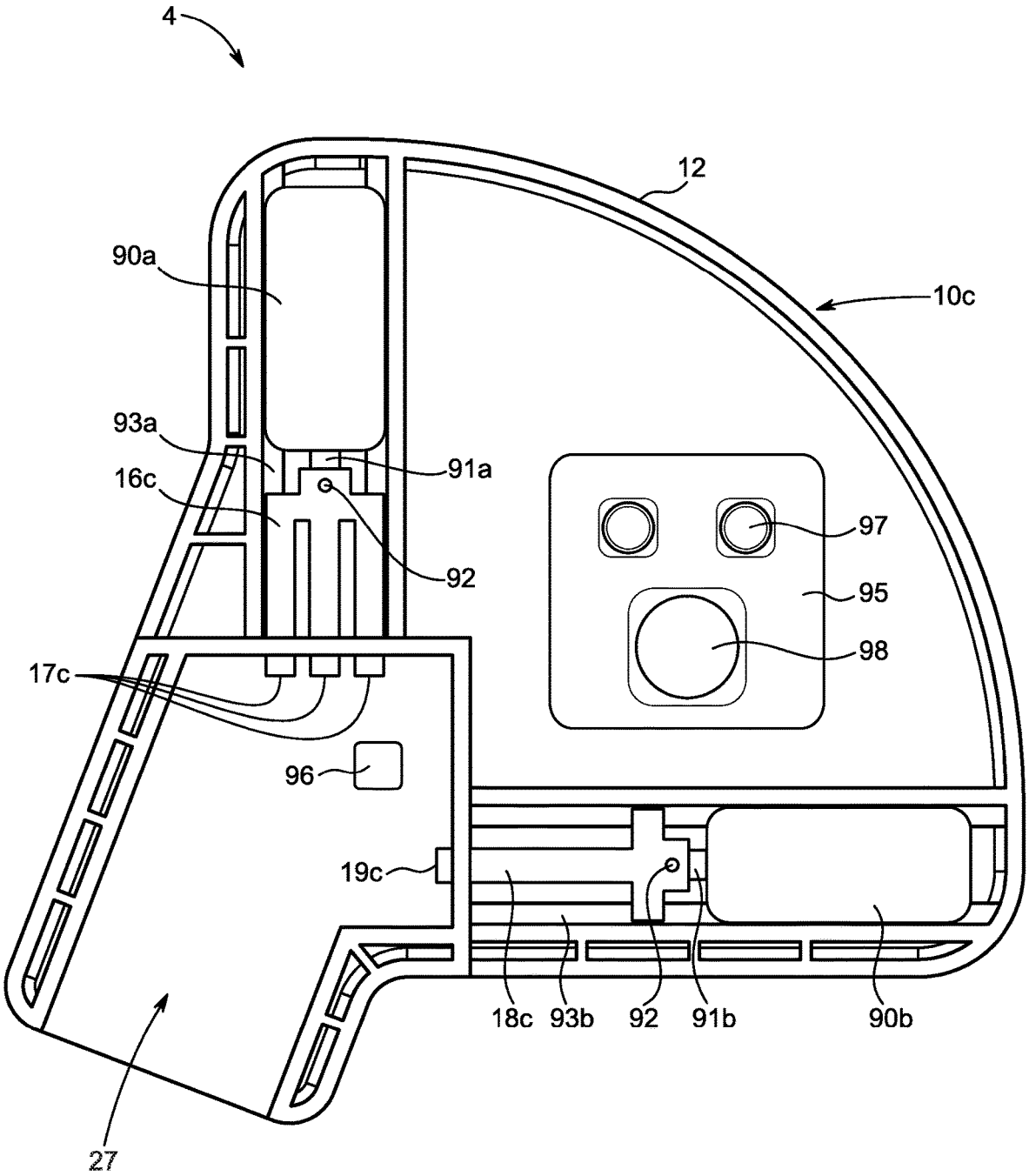
FIG. 3 illustrates a loader system and operation thereof according to various embodiments described herein.

FIG. 3 illustrates an embodiment of a loader system 4 including a loader 10*c* including a case piston 16*c* and a projectile piston 18*c*, each including a respective engagement surface 17*c*, 19*c* for engaging a cartridge. The pistons 16*c*, 18*c* and associated piston engagement surfaces 17*c*, 19*c* are translatable along respective translation paths to load one or more cartridges into a magazine in a manner similar to that described above with respect to FIGS. 1A-1E.

The piston engagement surfaces 17*c*, 19*c* are positioned to translate along approximately perpendicular translation paths. However, the piston engagement surfaces 17*c*, 19*c* may be arranged in other configurations to translate along other translation paths, e.g., any translation path combination described herein.

The loader 10*c* includes a magazine interface 27 for interfacing with a magazine (not shown), either directly or indirectly, e.g., via an adapter. The magazine interface 27 may be similar to that described herein with respect to other embodiments. For example, the magazine interface 27 may include brackets, retainer clips, tongue and groove guides, slots, interference fit, tapered fit, slide joint, or other retention structure configurations to couple magazines and/or adapters to the body 12, directly or indirectly. In some embodiments, the body 12 may also include a feeder interface for interfacing with a feeder, as also described in more detail below. In some embodiments, the body 12 may couple to an adapter comprising a magazine interface for coupling to a magazine and/or a feeder interface for coupling to a feeder.

Each piston 16*c*, 18*c* interfaces with a respective linear actuator 90*a*, 90*b*. Pistons 16*c*, 18*c* couple to the operation of the linear actuators 90*a*, 90*b* directly or indirectly. For example, pistons 16*c*, 18*c* may be driven to translate by an intermediate structure that transfers motion of the linear translator 90*a*, 90*b* to the pistons 16*c*, 18*c*. In some embodiments, pistons 16*c*, 18*c* may include shafts that insert into an actuator 90*a*, 90*b* and are therein translated. In the illustrated embodiment, the pistons 16*c*, 18*c* are slid onto actuator shafts 91*a*, 91*b* and are held in place with an attachment structure, e.g., a screw 92. In other embodiments, the pistons 16*c*, 18*c* may be crimped, welded, or otherwise coupled to actuator shafts 91*a*, 91*b* using other attachment techniques. In one embodiment, the pistons 16*c*, 18*c* comprise a rigid polymer, e.g., nylon. At the actuator shaft interface of piston 16*c*, 18*c* may include a sleeve or slot into which the actuator shaft 91*a*, 91*b* interfaces with the piston 16*c*, 18*c*. A setscrew 92 may be inserted to keep the piston 16*c*, 18*c* from slipping off of the actuator shaft 91*a*, 91*b*. The actuation action of the actuators 90*a*, 90*b* may be configured to be staggered to translate the pistons 16*c*, 18*c* and piston engagement surfaces 17*c*, 19*c* along their respective translation paths in a sequential manner similar to that described with respect to FIGS. 1A-1E. For example, actuator 90*a* may fire to translate the case piston 16*c* and engagement surface 17*c* along its translation path, which may be guided along piston guide 93*a*. When actuator 90*a* has reached full extension, actuator 90*b* may fire to translate the projectile piston 18*c* and engagement surface 19*c* along its translation path, which may be guided along piston guide 93*b*. In a further example, full extension of the actuators 90*a*, 90*b* may be approximately 1 inch; however, longer or shorter extensions may be used. Actuator 90*a* may hold its extension until actuator 90*b* has reached its full extension. After both actuators 90*a*, 90*b* have reached full extension, the actuators 90*a*, 90*b* may retract to return the pistons 16*c*, 18*c* to their resting positions.

In various embodiments, the loader 10*c* may include a controller 95 operable to control operations of the actuators 90*a*, 90*b*. In one example, the controller 95 may include a sensor 96 that detects if a magazine is properly secured and/or inserted with respect to the body 12. The controller 95 may be programmed to prevent operation of the actuators 90*a*, 90*b* unless the sensor detects that a magazine in properly secured. In one example, sensor 96 includes a contact on a micro switch that completes a circuit to relay when a magazine is fully inserted with respect to the body 12 such that the magazine pushes on the contact on the micro switch to complete the circuit, thereby allowing the controller 95 operation of the actuators 90*a*, 90*b*.

The loader 10*c* may include a start switch to initiate power delivery to the actuators 90*a*, 90*b* and/or controller 95. For example, in one embodiment, the controller 95 may include a user interface providing a start switch 97 operable to start a loading operation. As noted above, the controller 95 may prevent or discontinue operation of the actuators 90*a*, 90*b* if the sensor 96 does not detect a magazine is properly inserted. For example, if the magazine is pushed out or otherwise becomes unsecured, e.g., because the magazine has reached capacity or a jam has occurred, the sensor 96 may detect the occurrence and the controller may stop actuation. In one example, a user may interface with the start switch 97 to initiate a full actuation cycle, e.g., translation and return of both pistons 16*c*, 18*c*. In one embodiment, the controller 95 may provide cycle select interface 98 allowing a user to select a number of cycles and/or cycle parameters, e.g., extension length, translation angles, etc. In one example, the start switch 97 may operate in conjunction with the cycle select interface 98, which may be a dial for example, to complete one full cycle or in conjunction with the cycle select interface 98, run a designated number of cycles. The loader system 4 illustrated in FIG. 3 may further include a cover (not shown) that interfaces with the controller to provide a user interface including one or more of a start switch 97 or cycle select interface 98 along the cover. In some embodiments, the controller 95 may further provide a manual shutdown/kill switch allowing a user to stop operation of the actuators 90*a*, 90*b* before a programmed cycle(s) is complete. While not shown in the illustrated embodiment, the loader 10*c* may include wiring for external power supply and/or battery operation.

In the illustrated embodiment, the engagement surface 17*c* of the case piston 16*c* extends along three prongs. However, in various embodiments, the engagement surface 17*c* may extend along fewer or additional prongs. It is to be appreciated the entire engagement surface 17*c* need not engage the case of a cartridge at the same time or at all.

Figure 4A:
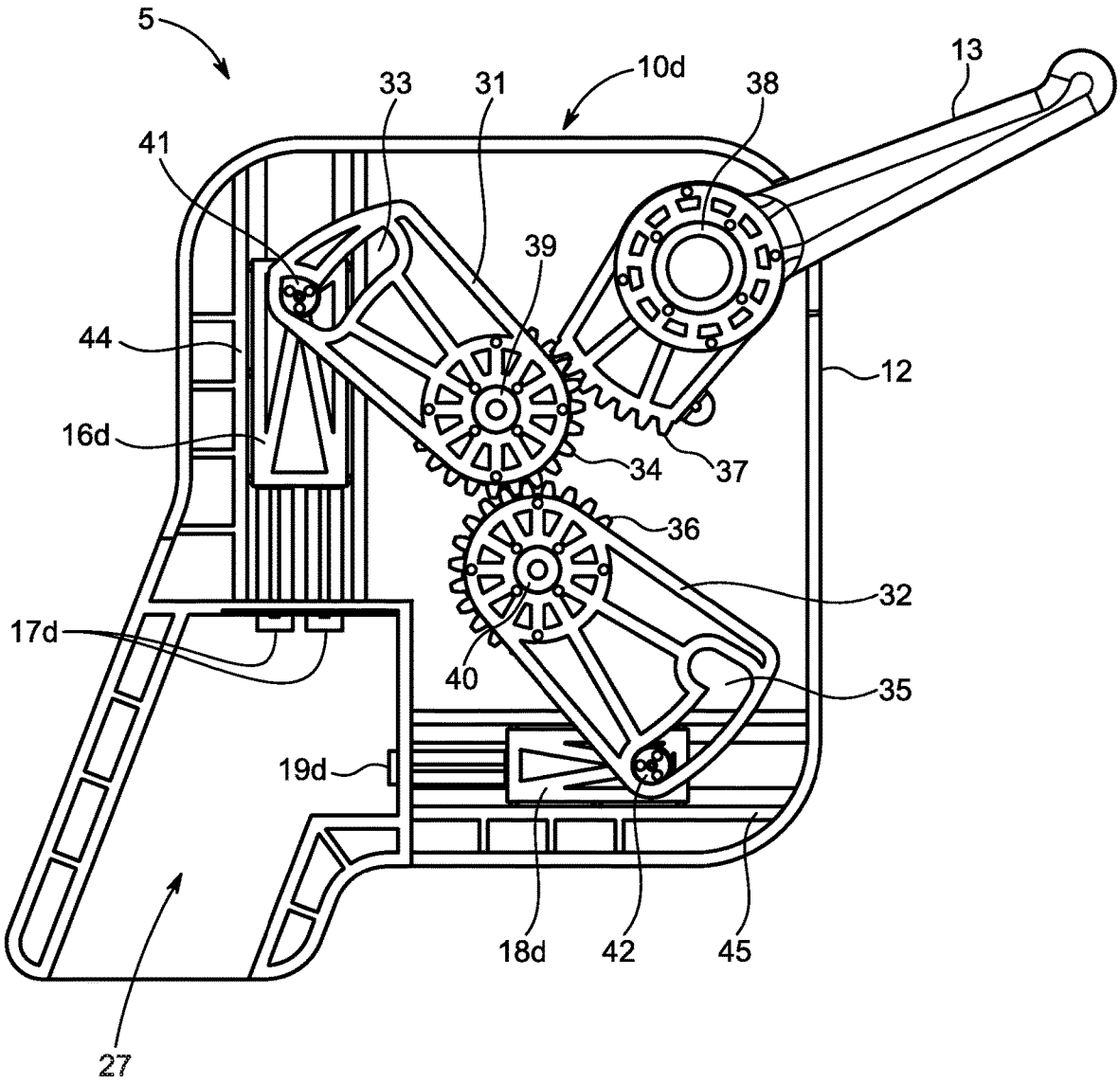
FIGS. 4A-4C illustrate a loader system and operation thereof according to various embodiments described herein.
Figure 4B:
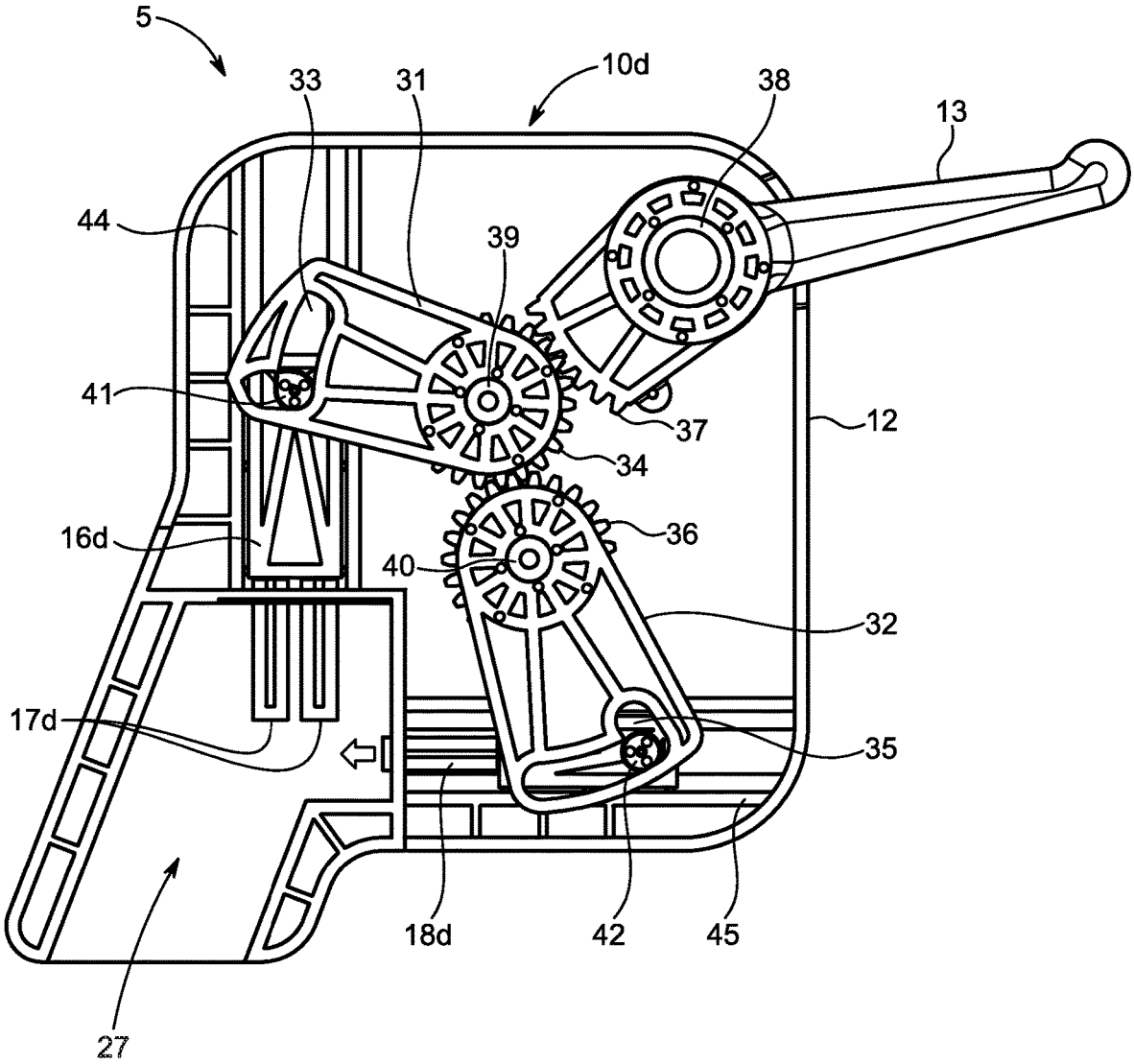
Figure 4C:
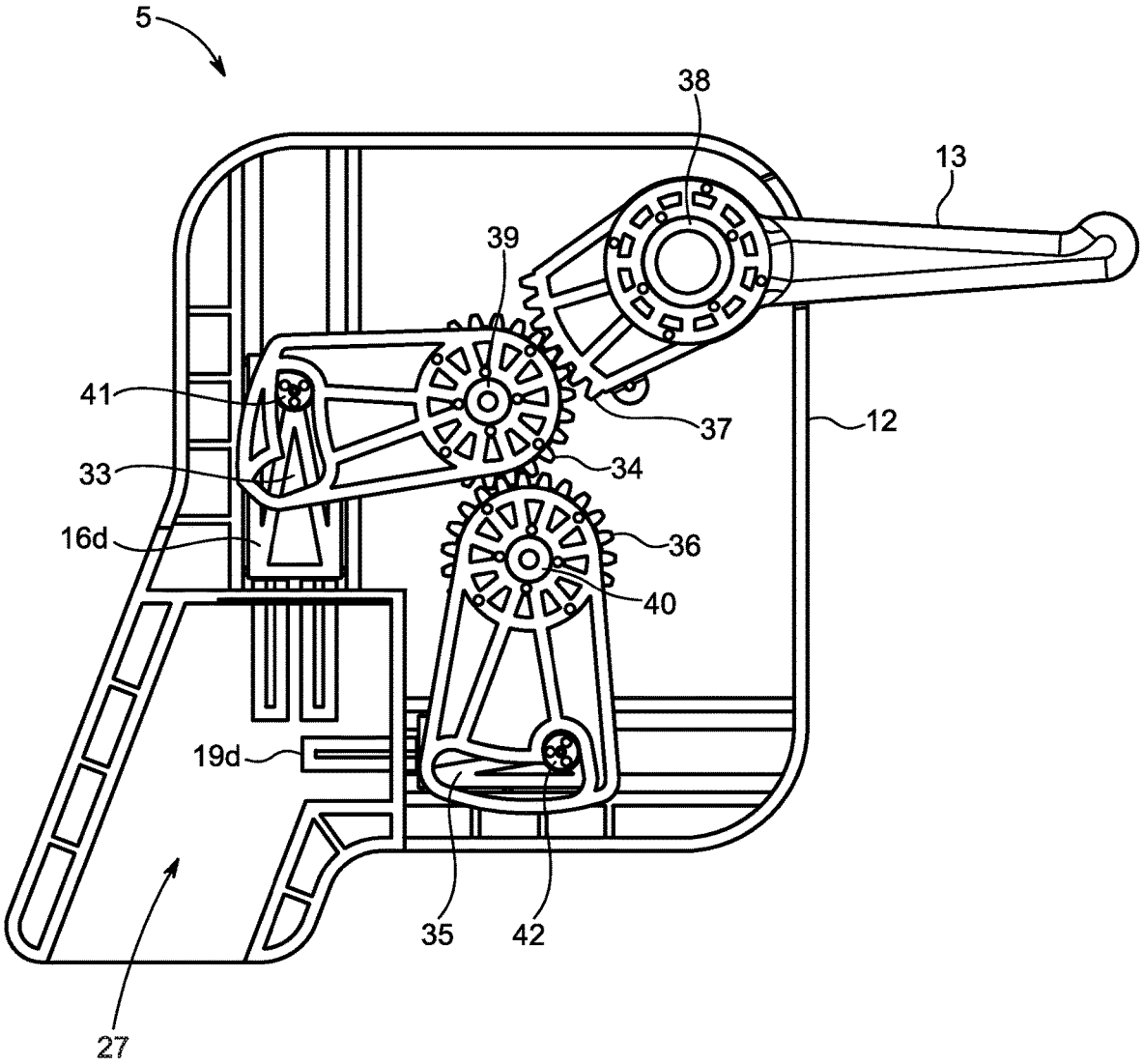

FIGS. 4A-4C illustrate an embodiment of a loader system 5 including a loader 10*d* that incorporates a gearing mechanism for translating force driven by a lever 13 to translate pistons 16*d*, 18*d* according to various embodiments. The loader 10*d* includes a body 12 that houses the lever 13, a first gear 31 and a second gear 32. The first gear 31 includes an L shaped slot 33 at one end and gear teeth 34 along another end. The second gear 32 also includes an L shaped slot 35 at one end and gear teeth 36 at another end, that interfaces with the gear teeth 34 of the first gear 31. Opposite a grasping end of the lever 13, the handle includes gear teeth 37 positioned to interface with the gear teeth 34 of the first gear 31. The lever 13 is pivotably mounted to the body 12 at a pivot whereon pivoting the lever 13 causes gear teeth 37 to pivot the first gear 31 on a pivot 39 via the interface of gear teeth 37, 34. Rotation of the first gear 31 causes the second gear 32 to pivot on pivot 40 via the interface of gear teeth 34 and 36. The loader 10*d* further includes a case piston 16*d* and a projectile piston 18*d*, each including a respective engagement surface 17*d*, 19*d*. The case piston 16*d* includes a shaft 41 that is received within the L shaped slot 33 of the first gear 31. The projectile piston 18*d* includes a shaft 42 that is received within the L shaped slot 35 of the second gear 32.

The loader includes a magazine interface 27 for interfacing with a magazine (not shown), either directly or indirectly, e.g., via an adapter. The magazine interface 27 may be similar to that described herein with respect to other embodiments. For example, the magazine interface 27 may include brackets, retainer clips, tongue and groove guides, slots, interference fit, tapered fit, slide joint, or other retention structure configurations to couple magazines to the body 12, directly or indirectly. In some embodiments, the body 12 may also include a feeder interface for interfacing with a feeder, as also described in more detail below. In some embodiments, the body 12 may couple to an adapter comprising a magazine interface for coupling to a magazine and/or a feeder interface for coupling to a feeder.

Operation of the loader 10*d* via clockwise rotation of the lever 13 causes the pistons 16*d*, 18*d* and piston engagement surfaces 17*d*, 19*d* to translate along translation paths to thereby engage and load a cartridge similar to that described with respect to FIGS. 1A-1E. With respect to the interaction of the components of loader system 5, FIG. 4A illustrates the loader 10*d* at rest. Clockwise rotation of the lever 13 causes the lever 13 to pivot on pivot 38 to cause the gear teeth 37 to pivot the first gear 31 on pivot 39 in a counterclockwise direction via the interface of gear teeth 37, 34. The pivot of the first gear 31 drives the case piston 16*d* downwardly along guides 44 into the cavity of the magazine interface 27 as the shaft 41 moves from one end of the short leg of L shaped slot 33 to the second end of the L shaped slot 33, as shown by comparison of FIG. 4A and FIG. 4B, wherein the loader system 5 has completed a first stage through an initial rotation, approximately 15°, of the lever 13. In FIG. 4B, the ease piston 16*d* is shown in its final position. During the first stage, pivoting of the first gear 31 causes the second gear to pivot on pivot 40 in a clockwise direction via the interface of gear teeth 34, 36. During this pivot, shaft 42 slides through the long arcuate leg of L shaped slot 35 to the short leg of L shaped slot 35, to avoid translation of the projectile piston 18*d* during the first stage. The second stage of the loading operation is depicted by comparison of FIG. 4B and FIG. 4C. As the lever 13 is pivoted further, shaft 42 reaches the short leg of L shaped slot 35 such that further pivoting of the second gear 32 drives the projectile piston 18*d* along guides 45 along a translation path perpendicular to the translation path of the case piston 16*d* as shaft 24 moves between ends of the short leg of L shaped slot 35. During the second stage, shaft 41 slides through the long arcuate leg of L shaped slot 33 and remains in the translated position. The sequential translation of the pistons 16*d*, 18*d* may be utilized to load cartridges into a magazine as described with respect to FIGS. 1A-1E. After a cartridge is loaded, the lever 13 may be pivoted in a counterclockwise direction to reverse the movements and return the loader system 5 to its initial resting position (FIG. 4A). In the illustrated embodiment, the engagement surface 17*d* of the case piston 16*d* extends along two prongs. However, in various embodiments, the engagement surface 17*d* may extend along fewer or additional prongs. It is to be appreciated the entire engagement surface 17*d* need not engage the case of a cartridge at the same time or at all.

In various embodiments, the loader system 5 illustrated in FIGS. 4A-4C may comprise an automated or electric configuration wherein, rather than a lever, the loader 10*d* utilizes a step motor with the same size pinion gear. In one example, loader 10*d* may be configured such that the step motor may be rotated approximately 30 degrees and return with every cycle.

Figure 18:
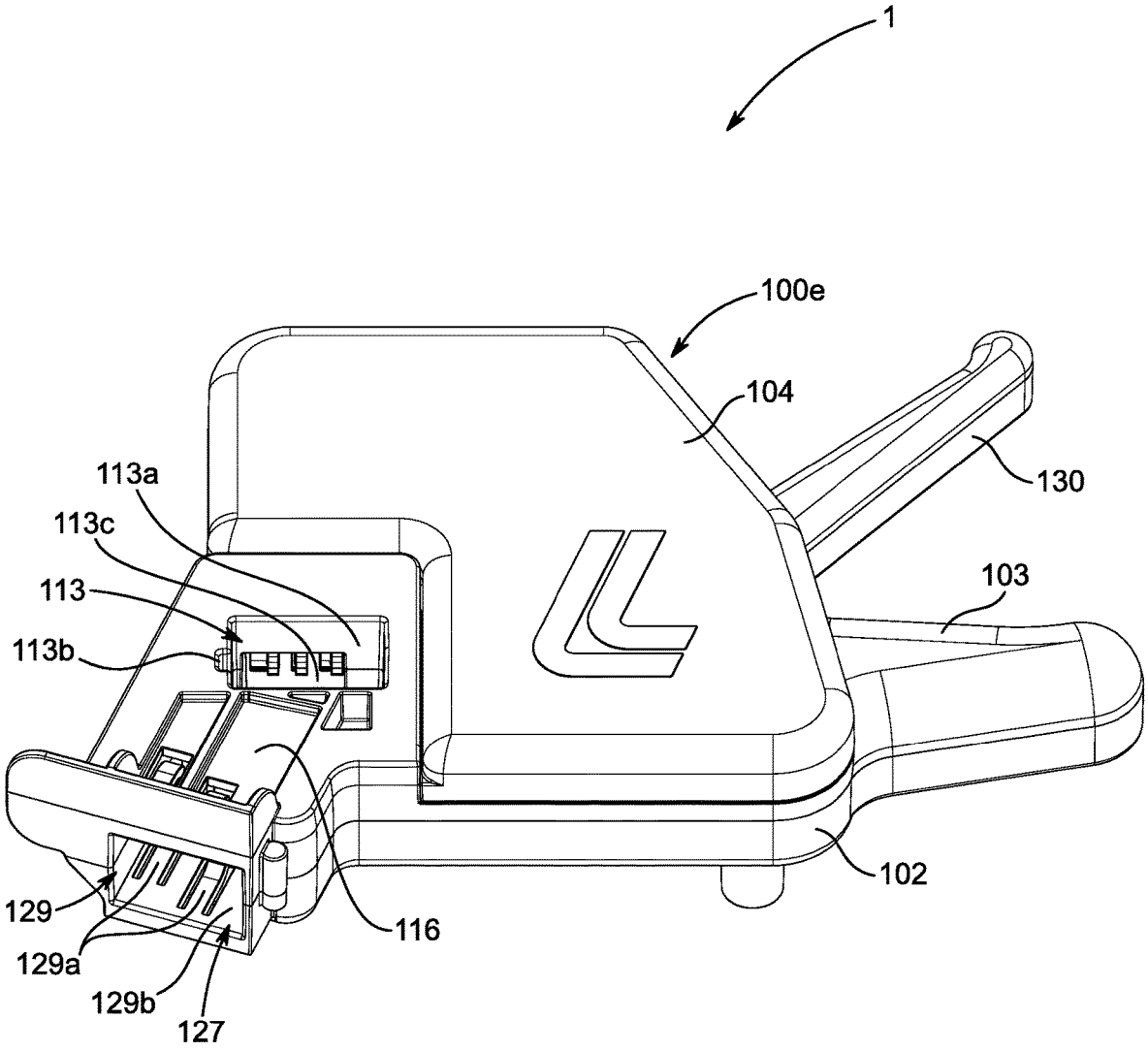
FIG. 18 illustrates a loader including a magazine interface for directly coupling a magazine to the body according to various embodiments described herein.
Figure 19A:
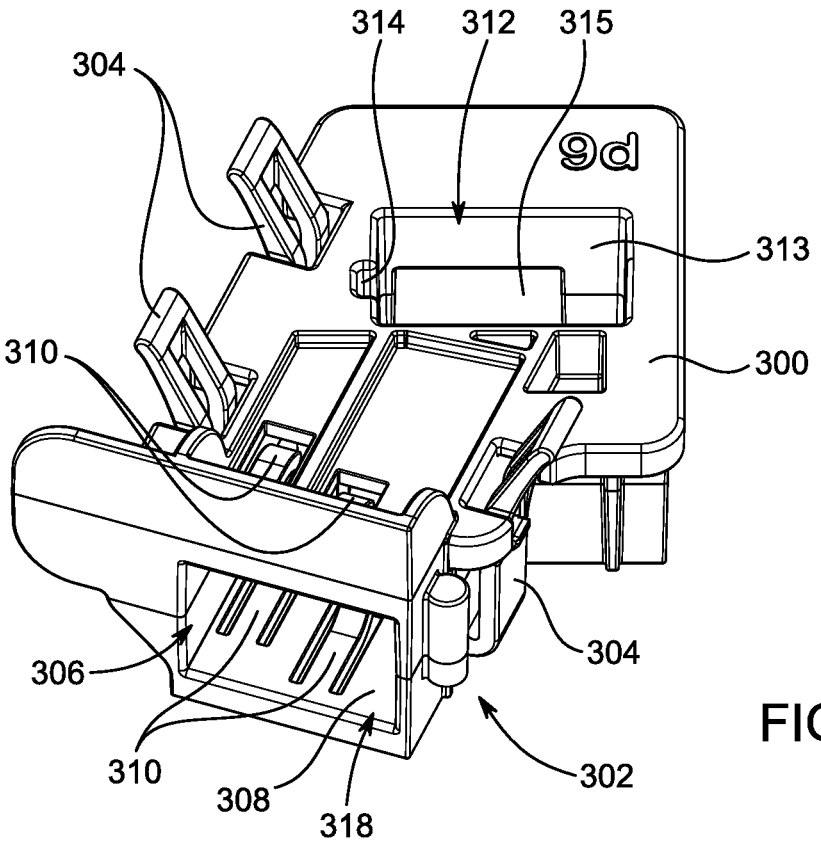
Figure 19B:
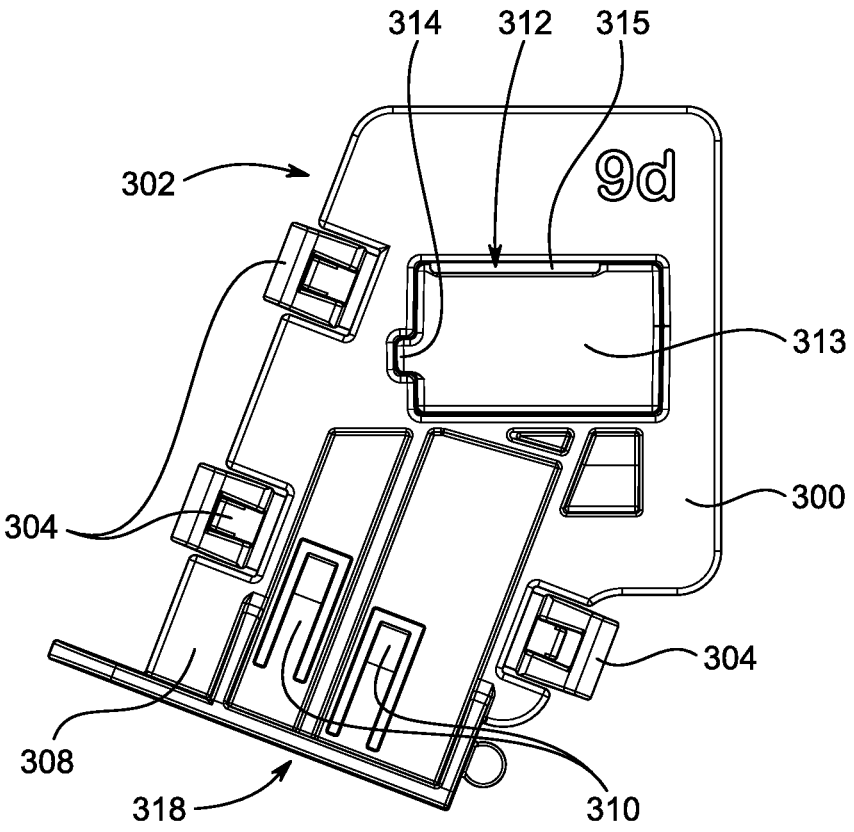

FIGS. 5-12B, 18, & 20A-21C illustrate various embodiments of a loader system 8 and components thereof comprising a lever actuatable loader 100 according to various embodiments, FIGS. 13A-17B illustrate various features of a feeder 200 according to various embodiments, and FIGS. 19A & 19B illustrate an example embodiment of an adapter 300 wherein like features are identified by like numbers. It will be appreciated that while the feeder 200 and adapter 300 may be described with respect to the loader system 8 including a lever 130 operable loader 100, the feeder 200 and/or adapter 300 may be used in other loader systems, such as any loader system according to the present disclosure.

Figure 5:
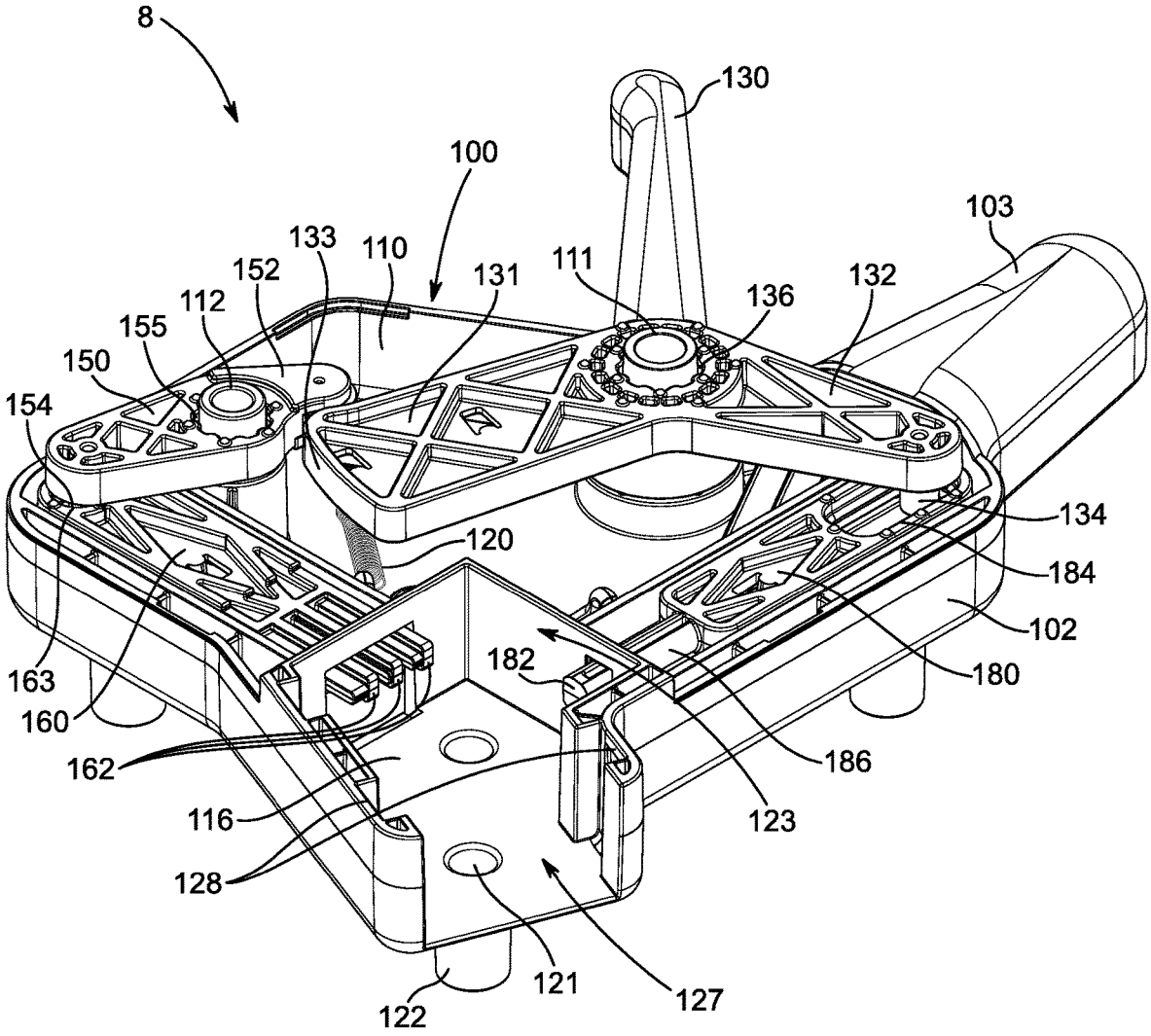
FIG. 5 illustrates a perspective view of a loader system according to various embodiments described herein.
Figure 6:
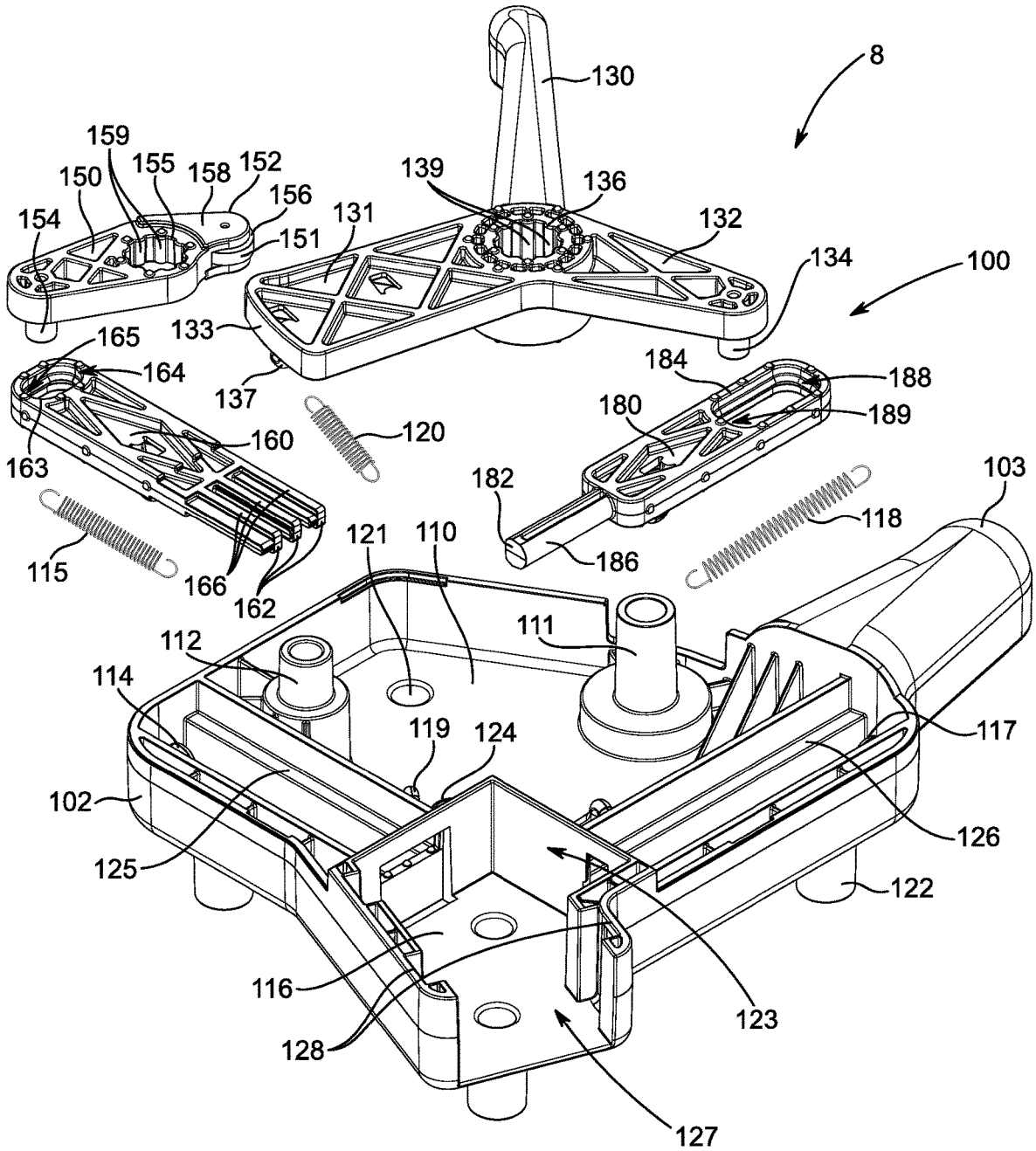
FIG. 6 illustrates an exploded view in perspective of the loader system shown in FIG. 5 according to various embodiments described herein.

With general reference to FIGS. 5-6, the loader 100 comprises a body 102. The body houses various internal components operable to engage and manipulate cartridges, such as movable, e.g., actuatable, projections or pistons. The illustrated body 102 includes a handle 103 and generally houses, a lever 130, a rocker arm 150, a first piston 160, and a second piston 180. With respect to loader 100, the first piston 160 may also be referred to herein as case piston 160 and the second piston 180 may also be referred to herein projectile piston 180. Also as noted above references to pistons with respect to translation paths are applicable to the engagement surfaces; however, in some embodiments, additional structures including the illustrated may be excluded or associated with other components. Thus, translation paths with respect to pistons should be considered to refer to engagement surfaces.

As most clearly shown in FIG. 5, the body 102 includes a frame 110 having a rigid construction for providing mounting points for components. The frame 110 includes one or more mounts for coupling components and/or magazines to the body 102. As introduced above, mounts may be utilized to anchor components, magazines, and/or movements of the same to the body 102.

In the illustrated embodiment, the frame 110 includes a plurality of mounts including a lever pivot mount 111 for pivotably coupling the lever 130 to the frame 110, a rocker arm pivot mount 112 for pivotably coupling the rocker arm 150 to the frame 110, a case piston return bias mount 114 for mounting a case piston return bias member 115 that biases the case piston 160 to a retracted or resting position, a projectile piston return bias mount 117 for mounting a case piston 160 return bias member 118 that biases the projectile piston 180 to a retracted or resting position, and a lever return bias mount 119 for mounting a lever return bias member 120 that biases the lever 130 to an expanded or resting position with respect to the handle 103.

The frame 110 may also include mounts comprising mounting holes for mounting various accessory components. For example, the illustrated frame 110 includes a plurality of pedestal mounting holes 121 for mounting pedestals or feet 122. In some embodiments, the body includes a cover 104 (see FIG. 7) that mounts to a cover boss 124 (see also FIG. 21A) in the frame 110. As shown the cover boss 124 is located toward the center of the body 100; however, additional cover bosses and/or cover bosses located elsewhere along the frame 110 may also be used as well as other cover 104 attachment techniques may be used.

The frame 110 further includes one or more guides, e.g., guide surfaces, for guiding movements of components. As shown, the frame 110 houses piston guides 125, 126 configured to guide pistons 160, 180 during translation, e.g., extension and/or retraction. The piston guides 125, 126 comprise horizontal and vertical guides along which the pistons 160, 180 glide, which also stabilize and constrain the pistons 160, 180 to the Z/X or X/Y plane. More specifically, piston guide 125 is configured to guide translation of the case piston 160 and a projectile piston guide 126 for guiding translation of the projectile piston 180. In some embodiments, wheels or bearings may be used to promote more efficient sliding. In the illustrated embodiment, molded hemispherical surface contact points are adapted to reduce friction.

It is to be appreciated that while the illustrated body 102 is depicted as including the above mounts and guides, in some embodiments fewer or additional mounts or guides may be used. Further, while the mounts and guides are shown as being integral with the body, e.g., frame 110, in other embodiments, mounts and/or guides may comprise components that themselves are mounted to the body either directly or indirectly, e.g., mounted to another component mounted to the body 102.

The body may be configured to interface with a magazine along a magazine interface 127. For example, the frame 110 may include a magazine interface 127 for coupling a magazine with respect to the pistons 160, 180 such that translation of the pistons 160, 180 loads cartridges into the magazine. In some embodiments, the magazine interface 127 is configured to couple to a plurality of different caliber cartridges and/or magazine types, e.g., caliber, stack configurations, stack sizes, and/or stack angles. The magazine interface 127 may include brackets, retainer clips, tongue and groove guides, slots, interference fit, tapered fit, slide joint, or other retention structure configurations to couple magazines to the body, directly or indirectly. In some embodiments, the body may also include a feeder interface 113 for interfacing with a feeder, as described in more detail below.

As also described in more detail below, the body may be configured for assembly with one or more feeders and/or adapters for loading cartridges into a magazine. For example, the body may be configured to interface with multiple adapters and/or feeders to accommodate different caliber cartridges and/or magazine types, e.g., caliber, stack configurations, stack sizes, and/or stack angles. In various embodiments, the magazine interface 127 and/or feeder interface 113, when present, includes an adapter interface 123 wherein the adapter interface 127 is configured to accommodate one or more magazines and/or one or more feeders. In the illustrated embodiment, the frame 110 includes a magazine interface 127 comprising an adapter interface 123 and a feeder interface 113. The adapter interface 123 comprises adapter mounts 128 configured to accommodate one or more adapters. Adapters may be specific to different caliber cartridges and/or magazine types. In some embodiments, the adapter interface 123 may be configured to interchangeably couple to a plurality of different adapters specific to different caliber cartridges and/or magazine types. Each adapter may also be configured to accommodate one or more feeders for feeding suitable caliber and/or size cartridges to the loader for loading the respective magazines. The adapter mounts 128 include clips for clipping to adapters. Other mounting structures may also be used such as brackets, retainer clips, tongue and groove guides, slots, interference fit, tapered fit, slide joint, or other retention structure configurations.

The case piston 160 and projectile piston 180 each comprise a respective engagement surface 162, 182 for engaging cartridges during translation to thereby urge cartridges into a magazine.

The case piston 160 and projectile piston 180 may be configured to translate in approximately perpendicular directions. However, as described above with respect to FIGS. 1A-4C, the pistons 160, 180 may be configured to translate along paths having axes that intersect at other angles. The pistons 160, 180 may also be configured to translate within approximately a same plane, as shown. However, it is contemplated that, in some embodiments, one or both of the pistons 160, 180 may translate in multiple planes and/or the pistons 160, 180 may translate in different planes.

As explained in more detail below, the engagement surface of the case piston 160 of loader 100 may further include a guide surface for guiding a cartridge while translation of the projectile piston 180 moves the cartridge.

As introduced above, the body 102 includes or incorporates a handle 103. The handle 103 is configured to enable a user to grip the body 102 and generate leverage by placing their palm and thumb around the handle 103 while using their fingers to grab, squeeze, and compress the lever 130 to cause sequential translation of the pistons 160, 180, as described in more detail below.

Figure 7:
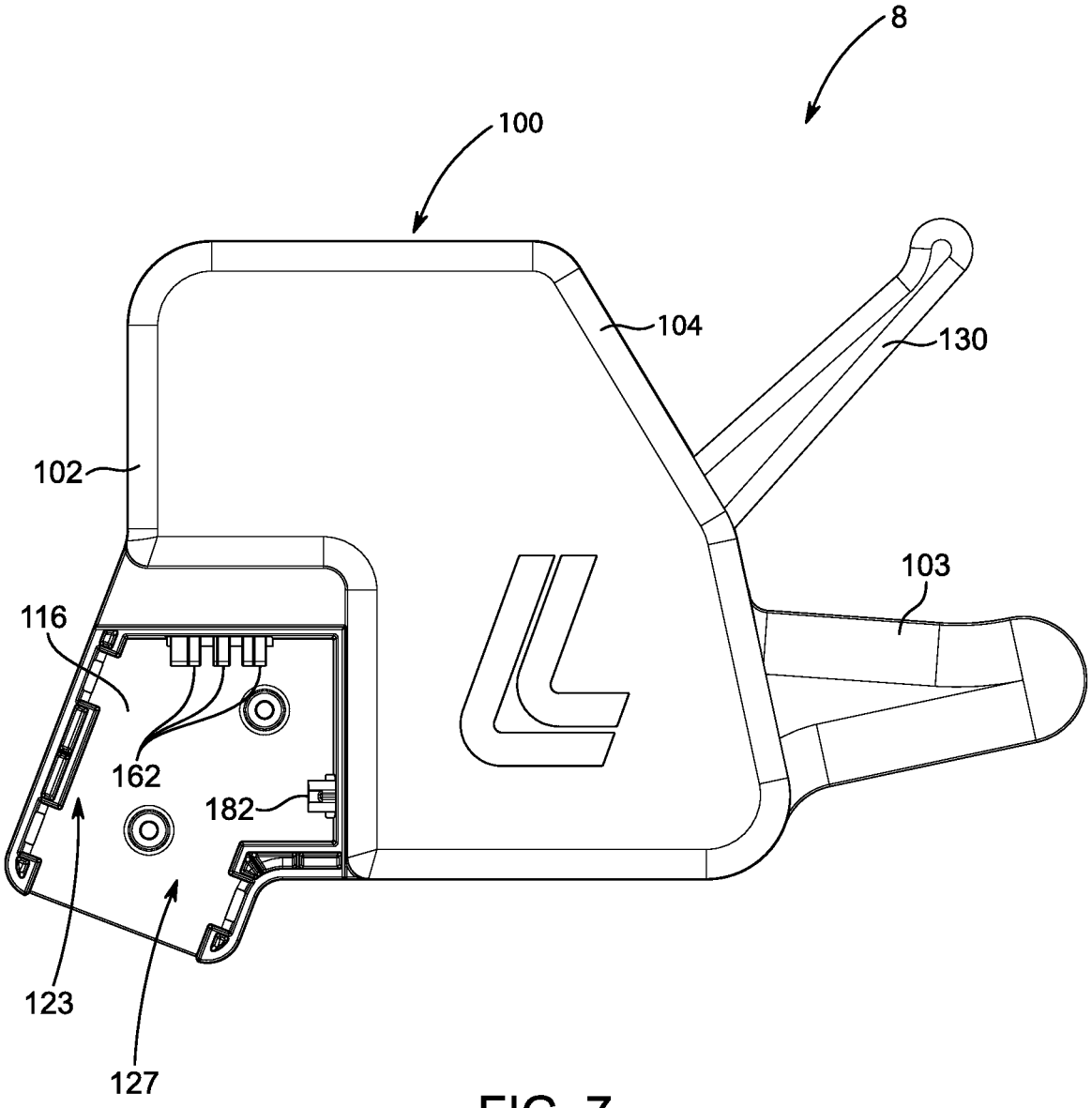
FIG. 7 illustrates the loader system shown in FIG. 5 further including a cover according to various embodiments described herein.

The lever 130 may also be biased toward a resting rotational position, spaced apart from the handle 103, e.g., as shown in FIG. 7, via a lever return bias member 120 (see FIG. 6). For example, a return spring or band may be used to connect the lever 130 to a location on the body that together with the return spring provides automatic return of the lever 130 to its resting position after being fully rotated. As shown, the lever return bias member 120 comprises a band or spring that couples between a lever return bias mount 137 positioned on the lever 130 and the lever return bias mount 119 extending from the frame 110.

As introduced above, the loader 100 may include various components configured to assist in translation of the pistons 160, 180. In the illustrated embodiment, the loader 100 includes a lever 130 that is actuatable by a user to cause translation of the pistons 160, 180.

The lever 130 may be pivotably coupled to the body 102. The operation of the lever 130 may cause sequenced translation of the pistons 160, 180 and hence engagement surfaces 162, 182. For example, the case piston 160 may translate during a first stage and the projectile piston 180 may translate during a second stage. In the illustrated embodiment, the lever 130 includes a lever pivot fitting 136 comprising a socket dimensioned to pivotably mount on the lever arm pivot mount 111 to provide limited rotational movement, toward the handle 103. As shown, the lever arm pivot mount 111 comprises a shaft on which the socket of the lever pivot fitting 136 revolves.

In the illustrated embodiment, the lever 130 is operable to cause the case piston 160 to translate via interaction with the rocker arm 150. The rocker arm 150 may be pivotably coupled to the body 102. As shown, the rocker arm 150 includes a rocker arm pivot fitting 155 configured to pivot on the rocker arm pivot mount 112. In this embodiment, the rocker arm pivot fitting 155 comprises a socket and the rocker arm pivot mount 112 comprises a shaft.

Figure 8A:
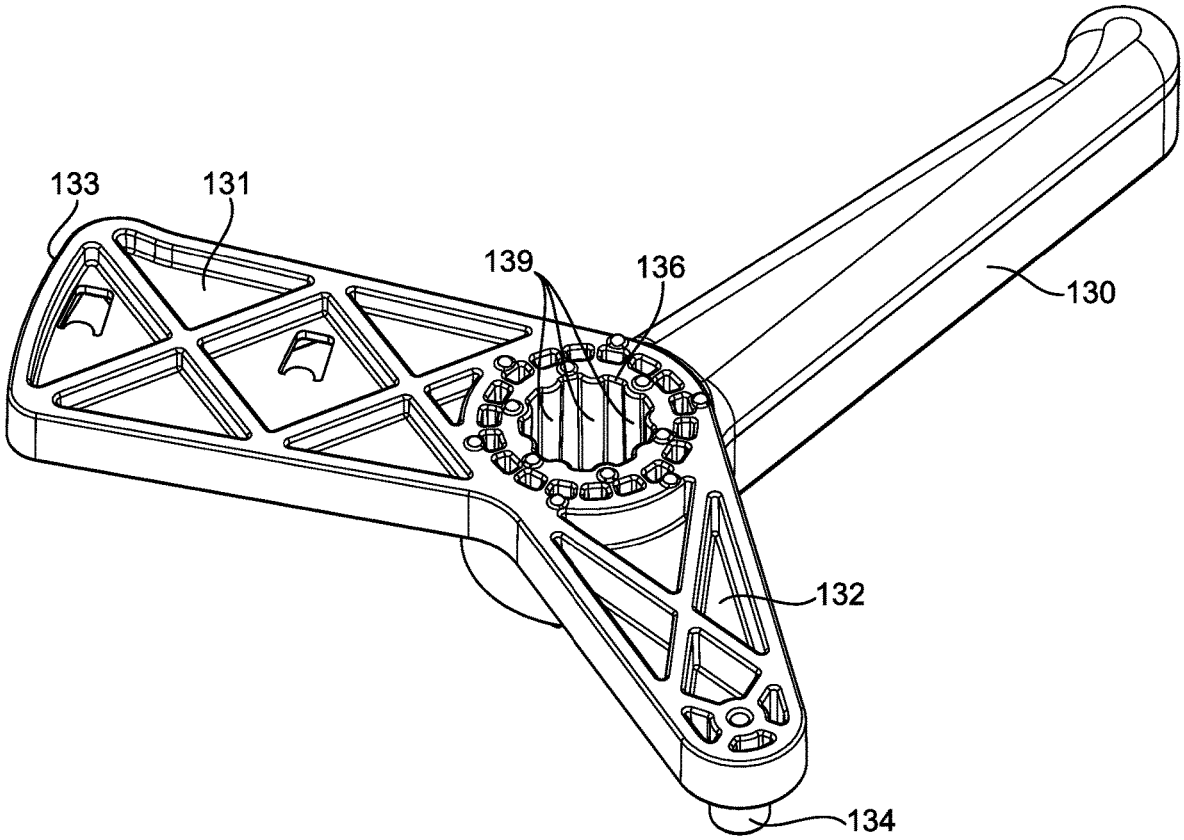
Figure 8B:
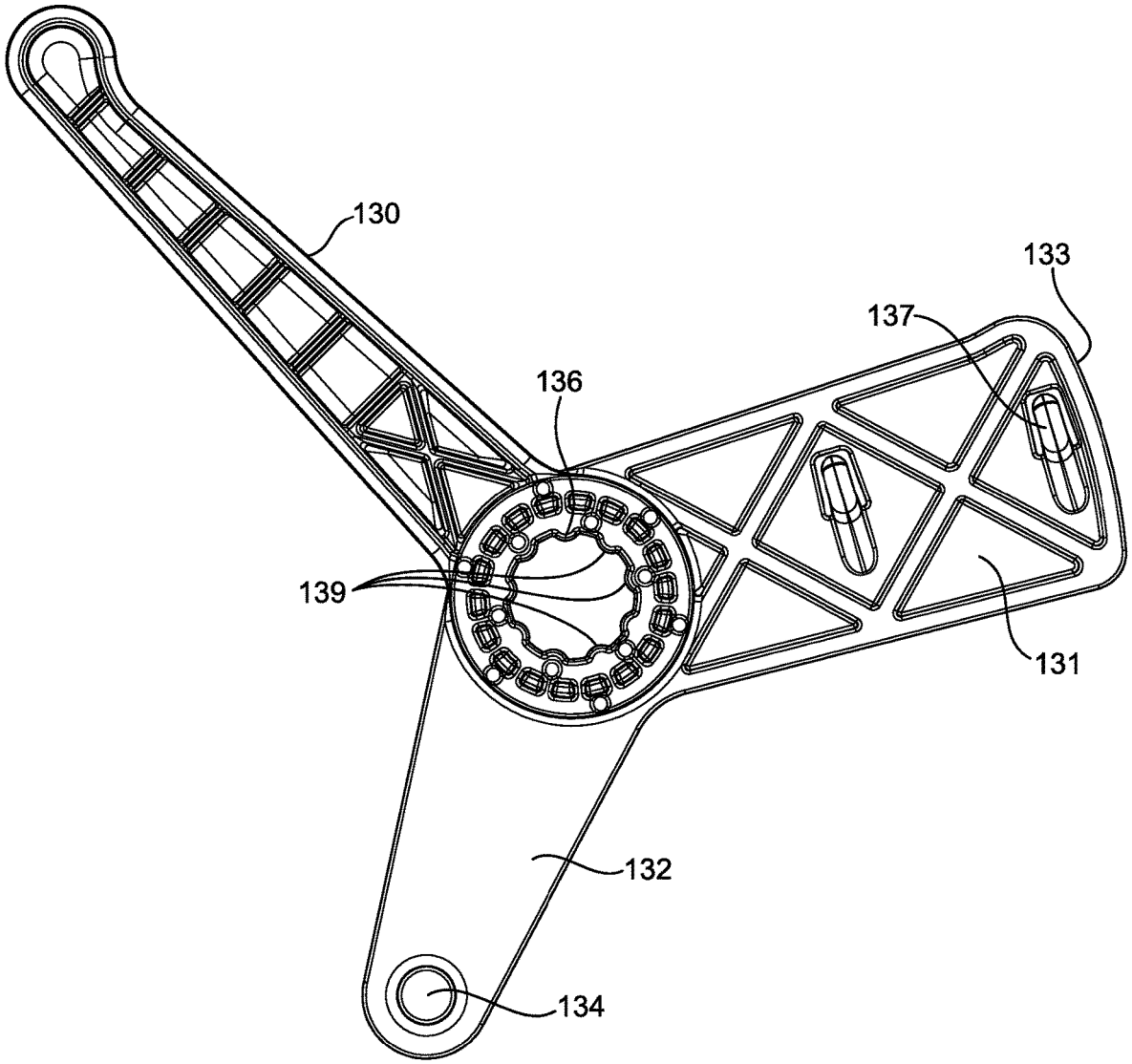
Figure 9A:
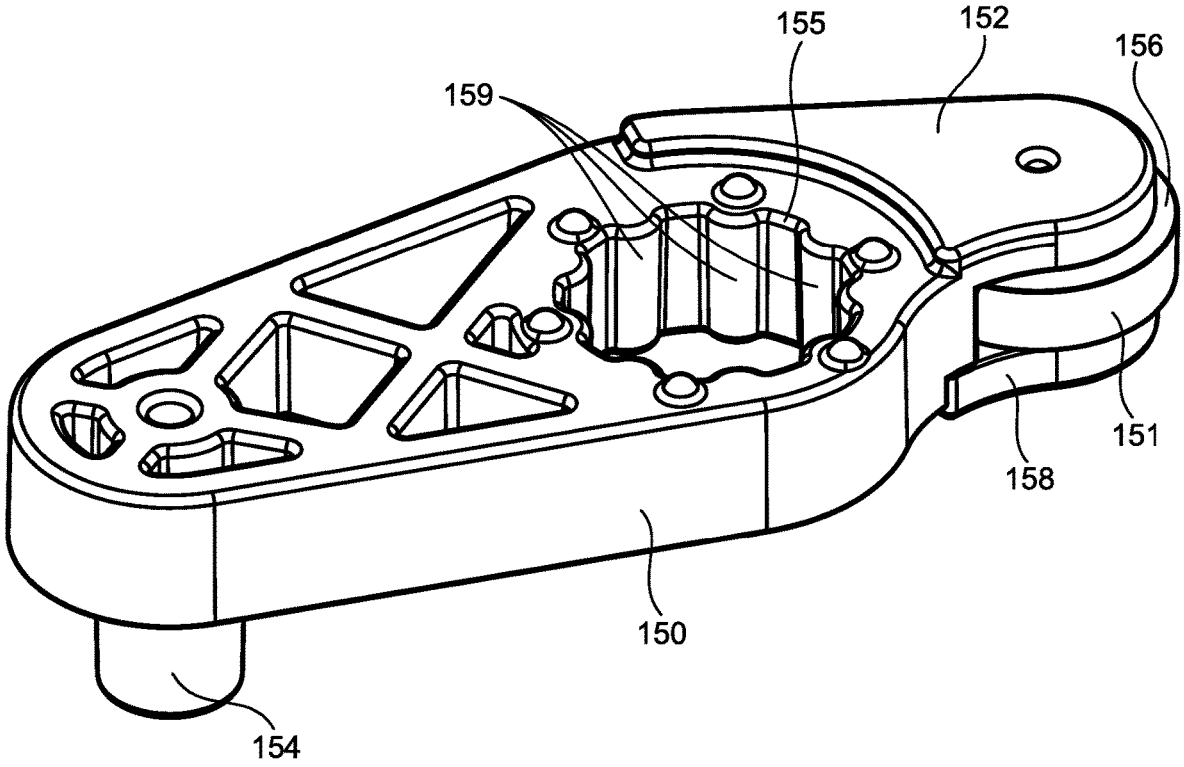
Figure 9B:
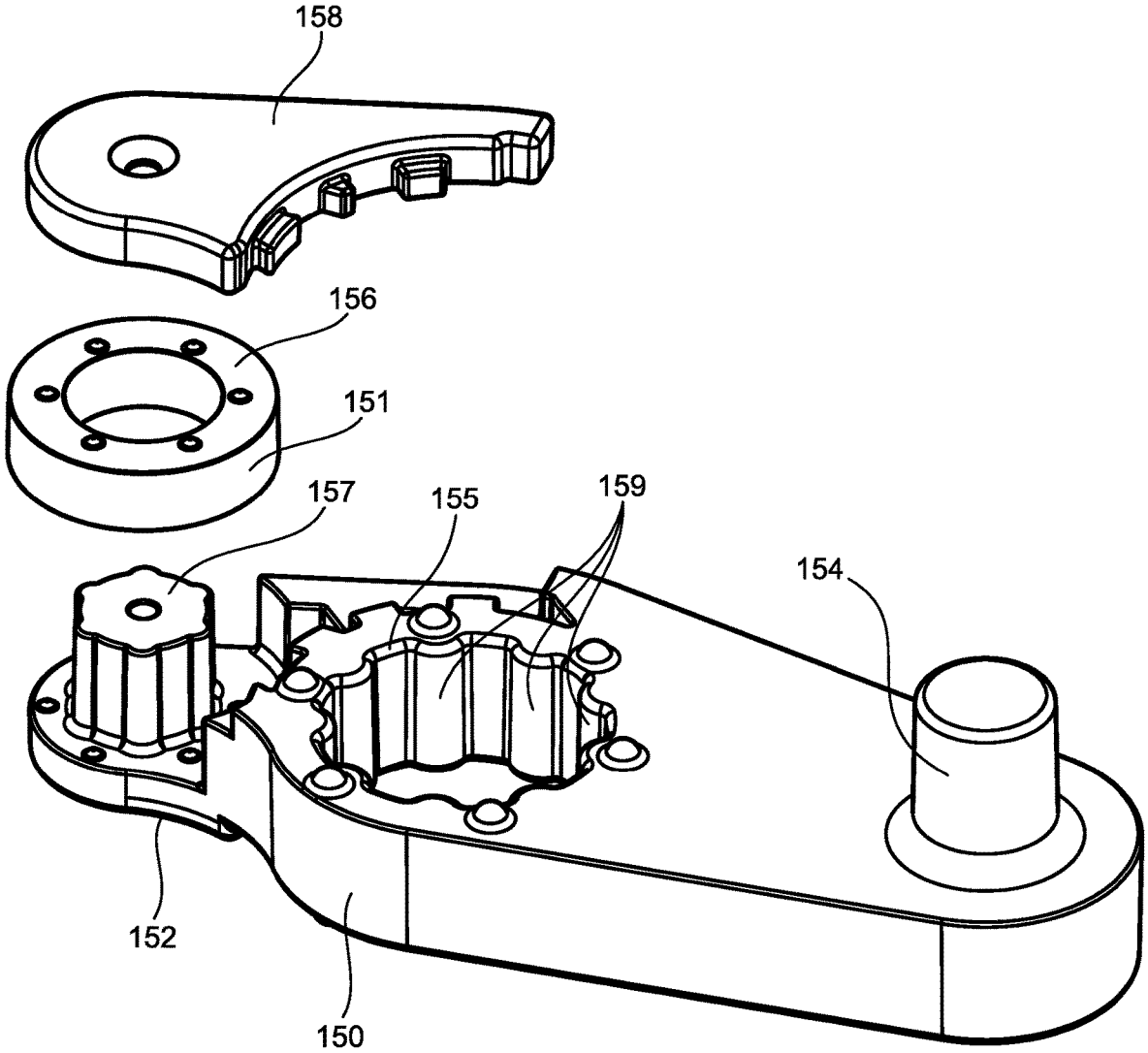
Figure 10A:
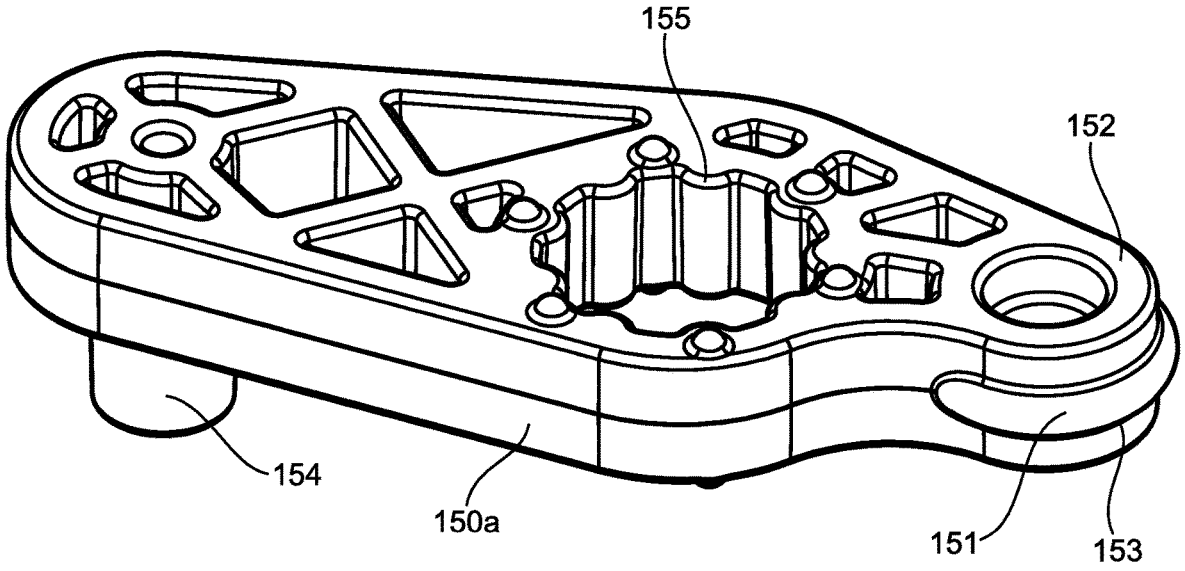
Figure 10B:
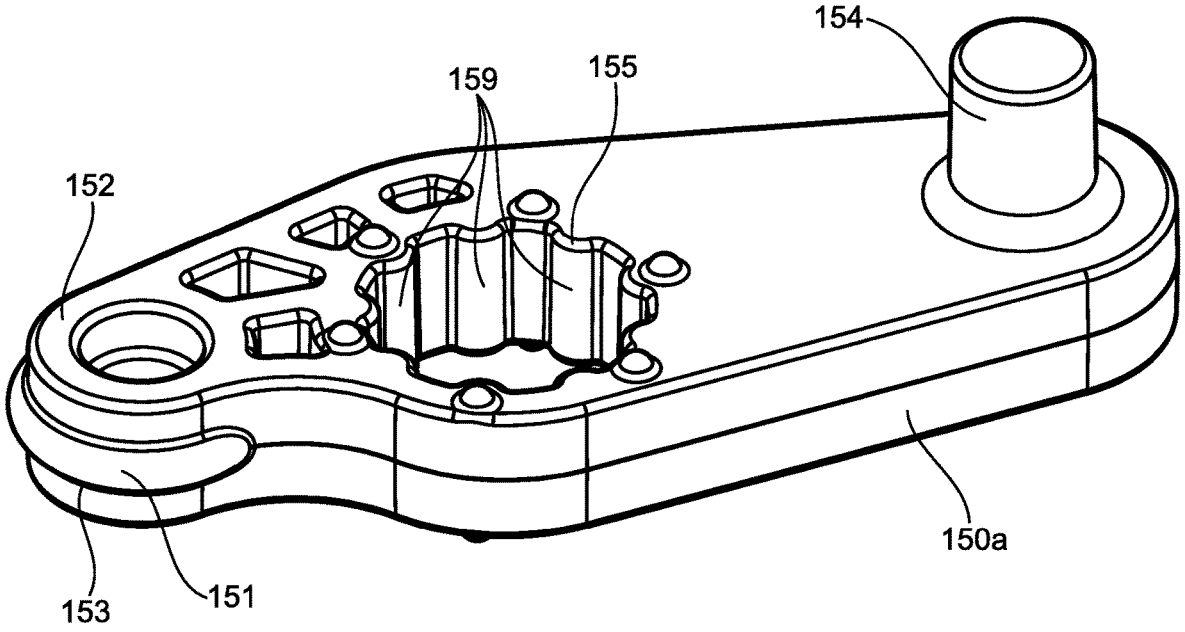

With continued reference to FIGS. 4-7 and further reference to FIGS. 8A & 8B illustrating isolated views of the lever 130 and FIGS. 9A-10B illustrating isolated views of two rocker arm 150, 150*a* variations, the lever 130 generally includes two appendages, a cam plate 131 and a swing arm 132. The cam plate 131 includes a cam plate surface 133 configured to interact with the rocker arm 150 to drive translation of the case piston 160. The swing arm 132 is configured to control translation of the projectile piston 180 via a projectile piston coupling 134.

As shown, the lever arm pivot mount 111 and rocker arm pivot mount 112 comprise shafts. Additionally or alternatively, the lever 130 and/or rocker arm 150 may employ bearing, bushings or ride directly on the body shafts, for example. It is to be appreciated that in some embodiments, the lever pivot fitting 136 may comprise a shaft and the lever arm pivot mount 111 may comprise a socket and/or the rocker arm pivot fitting 155 may comprise a shaft and the rocker arm pivot mount 112 may comprise a socket.

The lever pivot fitting 136 and/or rocker arm pivot fitting 155 may include a raised surface along interfacing portions of the socket. In one embodiment, one of the lever pivot fitting 136 or the lever arm pivot mount 111 has an interfacing surface having a reduced surface for interfacing with a smooth surface of the other to reduce friction during rotation. In this or another embodiment, one of the rocker arm pivot fitting 155 or the rocker arm pivot mount 112 has an interfacing surface having a reduced surface for interfacing with a smooth surface of the other to reduce friction during rotation. In the illustrated embodiment, the lever pivot fitting 136 and rocker arm pivot fitting 155 include molded ribs 139, 159 to provide cylindrical contact points to reduce friction when pivoted on the smooth surfaces of the respective lever arm pivot mount 111 and rocker arm pivot mount 112.

In operation, as the lever 130 rotates on the lever pivot mount 111, the cam plate surface 133 of the cam plate 131 engages the contact surface 151 along the contact arm 152 of the rocker arm 150 to cause the rocker arm 150 to rotate on the rocker arm pivot mount 112. Rotation of the lever 130 on the lever pivot mount 111 toward the handle 103 also drives corresponding movement of the projectile piston coupling 134. The projectile piston coupling 134 along the swing arm 132 of the lever 130 interacts with the projectile piston 180 along the lever 130 coupling to cause translation of the projectile piston 180. In the illustrated embodiment, the projectile piston coupling 134 has a cylindrical profile and the lever coupling 184 comprises a socket wherein the projectile coupling is configured to be received in the socket to couple at least a portion of the movement of the lever 130 to the projectile piston 180 to cause the piston to translate. The socket of the lever coupling 184 is elongated to allow initial movement of the projectile coupling to move within the socket without causing movement of the projectile piston 180. For example, when the swing arm 132 of the lever 130 rotates during a first stage of rotation, the elongated socket of the lever coupling 184 allows the projectile piston coupling 134 attached to the swing arm 132 to travel freely within the socket from a first end 188 to a second end 189 before causing movement of the projectile piston 180 when engaged along second end 189. In various embodiments, the projectile piston coupling 134 may utilize a bearing, bushing or have direct contact with the socket of the lever coupling 184 of projectile piston 180. The projectile piston coupling 134 may include a smooth surface or a reduced surface area configuration to reduce friction. For example, the projectile piston coupling 134 may include a raised surface along interfacing portions thereof. In one embodiment, one of the projectile piston coupling 134 or the socket of the lever coupling 184 comprises a reduced surface area surface for interfacing with a smooth surface of the other to reduce friction during rotation. In one configuration, the projectile piston coupling 134 includes molded ribs to provide cylindrical contact points to reduce friction.

As introduced above, the loader may include a rocker arm 150. In the illustrated embodiment, operation of the lever 130 transmits movement to the rocker arm 150 for further cause translation of the case piston 160. In particular, the rocker arm 150 is configured to oscillate on the rocker arm pivot mount 112 affixed to the frame 110. A first end of the rocker arm 150 rides along the lever cam plate surface 133, which rotates the rocker arm 150 in a counterclockwise direction (when viewing from the top). A second end of the rocker arm 150 includes the case piston coupling 154 for coupling to the rocker attic coupling 163 to couple movement to the case piston 160. As shown, the case piston coupling 154 comprises a cylindrical shaft and the rocker arm coupling 163 comprises a socket. The shaft inserts into the socket of the case piston 160 to propel the case piston 160 during a first stage of lever 130 rotation, and then sustaining the case piston 160 in a translated position for a remainder of the rotation of the lever 130. As described in more detail below, thereafter, continued rotation of the lever 130 causes translation of the projectile piston 180. The rocker arm coupling 163 and the case piston coupling 154 may be configured for reduced friction in a manner similar to that described above with respect to the lever pivot fitting 136 and the lever arm pivot mount 111. For example, one of the case piston coupling 154 or the rocker arm coupling 163 may include a reduced surface area for reduced friction when engaged with a smooth surface of the other. For example, the rocker arm coupling 163 may include a raised surface along interfacing portions thereof for reduced friction with a smooth surface of the case piston coupling 154. In another example, the case piston coupling 154 includes one or more molded ribs used to provide low-friction contact points, e.g., cylindrical contact points, for reduced friction along the socket of the rocker arm coupling 163.

In various embodiments, the lever 130 and rocker arm 150 may be configured to engage the cam plate surface 133 along a reduced friction interface. In the embodiment illustrated in FIGS. 5, 6, 9A & 9B, the contact arm 152 of the rocker arm 150 comprises a rotatable contact surface 151 configured to rotate against the cam plate surface 133 of the cam plate 131. With specific reference to FIGS. 9A & 9B, the contact surface 151 extends along a perimeter of a wheel 156 that rotatably mounts onto a shaft 157. The wheel may be retained on the shaft 157 by a retainer plate 158. In various embodiments, the rotation connection between the wheel 156 and the shaft 157 may utilize a bearing, bushing or have direct contact therebetween. In the illustrated embodiment, the shaft 157 includes molded ribs to provide cylindrical contact points to reduce friction with the interfacing surface of the wheel 156. In some embodiments, the contact surface 151 of the contact arm 152 does not rotate separate from the rocker arm 150. In one example, the cam plate surface 133 of the cam plate 131 or the contact surface 151 of the contract arm includes a raised surface upon which the other may interface to reduce friction. For example, with reference to FIGS. 10A & 10B, the contact surface 151 of the rocker arm 150*a* includes a raised surface 153 or rib along the contact arm 152 that rides along the cam plate surface 133 of the cam plate 131 of the lever 130. In another example, the contact surface 151 does not include raised surfaces and/or the cam plate surface 133 includes a raised surface.

Figure 11A:
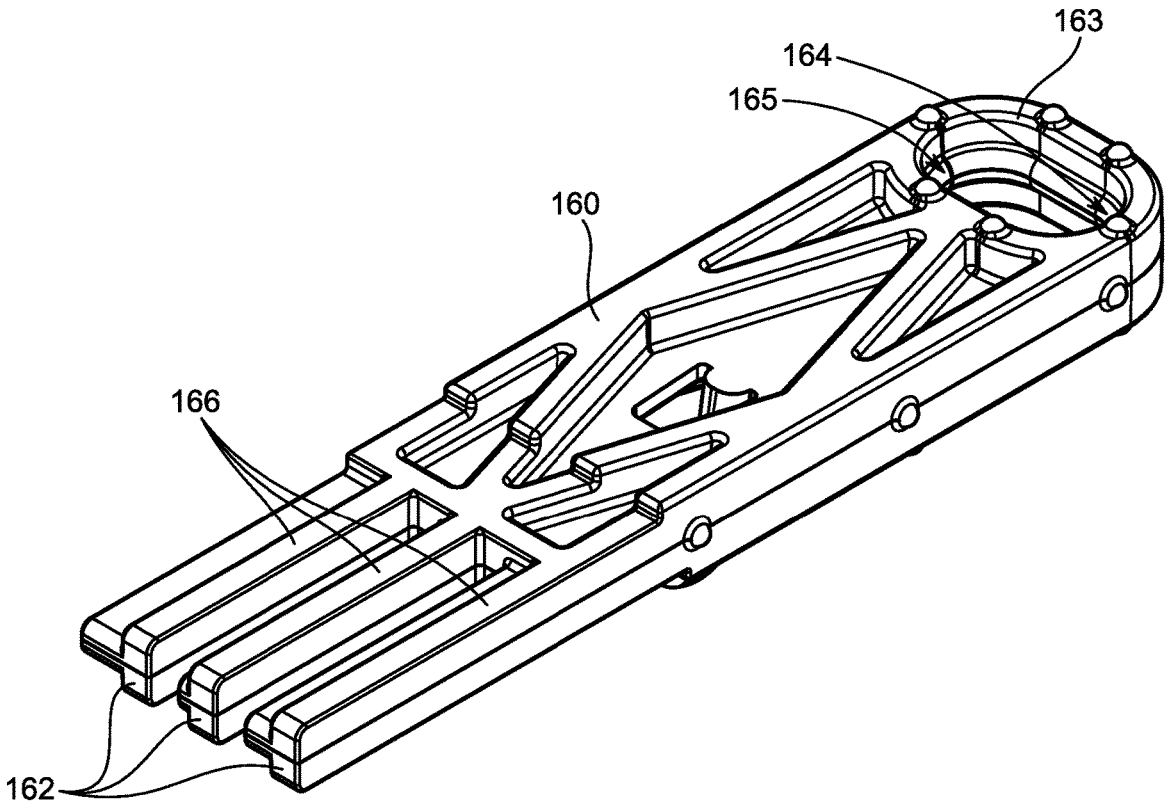
Figure 11B:
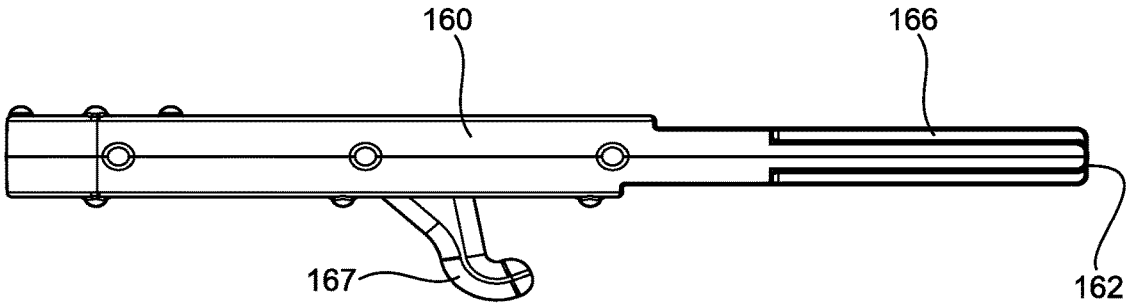

As introduced above, the illustrated case piston 160 includes a rocker arm coupling 163 for coupling to the case piston coupling 154 of the rocker arm 150 to cause translation of the piston. The case piston 160 is operable to push against a cartridge tangent to the case, thereby driving the cartridge directly or indirectly against a magazine follower or the top-most cartridge currently housed within the magazine. Translation of the case piston 160 is guided by case piston guide 125. In the illustrated configuration, the case piston 160 is translated linearly by arcuate movement of the case piston coupling 154 as the rocker arm 150 pivots on the rocker arm pivot fitting 155. To account for the arcuate movement of the case piston coupling 154, the rocker arm coupling 163 includes a larger lateral dimension than the corresponding socket of case piston coupling 154. In the illustrated embodiment, and with further reference to FIGS. 11A-11B showing various views of the case piston 160, the rocker arm coupling 163 includes an oblong socket extending between a first end 164 and a second end 165. During initial rotation of the lever 130, corresponding rotation of the rocker arm 150 on the rocker arm pivot fitting 155 translates the case piston coupling 154 along an arcuate path in a counterclockwise direction. The arcuate path drives the case piston 160 along its translation path while at the same time translating the case piston coupling 154 from the first end 164 of the rocker arm coupling 163 to the second end 165 of the rocker arm coupling 163.

As introduced above, the case piston 160 includes an engagement surface 162 for engaging a cartridge and urging the cartridge toward a bottom of a magazine. In the illustrated embodiment, the engagement surface 162 of the case piston 160 extends along three prongs 166. However, in various embodiments, the engagement surface 162 extends along fewer or additional prongs 166. For example, the case piston 160 may include a single continuous engagement surface 162. Whether extending along a single surface or multiple surfaces, the entire engagement surface 162 may not engage the cartridge at the same time or in all instances. For example, in some embodiments, portions of the engagement surface 162 may only engage cartridges when a cartridge becomes offset from its intended path during the loading operation.

In some embodiments, the engagement surface 162 may be textured. In another embodiment, the engagement surface 162 may be contoured to correspond with a case contour. The engagement surface 162 is preferably positioned to contact a portion of the case of a cartridge that includes approximately a central location of the width of the case. The engage surface 162 also preferably contacts a portion of the case that includes approximately a central location of a length of the cartridge. However, the engagement surface 162 may be configured to contact the cartridge at any location suitable to urge the cartridge toward a bottom of a magazine to depress the magazine follower.

As described in more detail below, in some embodiments wherein the system includes an adapter and/or feeder, the case piston 160 may travel through openings in the adapter and/or feeder to push a cartridge through cartridge stops of a feeder and toward a bottom of the magazine inserted within a magazine well of the adapter. Placement of engagement surfaces on multiple prongs may allow additional cartridge support to be provided along a cartridge tunnel between slots through which the prongs may extend.

The case piston 160 may also include a return bias coupling 167 for coupling a case piston return bias member 115 to bias the case piston 160 to an initial resting position such that following translation, the case piston return bias member automatically returns the case piston 160 to its resting position, e.g., as shown in FIG. 6. In the illustrated embodiment, the case piston return bias coupling 167 comprises a hook and the case piston return bias member 115 comprises a band or spring the couples between the hook and the case piston return bias mount 114 to return the case piston 160 to its resting position following translation.

Figure 12A:
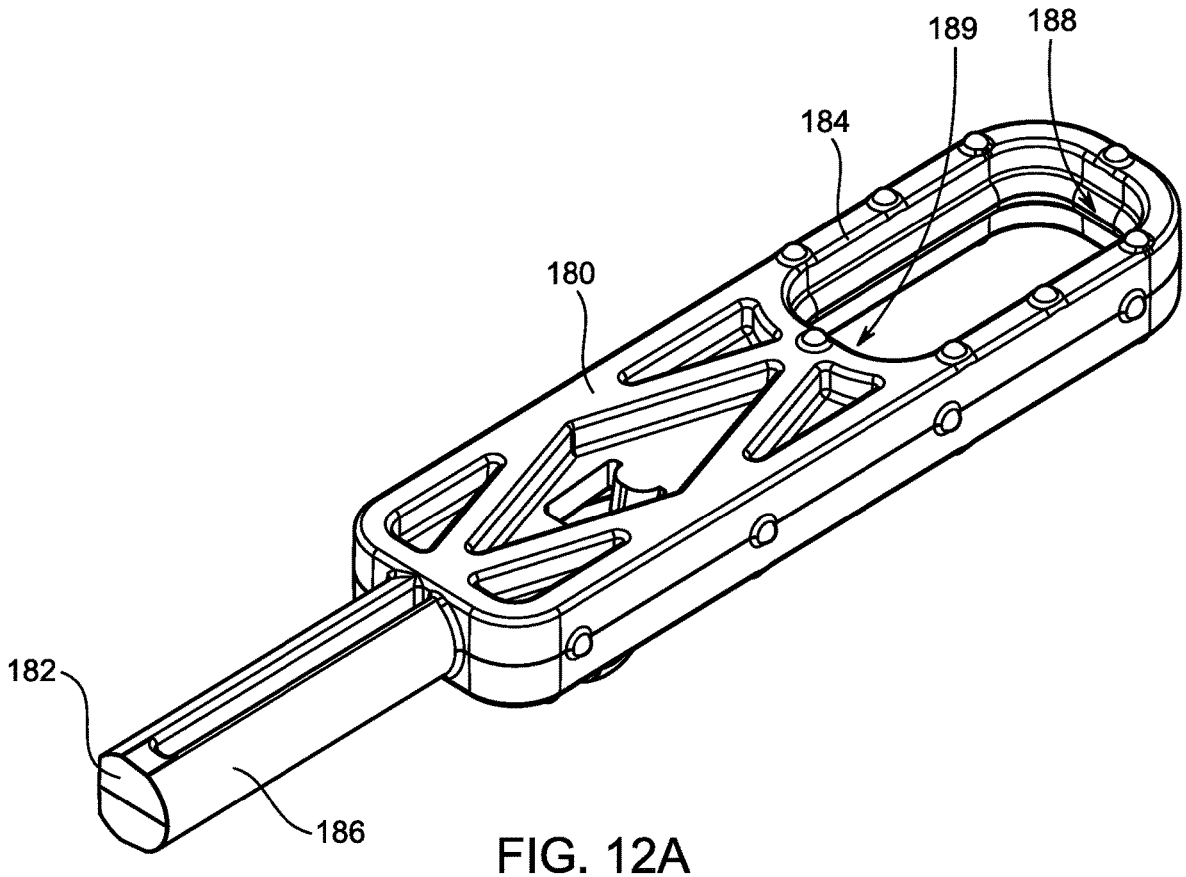
Figure 12B:
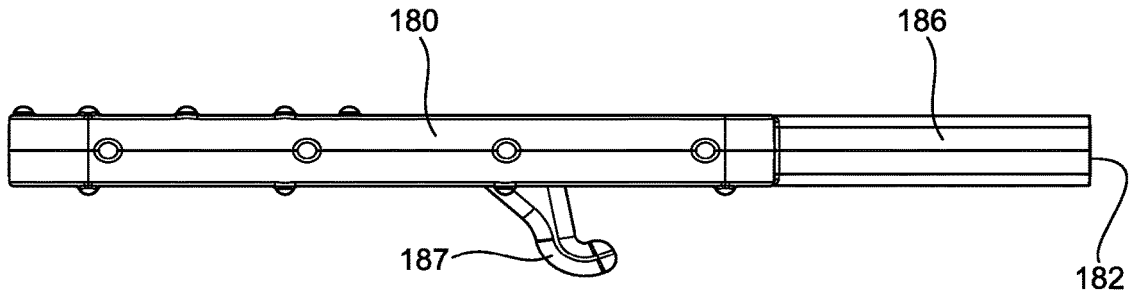

With further reference to FIGS. 12A-12B, illustrating an isolated view of the projectile piston 180 shown in FIGS. 5 & 6, the projectile piston 180 may include an engagement surface 182 configured to engage a projectile portion of a cartridge to drive the cartridge toward a back of a magazine. As described in more detail below, the projectile piston 180 may drive the cartridge toward a back of the magazine while the cartridge is held in a position that depresses a magazine follower. For example, translation of the case piston 160 may urge the cartridge to a position that drives the follower toward the bottom of the magazine. The case piston 160 or another surface may hold the cartridge downwardly with respect to the magazine in such a position while the projectile piston 180 engages the projectile along engagement surface 182 and translates to urge the cartridge to the back of the magazine, beneath feed lips of the magazine to load the cartridge in the magazine. In the illustrated embodiment, the projectile piston 180 is configured to move approximately perpendicular to the case piston 160, pushing against the projectile of a cartridge, driving the cartridge toward a back of a magazine where it may be securely contained by the feed lips of the magazine.

As described in more detail below, in some embodiments wherein the loader system 8 includes an adapter and/or feeder, the projectile piston 180 may travel through openings in the adapter and/or feeder to push a cartridge with the cartridge being held in place by the case piston 160 or another surface. In the illustrated embodiment, the engagement surface 182 is positioned at an end of prong 186 configured to travel through one or more adapter cutouts to make contact with the projectile of a cartridge being held in place by the case piston 160. The prong 186 has a cylindrical profile and also includes a side facing the case piston 160 that is shaved to allow clearance. Other profiles may be used.

The projectile piston 180 may also include a return bias coupling 187 for coupling a projectile piston return bias member 118 to bias the projectile piston 180 to an initial resting position such that following translation, the projectile piston return bias member 118 automatically returns the projectile piston 180 to its resting position, e.g., as shown in FIG. 5. In the illustrated embodiment, the projectile piston return bias coupling 187 comprises a hook and the projectile piston return bias member 118 comprises a band or spring that couples to the hook. The spring or band couples between the projectile piston return coupling 187 and the projectile piston return bias mount 117 to automatically return the projectile piston 180 to its resting position following translation.

It is to be appreciated that alternative connections between components may be utilized. For example, the rocker arm 150 may include a cam surface connection with the case piston 160 wherein the cam surface of the rocker arm 150 engages a surface of the case piston 160 to cause the case piston 160 to translate. In one example, the rocker arm 150 may be coupled to a bias member to return the rocker arm 150 to its pre-rotation, resting position after the lever 130 has also returned to its pre-rotation, resting position. Such a rocker arm bias coupling may be in addition to instead of a case piston bias member. In one embodiment, the projectile piston 180 may couple to the movement of the lever 130 utilizing a cam surface connection.

In some embodiments utilizing motors or actuators are utilized to cause translation of the pistons 160, 180, a lever 130, handle 103, and/or bias members are not be used.

The loader system 8 may also include or be operable for use with a feeder. The feeder may include a cartridge tunnel through which cartridges may be feed to the loader 100. The cartridge tunnel may be configured to sequentially feed cartridges. The feeder may feed cartridges to the loader 100 at any location. However, to reduce distance the case piston 160 and projectile piston 180 and/or other piston or guide surface must move cartridges to load a magazine, the feeder preferably feeds cartridges above a magazine opening, offset from feed lips. When fed to the loader 100, the cartridges preferably orientate within a same plane as the engagement surface 162 of the case piston 160 translates, which may be the same or different plane the engagement surface 182 of the projectile piston 180 translates. The feeder may include rails dimensioned to be received within extractor grooves of cartridges.

Figure 13A:
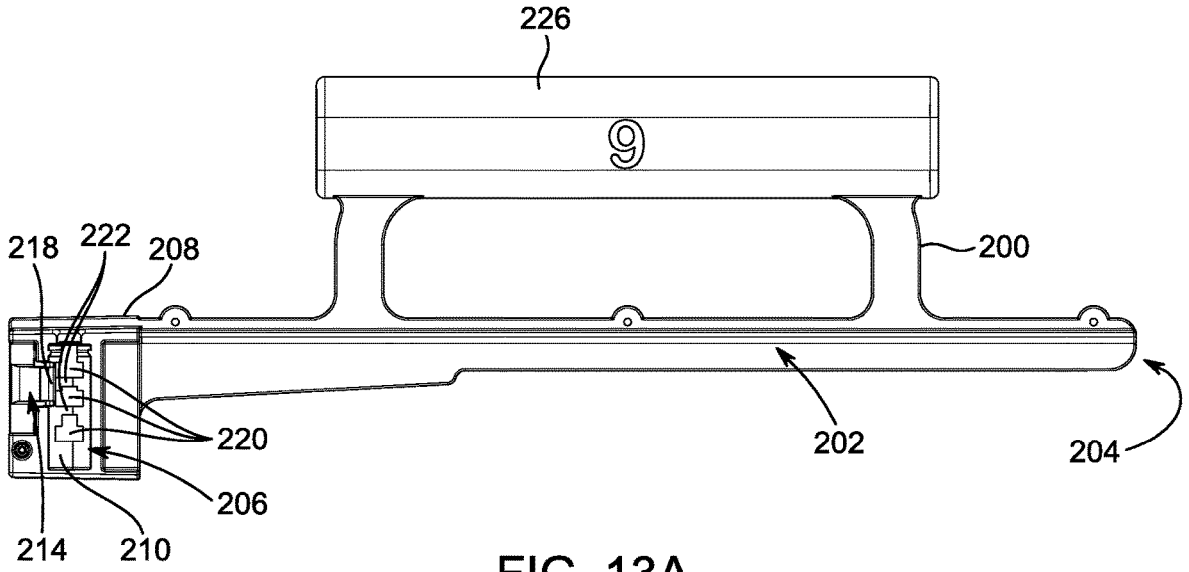
Figure 13B:
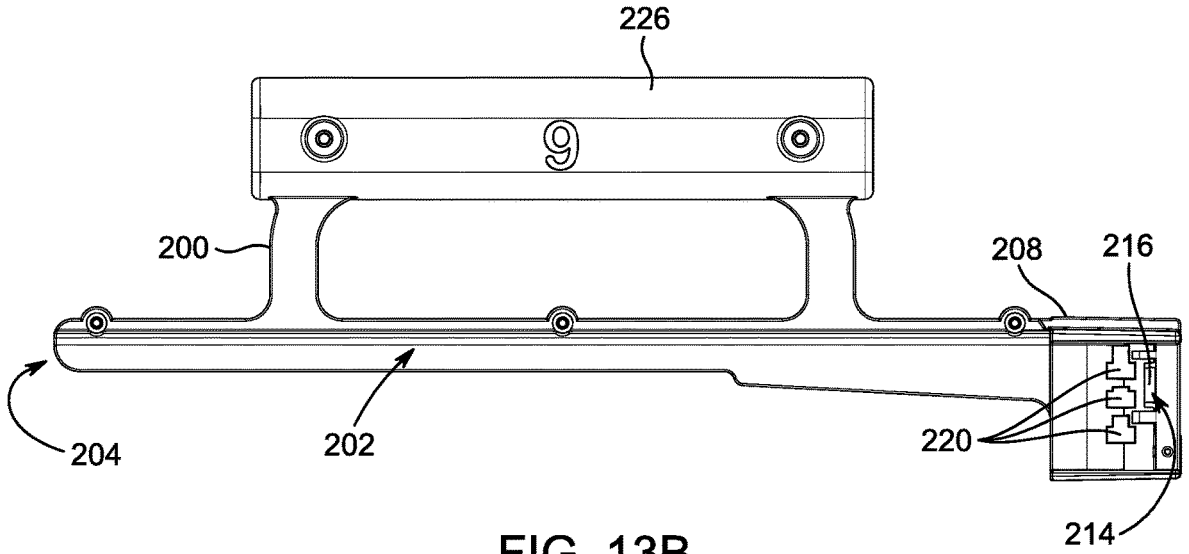

FIGS. 13A & 13B illustrate a feeder 200 according to various embodiments. The feeder 200 includes a cartridge path 202 along which cartridges may travel between a feeder entrance 204 and a feeder exit 206. The feeder 200 may include a base 208 including a cartridge tunnel 210 that leads to the feeder exit 204. The feeder 200 may also include rails 212 dimensioned to be received in cartridge extractor grooves. The profile of the rails 212 are configured to correspond with the profile of the extractor groove of a cartridge, to provide a precise and secure channel in which the cartridge can travel within the feeder 200 along the cartridge path 202. The rails 212 may be positioned parallel to each other along the cartridge path 202. The distance between rails 212 may be less than an outer diameter of a case or greater than an extractor groove diameter such that the cartridges may be slidably or rollably retained between the rails 212 as the cartridges move between the entrance 204 and exit 206. Thus, feeder rails 212 may be spaced apart a distance less than the outer diameter of the cartridge case, which may correspond to certain caliber size or size range. In various embodiments, the loader system may include a plurality of feeders 200 having rail size and spacing suitable for various caliber size or range of cartridges.

The feeder 200 may also include one or more cartridge stops 214 along the feeder exit 206 that stop a cartridge from exiting the exit 206 without urging. For example, the exit 206 illustrated in FIGS. 14A-14C includes one or more flexible anus 216 with one or more wedges 218 that act as cartridge stops 214. The wedge profile corresponds with a cross-section of a cartridge 55 to hold a cartridge 55 within the feeder cartridge tunnel 210 until the case piston 160 pushes it, flexing the stops 214 to allow the cartridge 55 to escape the feeder 200 through the exit 206. In an embodiment, wedges 218 are positioned in front of and behind the first cartridge 55*a*. In the illustrated embodiment, a wedge 218 is positioned in front of the first cartridge 55*a*, at the side of the exit 206. When a case piston 160 pushes the first cartridge 55*a* toward the exit 206, the force flexes the arms 216 to lower the wedge 218 to allow the first cartridge 55*a* to move to the exit 206. When the case piston 160 returns to its resting position, the second cartridge 55*b* drops to replace the first cartridge 55*a*.

One or more slots or openings 220 may be provided along the base 208 to allow the case piston 160 to travel through the cartridge tunnel 210 and interact with the bottom-most cartridge 55*a* in queue along the cartridge path 202. The case piston 160 may work most efficiently while applying direct pressure close to the extractor groove; therefore, the one or more openings 220 may be positioned to intersect the feeder rail of the lower tunnel within the transition sweep. However, other configurations may be used.

In some configurations, a contiguous opening 220 may be used. However, a contiguous opening 220 may increase the possibility of cartridges 55 getting jammed in the resulting opening 220 trench. To address this, the case piston 160 may be divided into multiple extensions or prongs. For example, as shown in FIGS. 11A & 11B, the case piston 160 is split into three prongs 166 such that the engagement surface 162 of the case piston 160 is located along an end of each of the prongs 166. Openings 220 matching the profile of the prongs 166 result in two cartridge tunnel ramps 222. The strategic spacing of these ramps 222 may enables support for cartridge cases 56 of various sizes. The feeder 200 may also include ribs to provide support in areas like the cartridge tunnel 210, where many openings may reduce the strength of the part due to limited available surface area and material.

In various embodiments, the upper wall 215 includes one or more raised surfaces or ribs that extend along the cartridge path 202 to contact a base 59 of cartridges 55, above the extractor groove 58, when the cartridges 55 are slotted along the cartridge path 202. A rib limits the vertical clearance available to a slotted cartridge 55 and is located between and offset from the rails 212 to provide reduced friction between rails 212 and extractor grooves 58 resulting from twisting. Ribs also define small contact points along their outer surfaces for low friction interaction with cartridges 55. In the illustrated embodiment, as most clearly shown in FIG. 14D, when supported by the feeder 200, an extractor groove 58 of a cartridge 55 slots over the rail 212 of the feeder 200. The rim 54 of defining the base 59 side of the extractor groove 58 contacts the upper surface of the rail 212 when slotted thereon. The upper wall 215 of the feeder 200 also includes a base support portion 215*a* extending above the rail 212 that may contact the base 59 of the cartridge 55, along the perimeter thereof, when the rail 212 is slotted within the extractor groove 58.

The illustrated feeder 200 also includes a handle 226 configured to be grasped by a user to manipulate the feeder 200. In various embodiments, the rails 212 at the entrance 204 may be configured to automatically align with extractor grooves of cartridges. For example, as most clearly shown in the cross-section side view of the feeder entrance 204 in FIG. 14D and the detailed bottom view of a portion of the feeder 200 including the feeder entrance 204 in FIG. 16 the rails 212 at the feeder entrance 204 may form an opening wherein the rails include a tapered and/or ramped portion 213. As shown, the tapered and/or ramped portion 213 includes rails 212 that taper inwardly from the entrance 204 along the cartridge path 202, decreasing spacing between the rails 212 and that also ramp vertically from the entrance 204. The taper and/or ramped portion 213 of the rails 212 may be chamfered and/or beveled. The tapered and/or ramped rail portion 213 enables the feeder opening at the feeder entrance 204 to be placed directly on a round of ammunition and automatically align along extractor grooves 58 of the cartridges 55, e.g., as the feeder 200 slides across a row of cartridges 55 positioned within an ammunition tray 232 (see, e.g., FIGS. 17A & 17B). The clearance between the rails 212 and the upper wall 215 of the feeder 200, along the base support portion 215*a* may also taper toward the entrance 204 for placing the entrance 204 flat onto the cartridges 55. Thus, at the feeder entrance 204, the upper wall 215 comprises a flat surface which angles upward to allow the feeder 200 to scoop cartridges 55 even when the opening is pointed downward, which is a natural tendency. The base support portion 215*a* also tapers upwardly at the feeder entrance 204 to provide a larger entrance and to urge an extractor groove 58 of a cartridge 55 over the rail 212 by guiding the base 59 of cartridge 55 along the rail support portion 215*a* that progressively brings the extractor groove 58 into alignment with the rail 212. The sidewalls 209 and rails 212 are also angled outwardly to provide a wider opening toward the opening at the feeder entrance 204. The rails 212 open up wider as well as the top edge angling down, and the bottom edge angling upward. The rails 212 are skinny and far apart along the feeder entrance 204, allowing for an inaccurate approach by a user to successfully find the extractor grooves 58 of the cartridges automatically and then progressively snugging up to the extractor grooves 58 as the feeder 200 travels across a row 230 of cartridges 55. Thus, the entrance 204 may be configured to operate as a scoop for quickly and easily scooping cartridges 55 onto the feeder 200 for feeding the loader 100. In some embodiments, the entrance 204 may include a cartridge stop (not shown) that blocks cartridges 55 from falling out of the entrance during movement or transport. For example, a latch or other physical block may be pivoted or slide adjacent to the entrance 204 to block exit of cartridges 55 from the entrance 204.

Proper feeder rail profile may facilitate smooth drop and travel throughout the feeder 200, while a poor profile can increase the probability of cocking and jamming. Rails 212 that provide ample support to the case 56 along its central axis may be employed to provide smooth rolling. The fewer contact points perpendicular to the central axis of the case 56 with minimal clearance may also create less friction and assist in free-flowing feeding of cartridges 55. In the illustrated embodiment, the feeder 200 includes a 90° drop angle having a transition sweep including curved upper and lower rails 212 and cartridge stops 214 forming a gate that keeps the cartridges 55 from rolling out of the feeder 200. Drop angle refers to the angle of the cartridge tunnel 210 relative to the case piston 160. In some embodiments, the feeder 200 may insert such that the cartridge tunnel 210 is approximately perpendicular to the case piston 160 and cartridge 55 therefore drop and turn 90° when the case piston 160 pushes them out of the feeder 200. The feeder 200 may be configured to insert on an angle or insert perpendicular with an angled cartridge tunnel 210. In this case, force on the cartridges due to gravity is not parallel with the cartridge tunnel 210. This allows the cartridges 55 to roll down a steep hill, rather than free fall through the transition. Cartridge tunnel 210 configurations may also include a sweep from drop angles. For example, the cartridge tunnel 210 configurations shown in FIGS. 15A & 15B make a 90° sharp turn and have zero sweep. In contrast, the configuration shown in FIG. 15C has a sweep along the lower wall 209*b* but none along the upper wall 209*a*. The cartridge tunnel 210 shown in FIG. 15D includes a gentle sweep along the lower wall 209*b* and a tight sweep along the upper wall 209*a*. Transition is the period in which a cartridge 55 changes direction from the cartridge tunnel 210 to the exit. FIG. 14C depicts a cartridge tunnel 210 having a transition that is long and graceful and that facilitates a constant and efficient flow of cartridges 55.

Figure 14A:
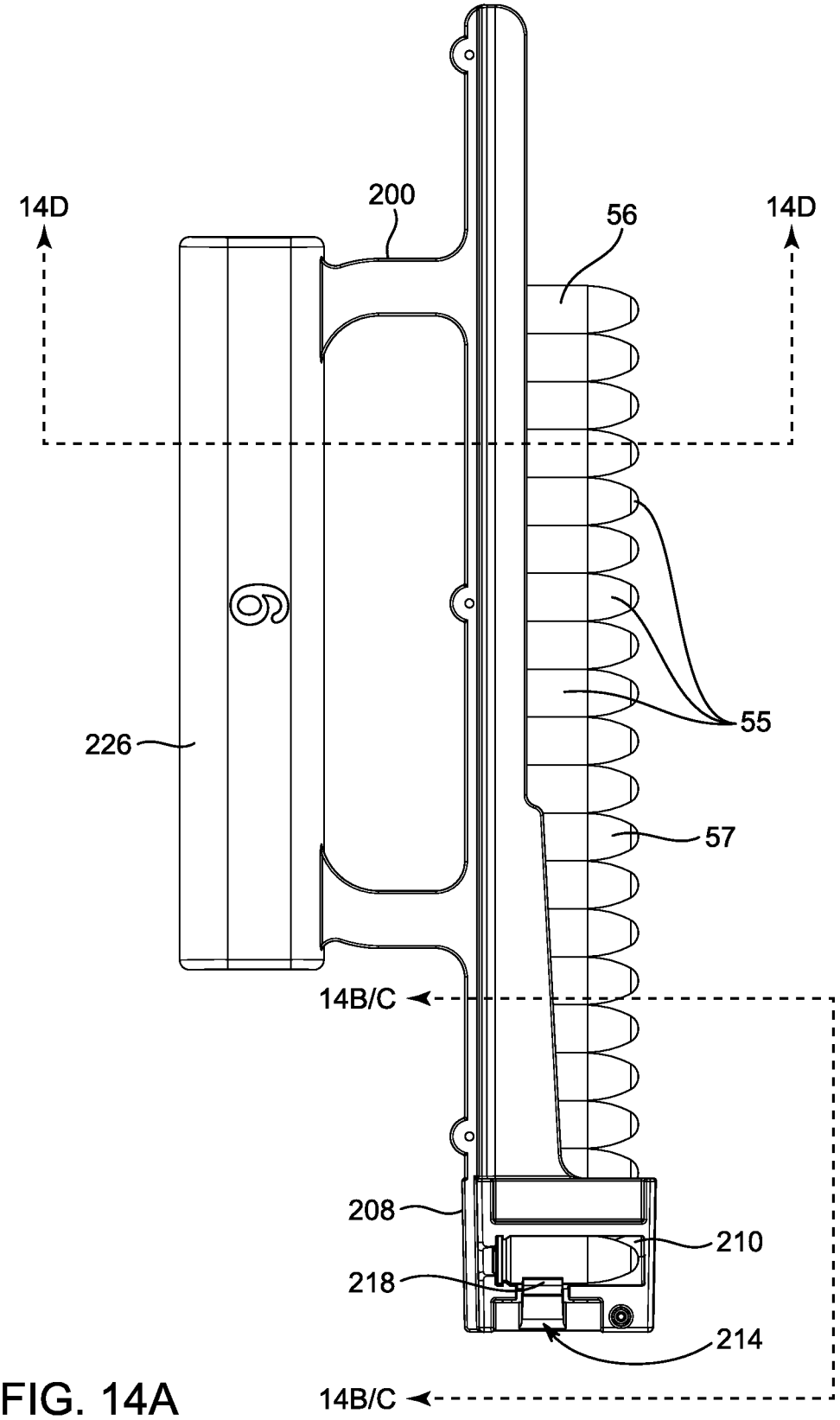
Figure 14B:
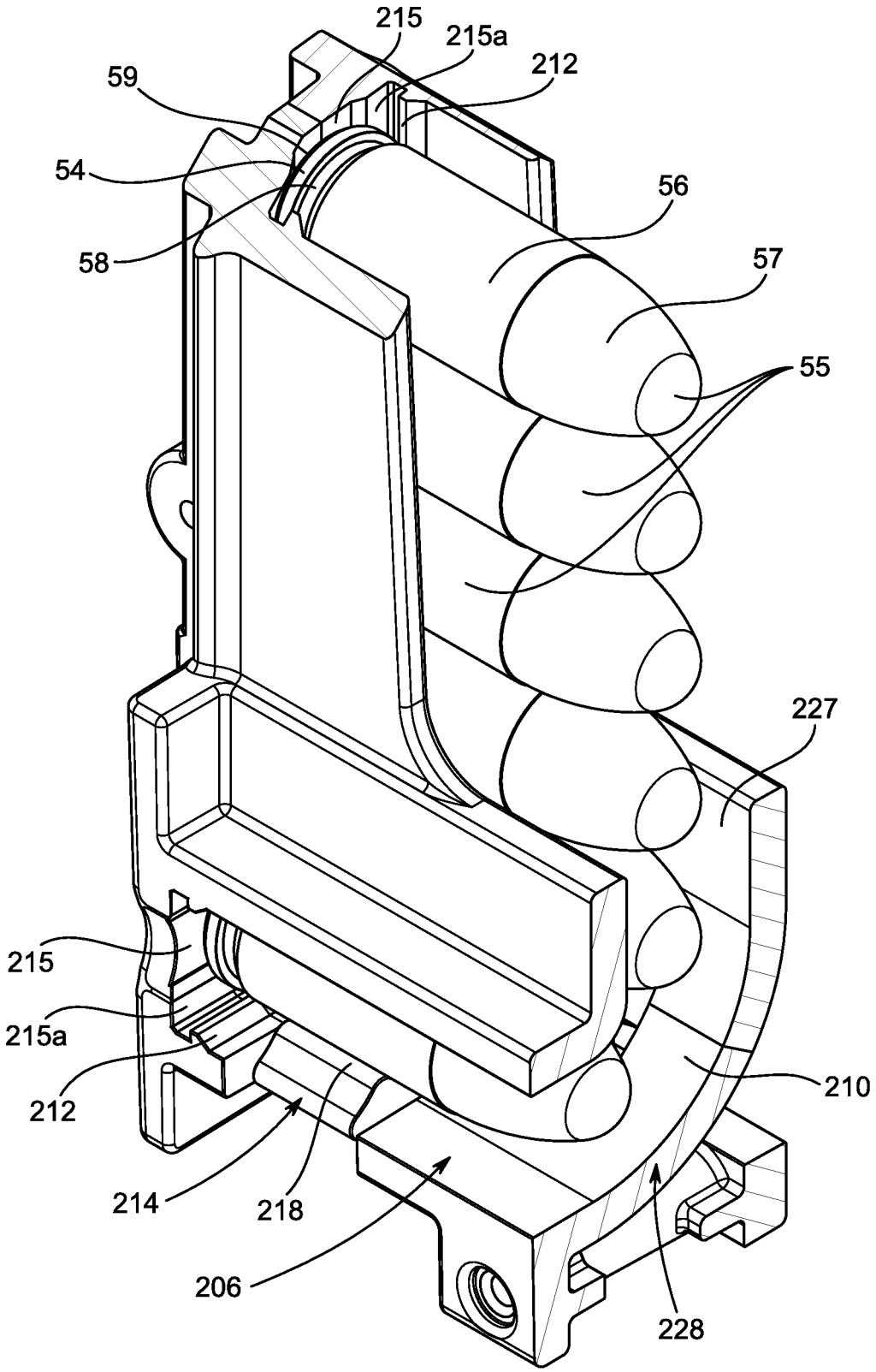
FIGS. 14B & 14C are isolated cross-section views of the portion of the feeder identified within box 14B/C in FIG. 14A.
Figure 14C:
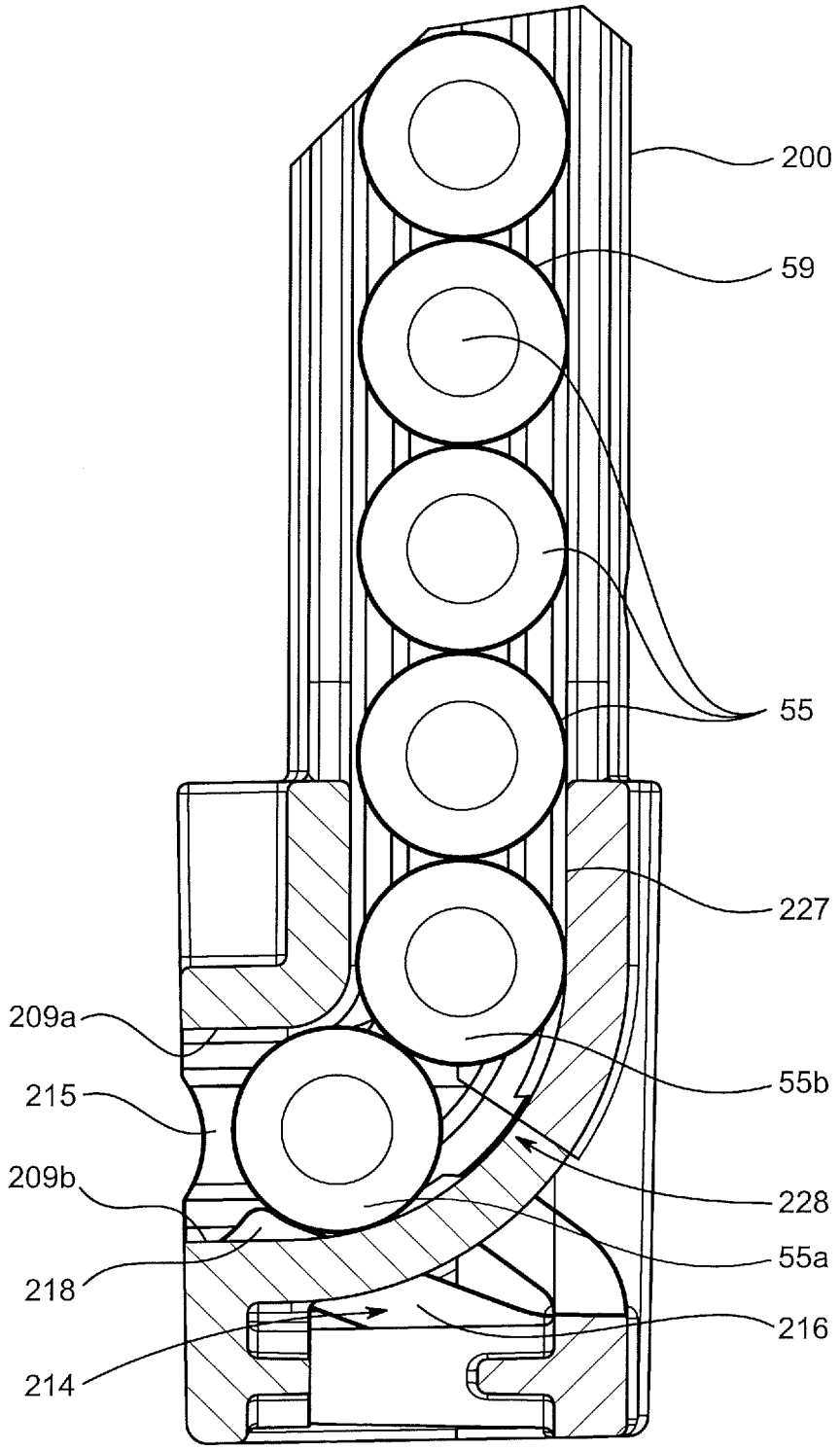
Figure 14D:
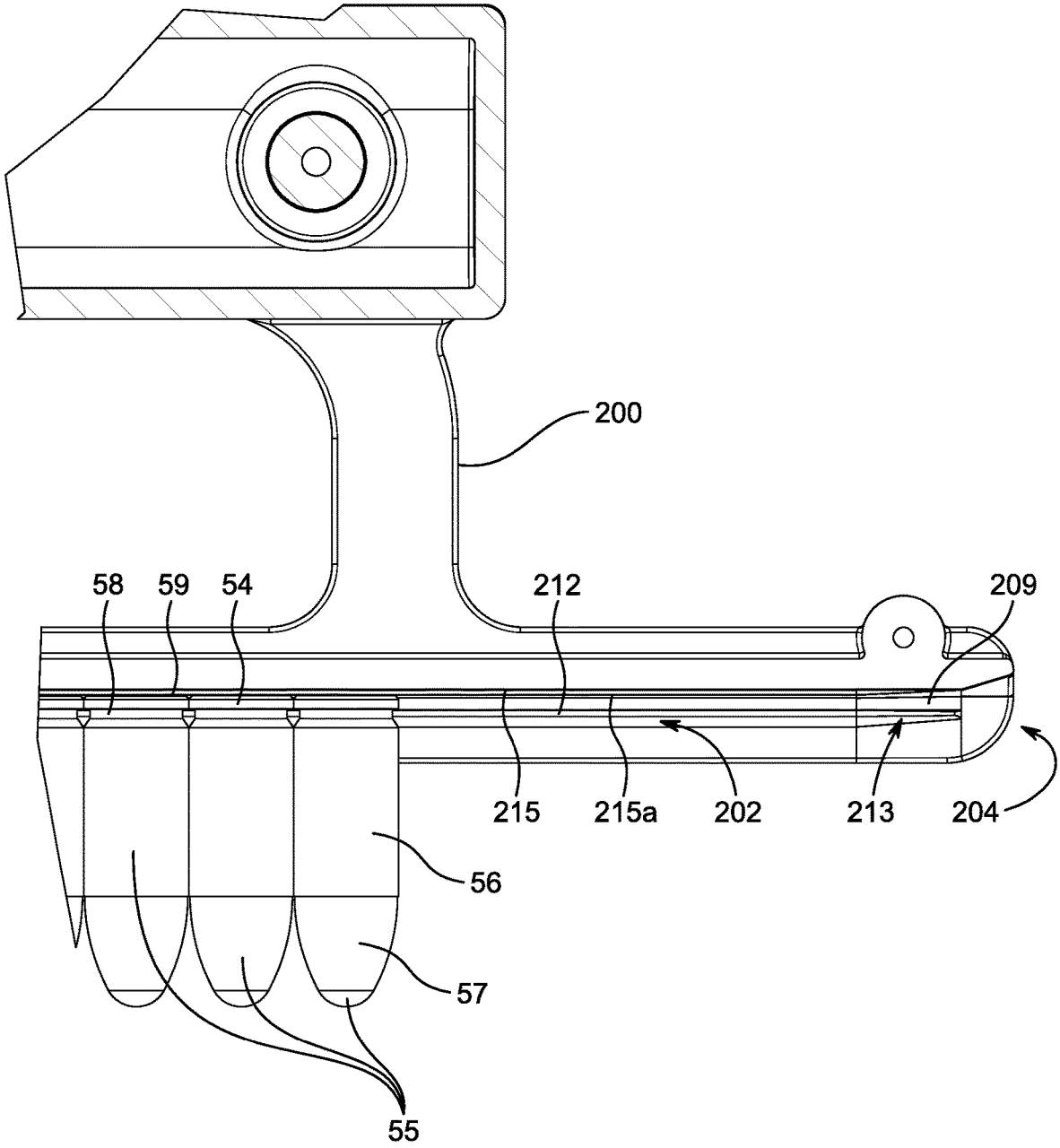

With continued reference to FIGS. 14A-14C, as introduced above, the feeder 200 may include a cartridge tunnel 210 along its base 208 through which cartridges 55 move along the cartridge path 202 to the exit 206. Within the cartridge tunnel 210, cartridge cases 56 may contact feeder walls 227 while extractor grooves are engaged with rails 212 along a drop angle including a transition 228 through the drop angle. The feeder 200 defines a drop angle of 90° having a sweep transition 228 to define an arcuate cartridge path 200 along the cartridge tunnel 210 at its base 208 where the feeder 200 interfaces with the loader 100, which in some embodiments include interfacing with an adapter.

The base 208 may implement different drop angles using straight joint and/or sweep transitions 228. FIGS. 15A-15D depict different 90° drop angles having various rail 212 and/or wall 227 configurations to provide different transitions 228 through the drop angle to a translation or travel angle of a case piston 160 of a loader 100. While a 90° drop angle is shown; different drop angles can be employed to provide more cartridge support and less pressure on the feeder rails 212. Although a direct vertical drop may place the most force on the feeder rails 212 while providing the least rolling support on the cartridge case 56, the steeper angle allows for less chance of the case piston 160 being obstructed by a cartridge above the one being engaged.

In various embodiments, upper and/or lower feeder rail tunnel walls along the cartridge exit 206 and/or cartridge tunnel 210 may include sweep transitions 228 to provide rail support throughout a journey of a cartridge 55 through the cartridge tunnel 210. Sweep transitions 228 may be preferable in operation as partial or no sweep along the lower wall may leave a cartridge 55 with minimal to no rail support for a period during transition, e.g., see FIG. 15B, which may allow some cartridges 55 to cock or jam when no longer constrained by the feeder rail system.

Figure 15A:
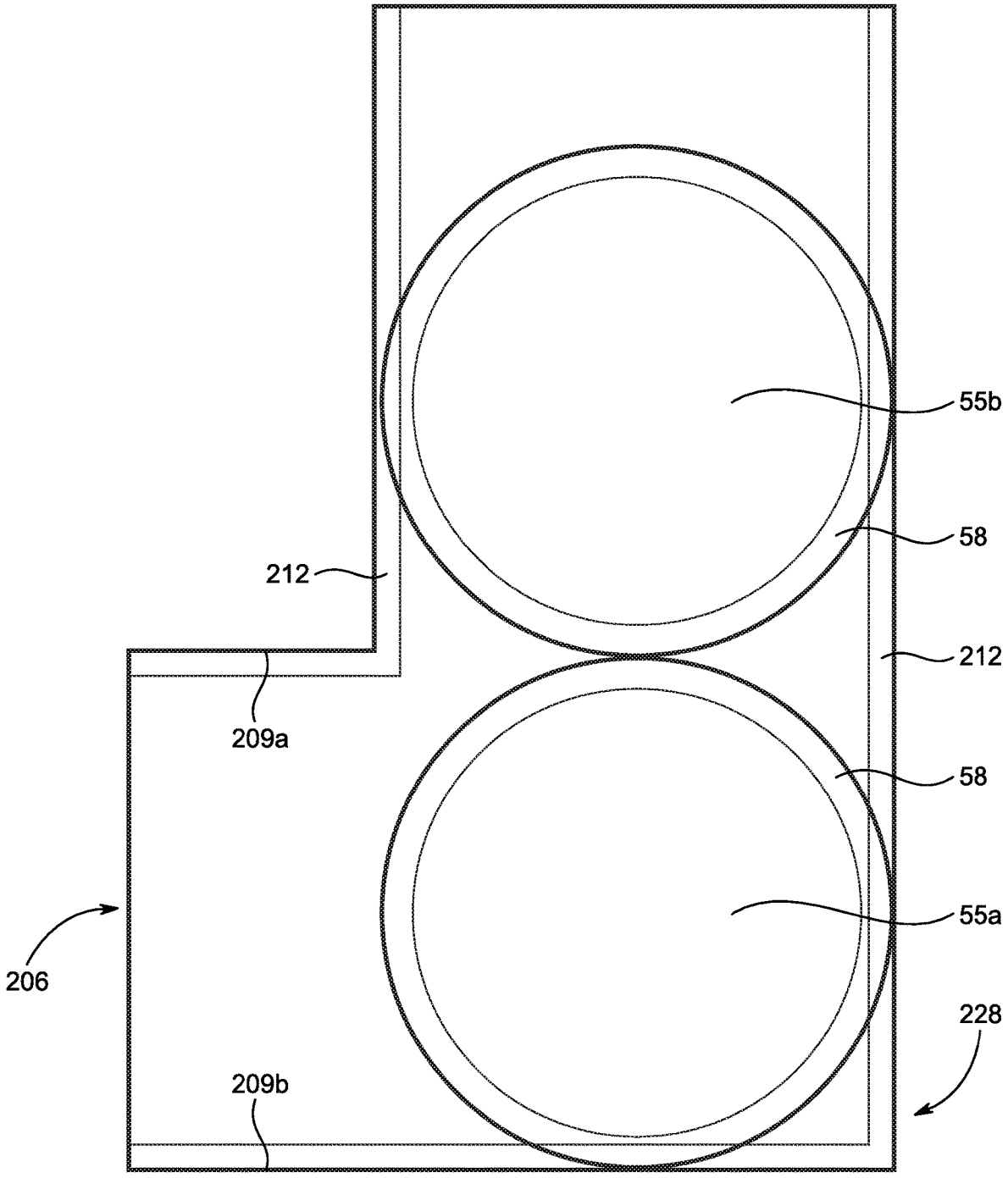
FIGS. 15A-15D illustrate various configurations of cartridge tunnel drop angles and transitions according to various embodiments described herein.

In various embodiments, a drop angle less than or greater than approximately 90° may be used, which may be used to allow second or subsequent cartridges 55*b* in a feeder queue to sit lower in the base. A drop angle less than 90° may be used but may have an increased tendency to jam. A drop angle greater than 90° provides support to the cartridge case 56 to roll rather than drop straight down with all of the force on the feeder rails 212. While a drop angle of approximately 90° provides the least support, it provides the most force from gravity and the most clearance on the second-to-last cartridge. In FIG. 15A, showing a 90° straight joint transition, the bottom-most point of a second cartridge 55*b* is tangent to the top-most point of a first cartridge 55*a*. As the drop angle decreases from 90°, or the sweep increases, the point tangent to the two cartridges 55*a*, 55*b* becomes closer to the center axis of the cartridge case 56, see, e.g., FIGS. 15C & 15D. If the second cartridge 55*b* is too low in the tunnel, it can interfere with the case piston 160 and cause system failure. Accordingly, in order to keep the bottom of the second cartridge 55*b* clear of the case piston 160 in such an embodiment, cartridge stops 214 can be moved to contain the first cartridge 55*a* farther beneath the second cartridge 55*b*, holding the second cartridge 55*b* higher in the cartridge tunnel. However, in operation, as the first cartridge 55*a* moves back toward the transition sweep, it may begin to move up as well as back, which may place more force on the case piston 160 when pushing the first cartridge 55*a* against the top wall of the cartridge tunnel.

Still referring to FIGS. 15A-15D wherein the cartridges 55 represent 10 mm diameter cartridges 55 with 0.5 mm extractor grooves 58 and cartridge tunnel wall 203 are representative of approximately 10.2 mm wide cartridge tunnel walls 203 to provide clearance with 0.5 mm rails 212 to engage the extractor grooves 58, various cartridge tunnel configuration considerations may be considered.

FIG. 15A depicts a cartridge tunnel with a 90° square turn on both the top and bottom walls. The perpendicular distance between the two feeder walls is approximately 10.2 mm and between the two rails is approximately 9.2 mm. The hypotenuse distance from the corner of the top wall to the corner of the bottom wall ($H_w$) is the square root of two times the square of the perpendicular distance:

$$H_w=\sqrt{2d^2}$$

$$H_w=\sqrt{2\times10.2^2}$$

$$H_w=14.425 \text{ mm}$$

The hypotenuse distance from the corner of the top rail to the corner of the bottom rail ($H_r$) is the square root of two times the square of the perpendicular distance:

$$H_r=\sqrt{2d^2}$$

$$H_r=\sqrt{2\times9.2^2}$$

$$H_r=13.010 \text{ mm}$$

When the 10 mm cartridge is along the right or bottom wall, the rail is engaged with the extractor groove of the cartridge. With both bottom and right rail support, the cartridge will likely remain aligned and not experience any cocking or jamming. However, without top rail support, and only bottom or right rail support, the odds that the cartridge will cock or jam increases. When the cartridge is flush with the right and bottom walls, the top rail may be over 3 mm from the cartridge case.

Figure 15B:
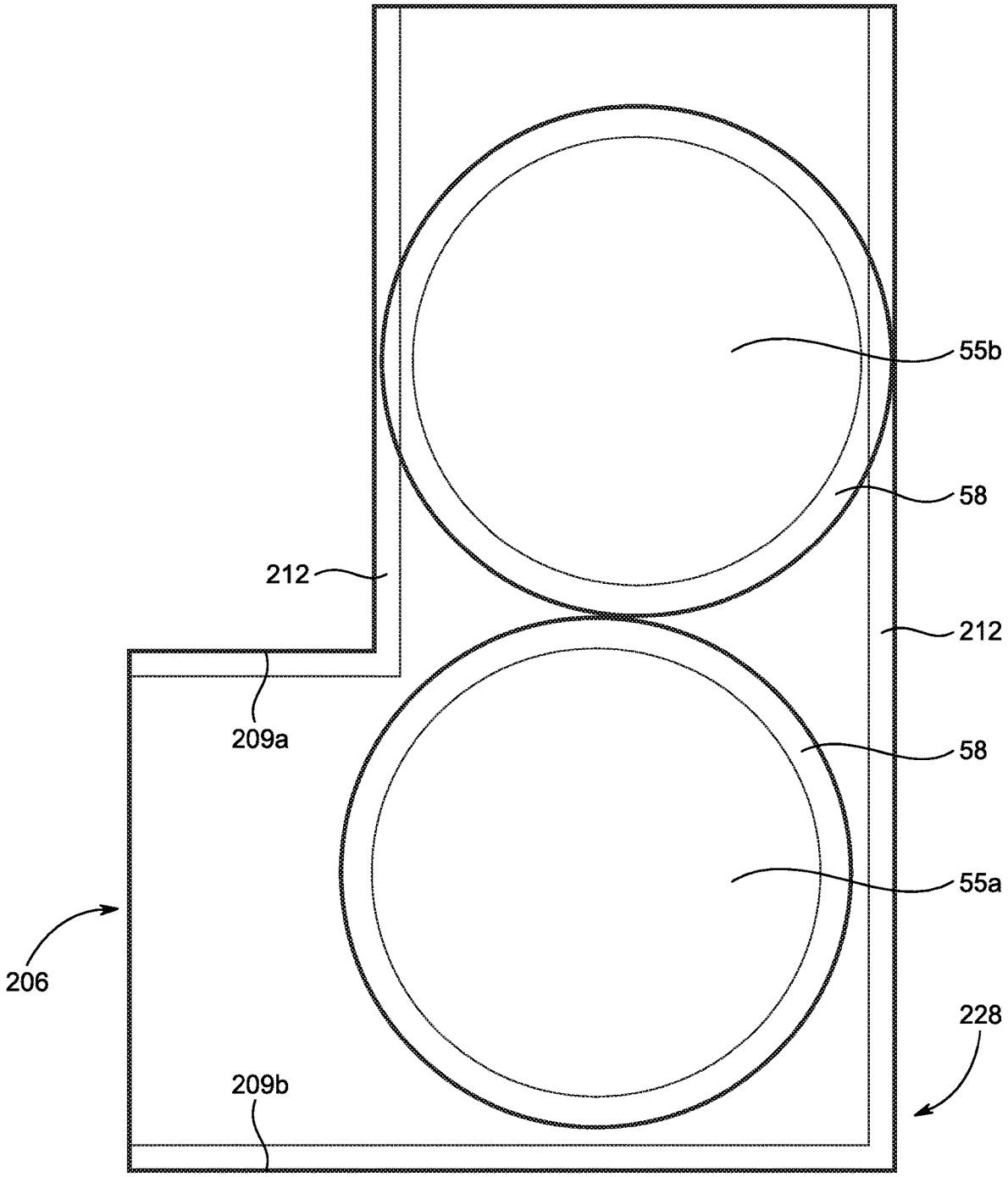

FIG. 15B depicts the same cartridge tunnel design as FIG. 15A, except the instead of the cartridge riding along the right and bottom rails, the cartridge is falling without making contact with any rail. In this illustration, the extractor groove is over approximately 1 mm from any rail. In this scenario the likelihood of cocks and/or jams are increased.

Figure 15C:
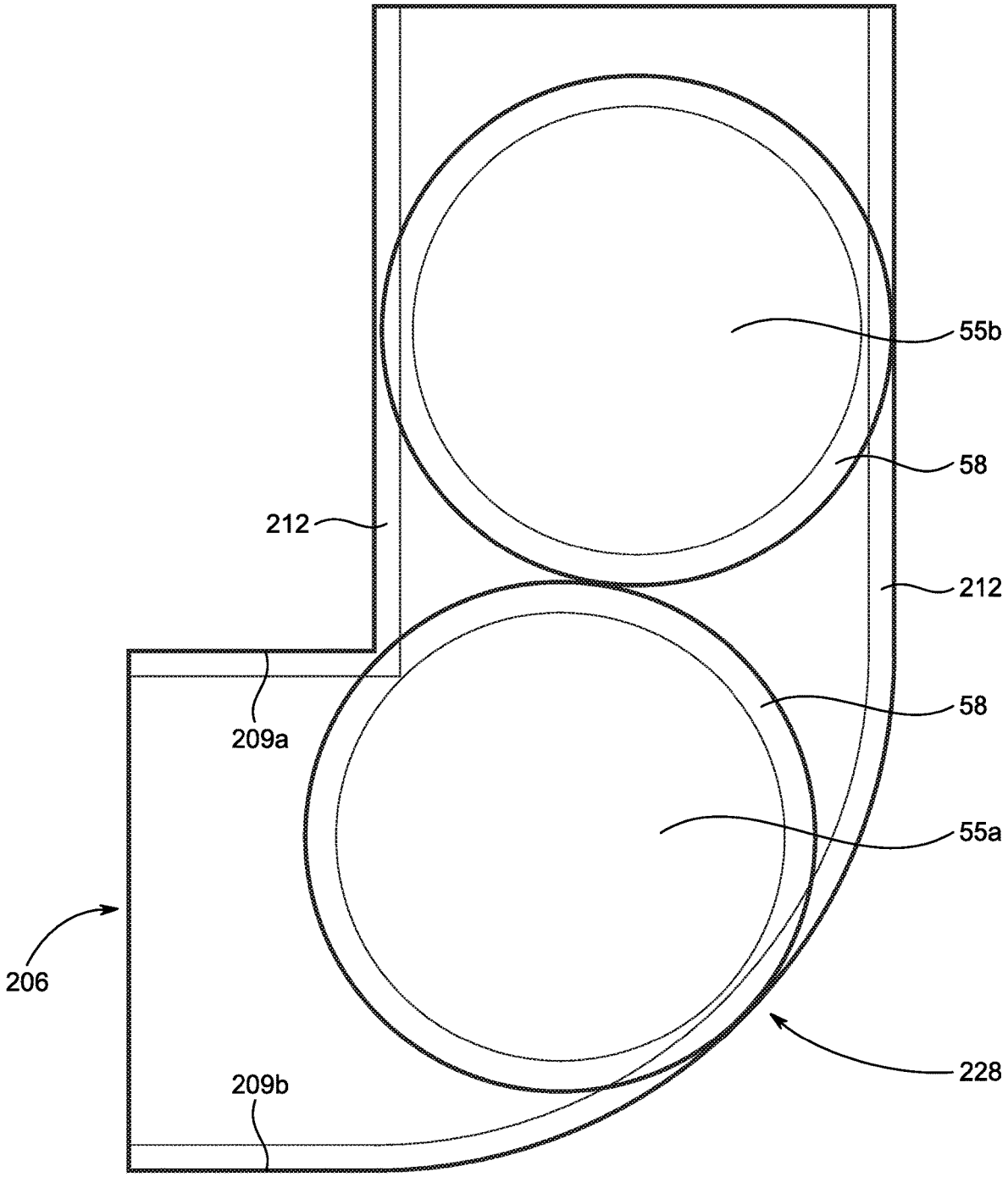

FIG. 15C depicts a similar cartridge tunnel design as in FIG. 15B, but with a swept lower tunnel and rail. In this scenario, the cartridge has rail support during travel throughout the cartridge tunnel. However, the top rail engages the extractor groove minimally. Additionally, the cartridge has to make a tight 90° turn, revolving around the top rail corner point.

Figure 15D:
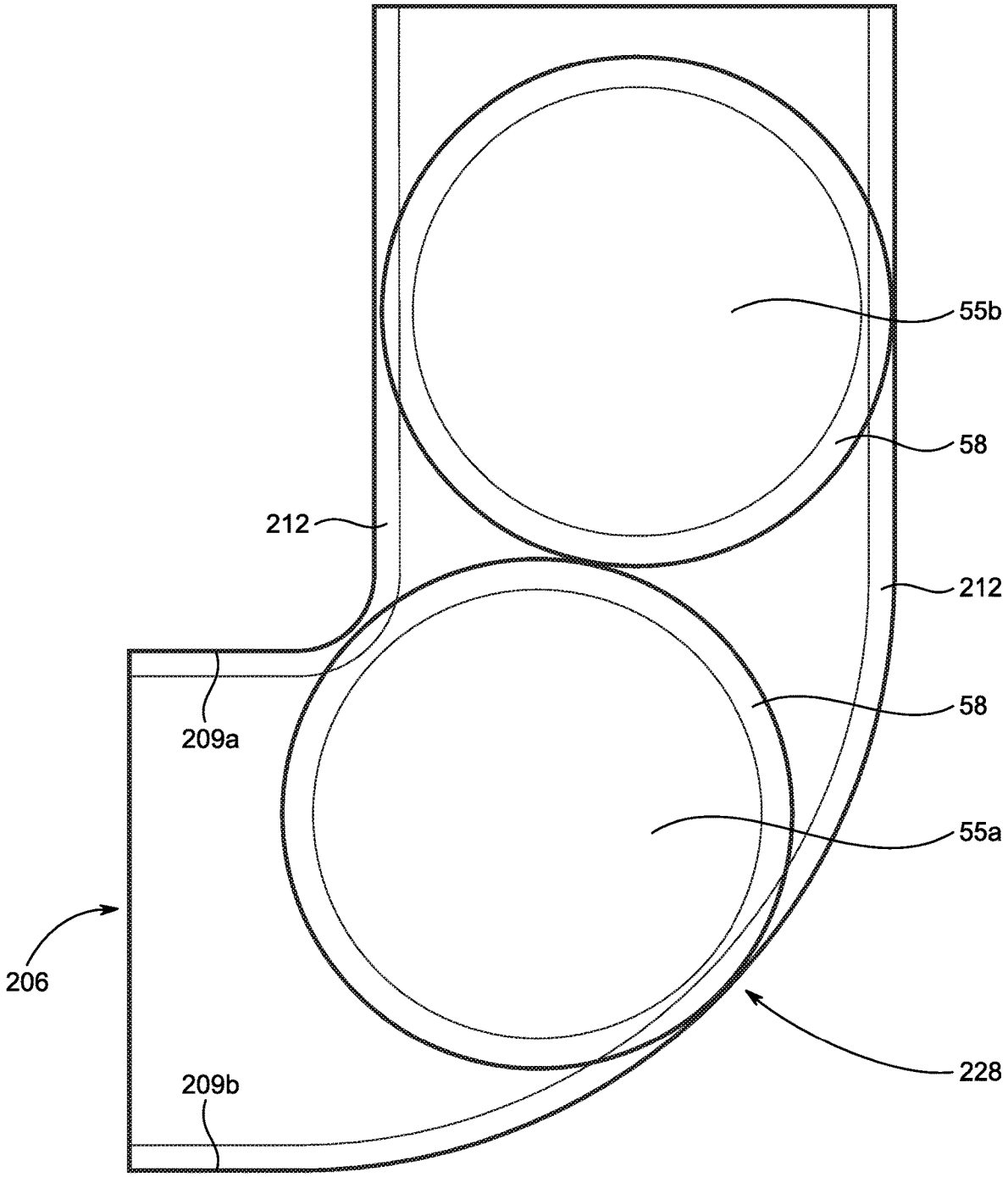
Figure 16:
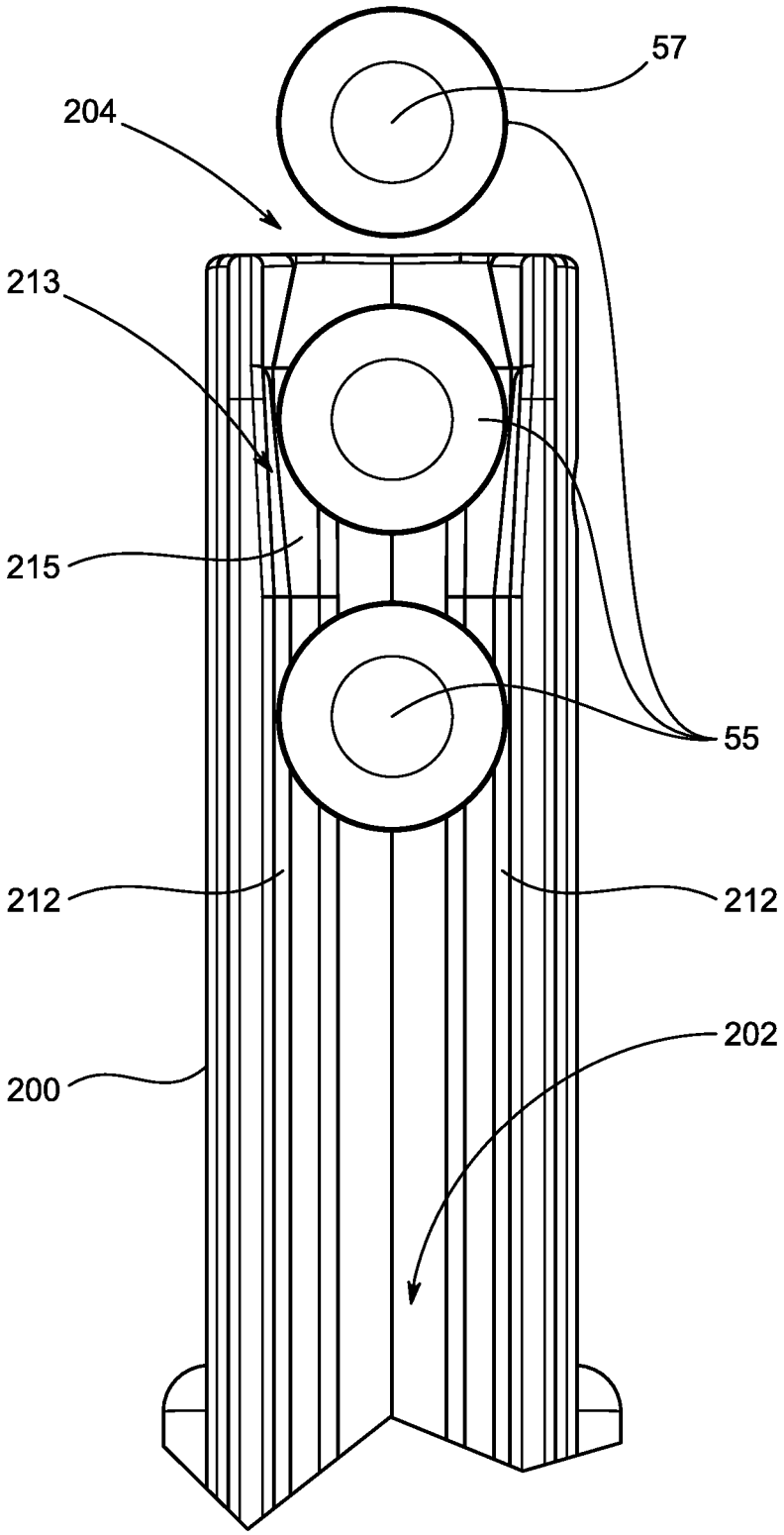
FIG. 16 illustrates a partial bottom view of a feeder showing tapered rails at a feeder exit scooping cartridges according to various embodiments described herein.
Figure 17A:
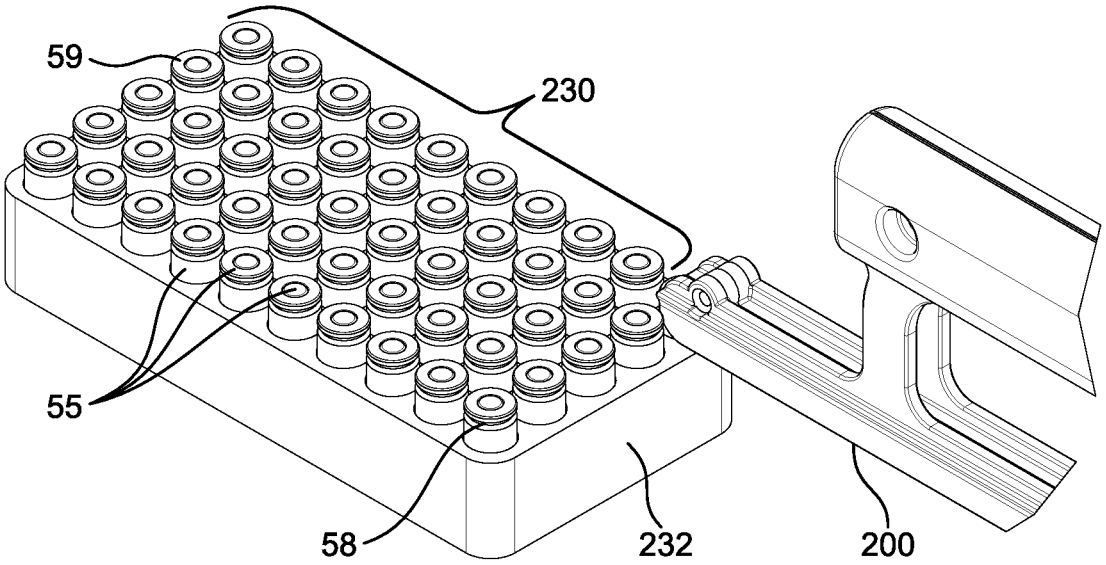
FIGS. 17A & 17B illustrate a scooping operation for scooping cartridges onto a feeder from an ammunition tray according to various embodiments described herein.
Figure 17B:
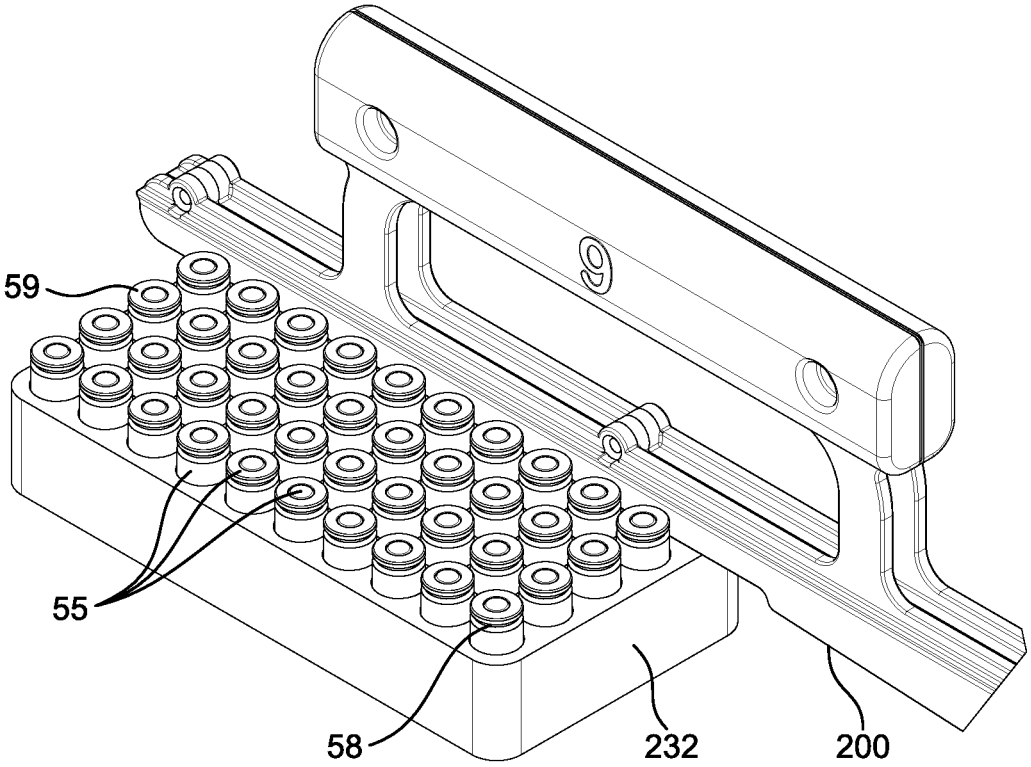

FIG. 15D depicts a cartridge tunnel design with swept upper and lower tunnel walls and rails. In this scenario, the cartridge has rail support during travel throughout the cartridge tunnel and has additional top rail contact while making the 90° transition over the moderately swept top wall. This design allows gravity to help the cartridge make a more graceful turn, rolling down the cartridge tunnel 210 as it gently sweeps to the left.

With reference again to FIGS. 5-7, the body 102 of the illustrated loader 100 includes a magazine interface 127 that includes a recessed cavity 116 for receiving a magazine. The magazine interface 127 also includes an adapter interface 123 including adapter mounts 128 within or adjacent to the recessed cavity 116 for coupling one or more adapters within the cavity 116, wherein the adapter is configured to couple the magazine to the body 102 within the cavity 116. For example, the loader system 8 may include or couple to one or more adapters for further coupling magazines. In some embodiments, adapters may also couple to one or more feeders. In some embodiments, the loader 100 may interchangeably couple to a plurality of adapters via the adapter interface 123. Adapter mounts 128 may include clips, pins, mating structures, e.g., threadable connections, dimensions providing interference fitment, or other suitable mounting structures. The cavity 116 and/or adapters may include universal fitments such that the cavity 116 may receive a plurality of magazines and/or adapters. Each adapter may include a magazine fitting configured to couple one or more magazine styles and calibers. Thus, the body 102 may be configured to couple to any of a number of adapters, such as any adapter, to further operatively couple to any magazine style or caliber utilizing the magazine fitting of a selected adapter. In other embodiments, the body 102 may be configured to directly couple to a magazine without the use of an adapter. For example, the magazine interface 127 may include one or more magazine fittings that may include and/or be positioned within the cavity 116. In another or a further example, the body 102 includes adapter mounts 128 and magazine fittings for coupling magazines to the body 102 directly or via an adapter. In an above or another example, the body 102 may include multiple magazine fittings configured to interchangeably mount two or more magazine styles and/or caliber.

As introduced above, the body 102 may include a magazine interface 127 for directly or indirectly coupling to a magazine. For example, the magazine interface 127 may include one or more fittings for coupling a magazine to the body 102 to thereby secure the magazine relative to the translation paths of the pistons 160, 180 and hence engagement surfaces 162, 182. Magazine fittings may include clips, pins, mating structures, e.g., threadable connections, dimensions providing interference fitment, or other suitable mounting structures. Magazine fittings may be configured to couple to one or more styles and/or caliber magazines. It is to be appreciated that while pistons exemplified in the illustrated embodiments include structures other than engagement surfaces, the present disclosure with respect to pistons is not limited to those additional structures. In various embodiments, such other structures may be provided with respect to other components that interact with piston engagement surfaces to perform the described functions or may be excluded.

FIG. 18 illustrates an example embodiment of a loader system 1 comprising a loader 100*e* similar to that described above with respect to FIGS. 5-7 wherein the body 102 includes a magazine interface 127 configured to directly couple to a magazine. The magazine interface 127 may be positioned within or be associated with cavity 116. The magazine interface 127 includes a magazine fitting 129 for securely coupling a magazine to the body 102. The magazine fitting 129 may be configured to securely accept one or more magazines styles and/or calibers. The magazine fitting 129 may include brackets, retainer clips, tongue and groove guides, slots, interference fit, tapered fit, slide joint, or other retention structure configurations for retaining the magazine. In the illustrated embodiment, the magazine fitting 129 includes one or more tensioners or finger spring clips 129*a* to apply pressure to an inserted magazine. For example, tensioners comprising finger spring clips 129*a* are shown that apply pressure to an inserted magazine, allowing it to be held in place with less force. The magazine fitting 129 also includes a magazine well 129*b* into which the magazine may be inserted and retained by the finger spring clips 129*a*.

In the illustrated embodiment, the loader 100*e* also includes a feeder interface 113 to interface with a feeder. In this embodiment, the feeder interface 113 is configured to interface with a feeder similar to that described with respect to FIG. 13A-14D; however, in this or other embodiments, the feeder interface 113 may be configured to interface with other feeder configurations. As shown, the feeder interface 113 comprises a cavity 113*a* configured to accept insertion of a feeder 200. For example, a feeder may be configured for feeding a caliber cartridge corresponding to a magazine to be loaded and fit snuggly within the cavity 113*a* of the feeder interface 113 and allow precise functionality and ease of removal. The feeder may attach within the cavity 113*a* utilizing feeder mounts 113*b* comprising brackets, retainer clips, tongue and groove guides, slots, interference fit, tapered fit, slide joint, or other retention structure configurations for retaining the feeder.

The cavity 113*a* of the feeder interface 113 may include one or more openings 113*c* that provide one or more pistons or other cartridge manipulation members access to cartridges. For example, the cavity 113*b* of the feeder interface may include one or more openings 113*c* to allow the case piston (not visible) to travel through a retained feeder to access cartridges. An additional opening into the cavity 116 may also be provided to allow the projectile piston (not visible) to translate to engage and maneuver cartridges into a magazine during the loading process.

As introduced above, the loader system may include or be configured to couple to an adapter. The adapter may provide an intersecting/interaction point within the assembly. For example, the adapter may be configured to interface with a body, feeder and a magazine being loaded. In some examples, the adapter may be configured to attach to the body using body fittings, e.g., brackets, utilizing retainer clips, tongue and groove guides, slots, interference fit, tapered fit, slide joint, or other suitable retainer structures. FIGS. 19A & 19B illustrate an embodiment of an adapter 300 according to various embodiments. In the illustrated embodiment, the adapter 300 includes a body fitting 302 including retainer clips 304 to secure the adapter 300 upon insertion into the body.

The adapter 300 may include a magazine interface 318 including a magazine fitting 306 configured to securely accept a magazine of matching stack size and caliber with respect to a configuration of the adapter 300. In one example, the magazine fitting 306 may be configured to securely accept one or more magazines styles and/or calibers. The magazine fitting 306 may include brackets, retainer clips, tongue and groove guides, slots, interference fit, tapered fit, slide joint, or other retention structure configurations for retaining the magazine. In the illustrated embodiment, the magazine fitting 306 includes one or more tensioners or finger spring clips 310 to apply pressure to an inserted magazine. For example, tensioners comprising finger spring clips 310 are shown that apply pressure to an inserted magazine, allowing it to be held in place with less force. The magazine fitting 306 also includes a magazine well 308 into which the magazine may be inserted and retained by the finger spring clips 310.

The adapter 300 may include a feeder interface 312 to interface with a feeder. In this embodiment, the feeder interface 306 is configured to interface with a feeder similar to that described with respect to FIG. 13A-14D; however, in this or other embodiments, the feeder interface 306 may be configured to interface with other feeder configurations. As shown, the feeder interface 306 comprises a cavity 313 configured to accept insertion of a feeder. For example, a feeder may be configured for feeding a caliber cartridge corresponding to a magazine to be loaded and fit snuggly within the cavity 313 of the feeder interface 306 and allow precise functionality and ease of removal. The feeder may attach within the cavity 313 utilizing feeder mounts 314 comprising brackets, retainer clips, tongue and groove guides, slots, interference fit, tapered fit, slide joint, or other retention structure configurations for retaining the feeder.

Adapters 300 may be configured to accommodate any caliber and/or length cartridge. In the illustrated embodiment, the adapter 300 is dimensioned to match the caliber of the magazine being loaded and feeder being utilized, to ensure proper mating of the components.

The cavity 313 of the feeder interface 306 may include one or more openings that provide one or more pistons or other cartridge manipulation members access to cartridges. For example, the cavity 313 of the feeder interface 306 may include one or more openings 315 to allow a case piston 160 to travel through the adapter 300 and into the contained feeder to access cartridges. In the illustrated embodiment, the adapter 300 includes one or more additional openings (not visible) along a side of the adapter 300 to allow a projectile piston 180 to travel through the adapter 300 to maneuver cartridges into a magazine during the loading process.

Figure 20A:
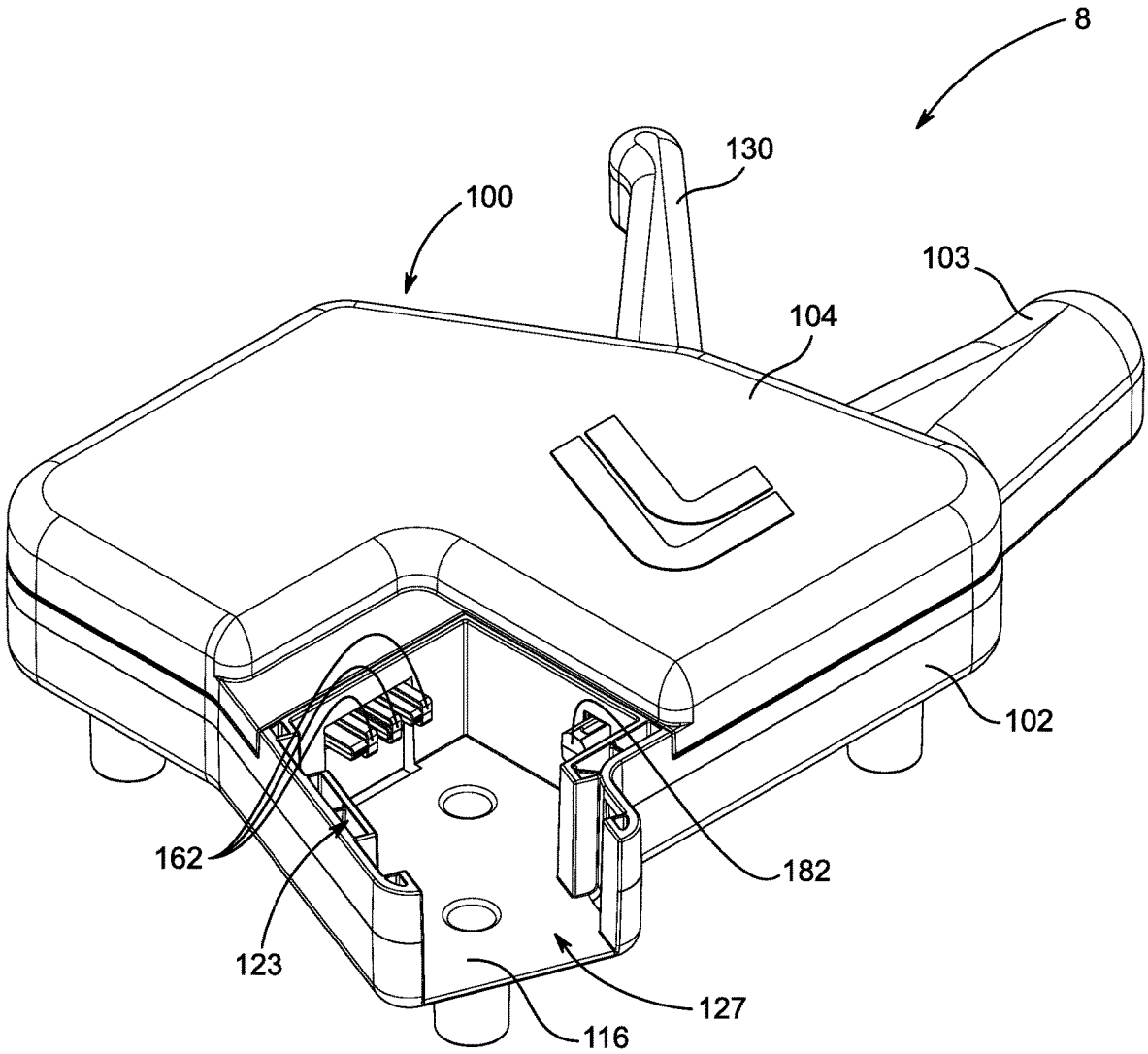
FIG. 20A illustrates a loader of a loader system according to various embodiments described herein.
Figure 20B:
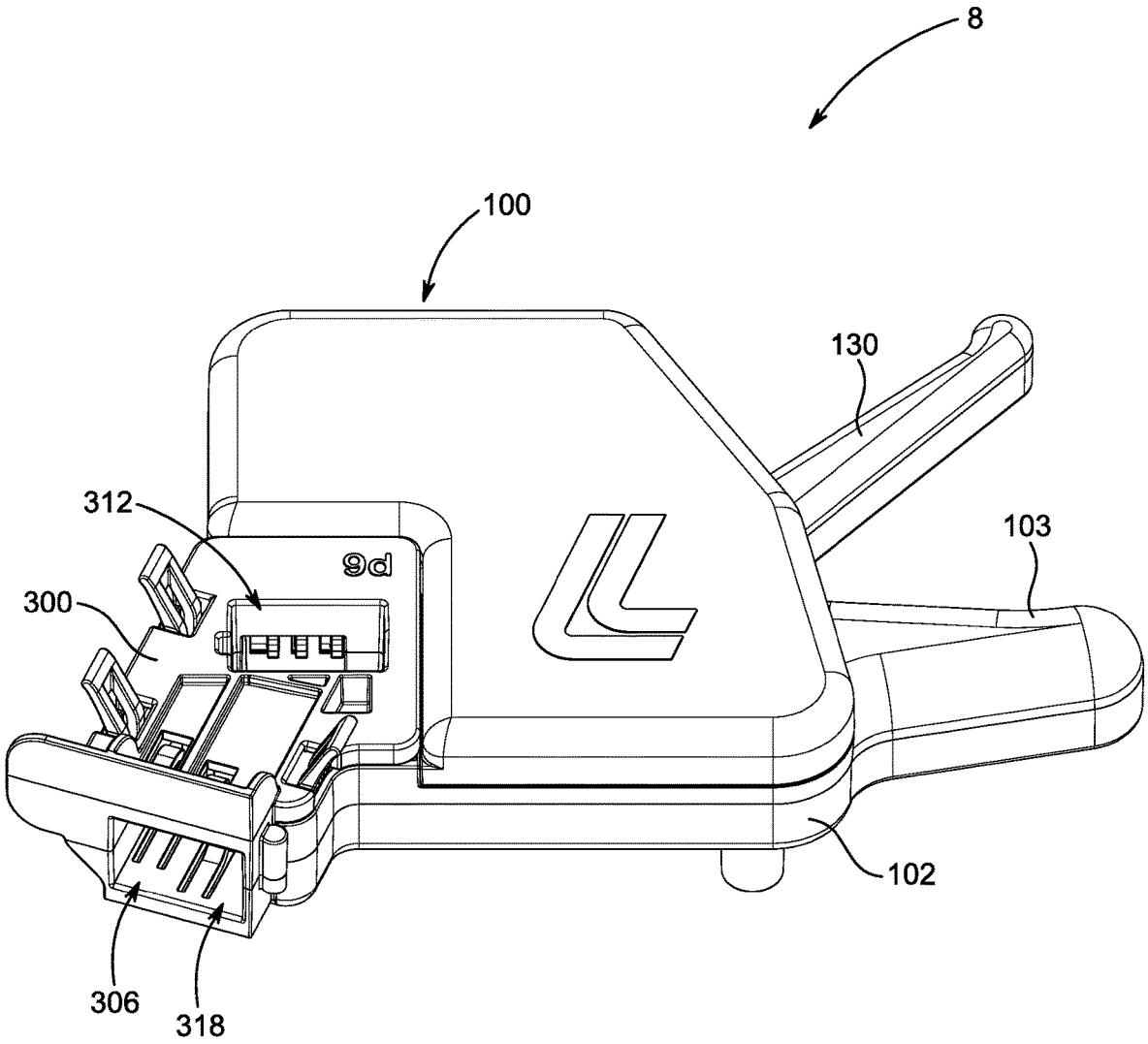
FIG. 20B illustrates the loader shown in FIG. 20A with the adapter shown FIGS. 19A & 19B inserted into an adapter interface comprising adapter mounts according to various embodiments described herein.

FIGS. 20A-20D illustrate preparation of the loader system 8 according to various embodiments for performing a loading operation. The loader 100 illustrated in FIG. 20A is similar to that described with respect to FIGS. 4-7 and includes adapter mounts 128 along the cavity 116 configured to couple the body fitting 302 of the adapter 300. When an adapter 300 is being used, a user may select the proper adapter 300 based on a caliber and stack size of the magazine 400 being loaded. The adapter 300 may be inserted into the adapter interface 123 of the body 102 utilizing adapter mounts 128. As shown in FIG. 20B, retainer clips 304 of the body fitting 302 may be used to latch onto the body 102 to secure the adapter 300 in place within the cavity 116.

A feeder 200 matching the caliber size of the selected adapter 300 may be used to feed the loader 100. Suitable cartridges 55 may be slotted between rails 212 of the feeder 200 and moved along the cartridge path 202 toward the feeder exit 206. In one example, this may be performed as describe with respect to FIGS. 16-17B to scoop cartridges out of a tray from a box of ammunition. For example, a tapered and/or ramped rail portion 213 along the feeder entrance 204 may be placed on a first cartridge 55 in a row 230 within a tray 232. Using the handle 226, a user may slide the feeder 200 forward across the cartridges 55. As noted, the rails 212 at the entrance 204 to the feeder 200 may be tapered, allowing the opening to be laid flat on top of the first cartridge 55 in a tray 232. Chamfered and/or beveled rails 212 may be utilized to automatically align themselves with an extractor groove 58 of the cartridges 55 as the feeder 200 is moved forward across the cartridges 55. The feeder 200 can be moved across the number of cartridges 55 desired to load within the feeder 200. Lifting the feeder 200 up will raise the cartridges 55 from the tray and allow the cartridges 55 to slide along the feeder rails 212 to the base 208, or exit end, of the feeder 200 where they may be prevented from passing through the feeder exit 206 by the cartridge stop 214. This scooping process may be repeated until the desired number of cartridges 55 are slotted along the cartridge path 202 or the feeder 200 is full to capacity. Conveniently, if the feeder employs a cartridge stop at the entrance 204, the cartridge stop may be engaged to prevent cartridges from falling out of the entrance 204 the scoop during movement or transport.

Figure 20C:
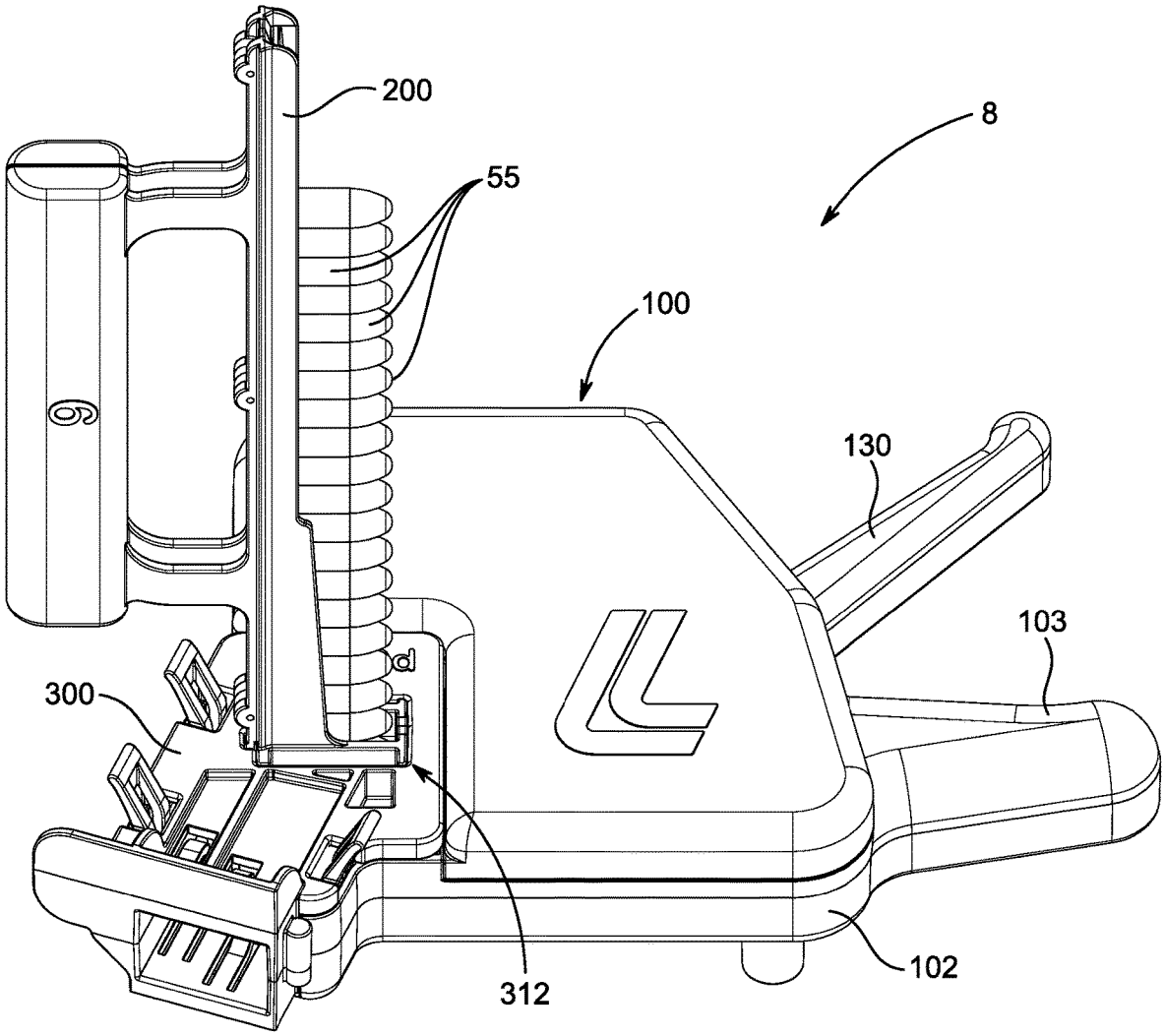
FIG. 20C illustrates the loader and adapter of FIG. 20B with the feeder shown in FIG. 14A inserted into a feeder interface according to various embodiments described herein.
Figure 20D:
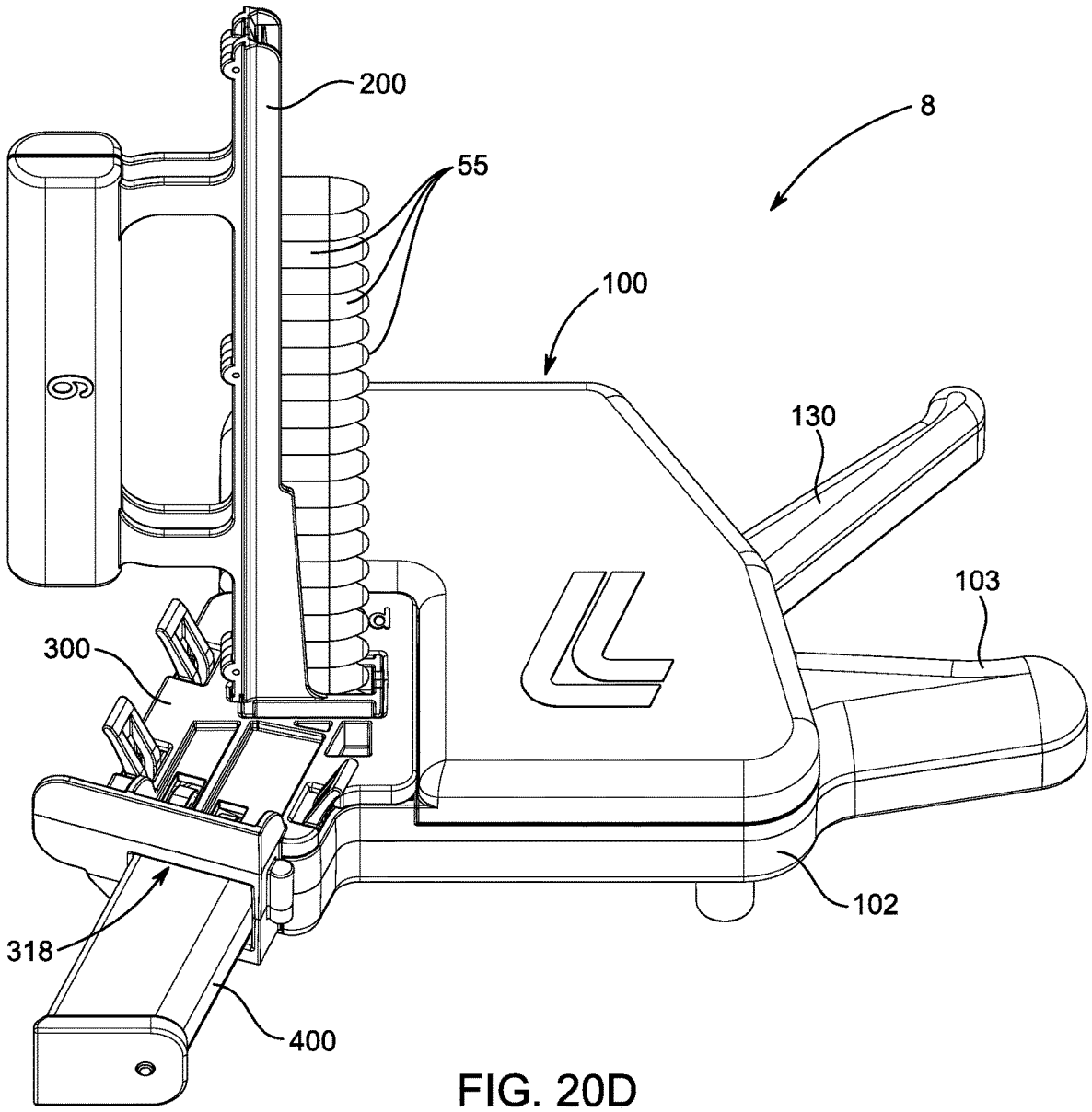
FIG. 20D illustrates the loader together with the adapter and feeder shown in FIG. 20C with a magazine inserted into a magazine interface comprising a magazine wall of the adapter according to various embodiments described herein.

The loaded feeder 200 may then be inserted into the feeder interface 312 of the adapter 300, as shown in FIG. 20C. As shown in FIG. 20D, an unloaded, or partially loaded, magazine 400 may be inserted into the magazine well 308 of the adapter 300. In the illustrated embodiment a 9 mm double-stack magazine 400 is shown. Depending on the adapter 300 used, other magazine styles and calibers may also be inserted for loading. The user may hold the magazine 400 in place with their hand. Magazine tensioners, e.g., finger spring clips 310, may be used to help secure and center the magazine 400 in the magazine well 308. A raised wall, molded to the adapter 300 above the magazine well 308, can be used to create leverage while holding the magazine 400 in place.

Figure 21A:
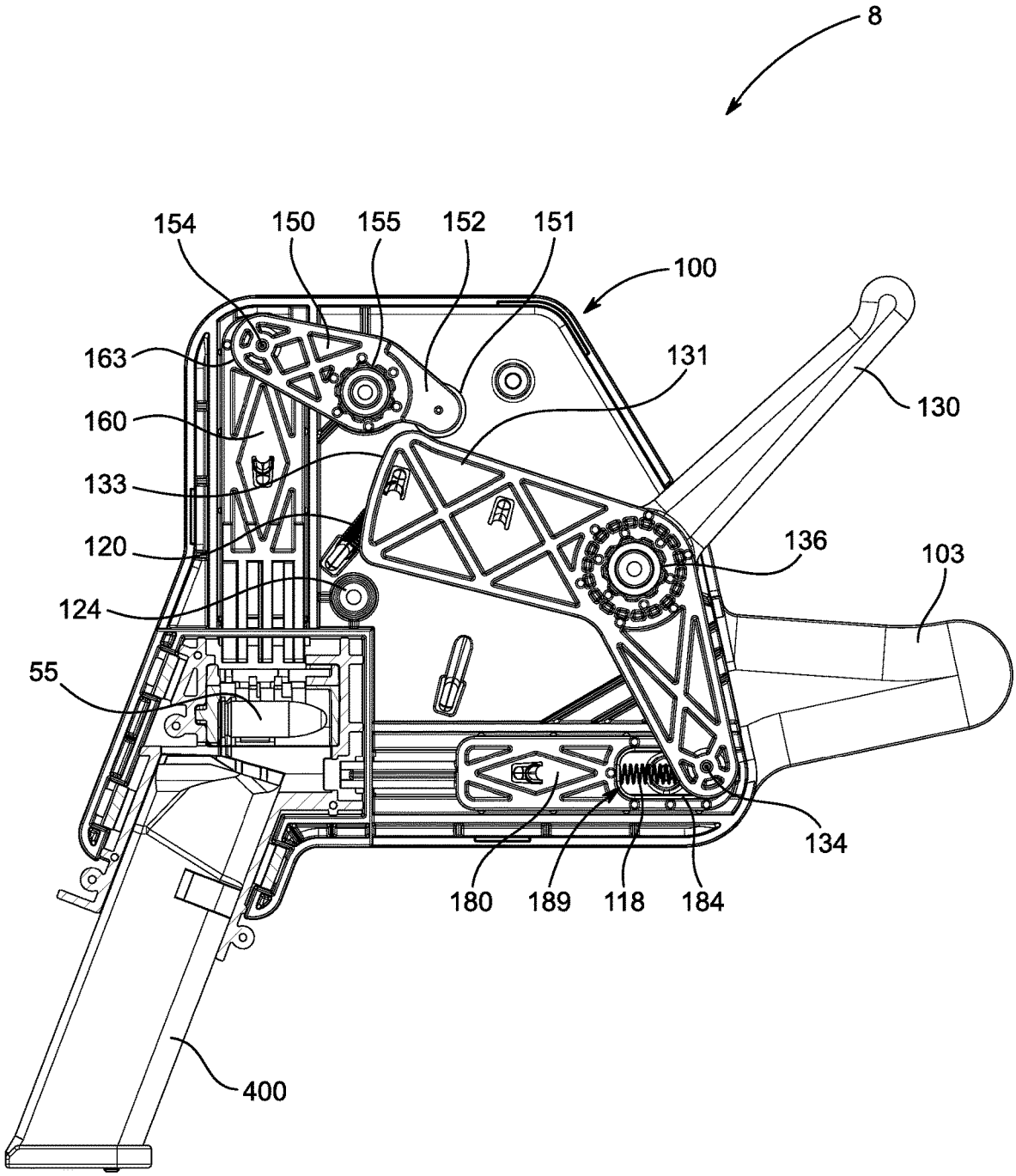
FIGS. 21A-21C illustrate a loading operation of the loader system including the loader shown in FIG. 5 coupled to the adapter shown in FIGS. 19A & 19B, the feeder shown in FIG. 14A, and a magazine as shown in FIG. 20D according to various embodiments described herein.
Figure 21B:
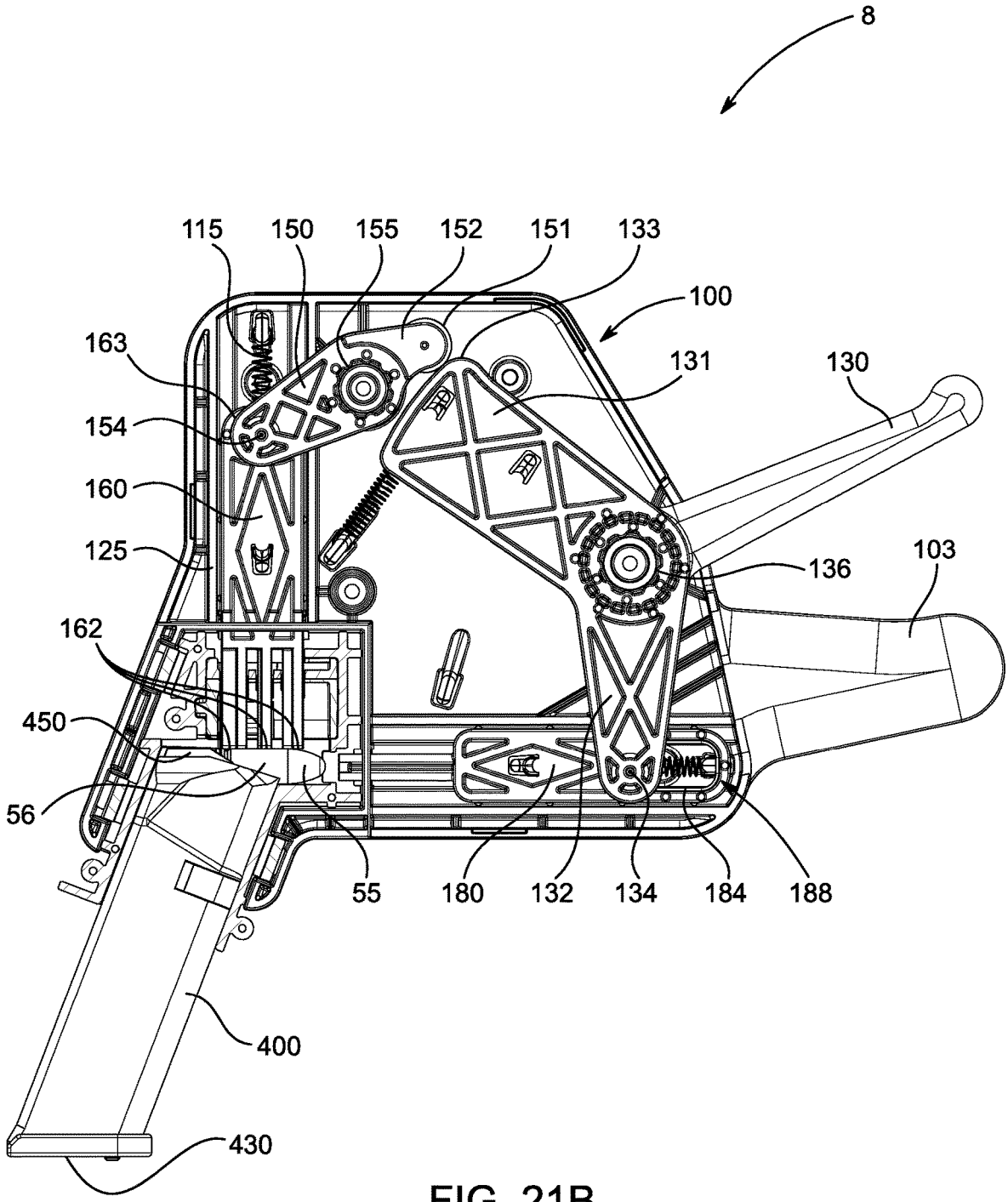
Figure 21C:
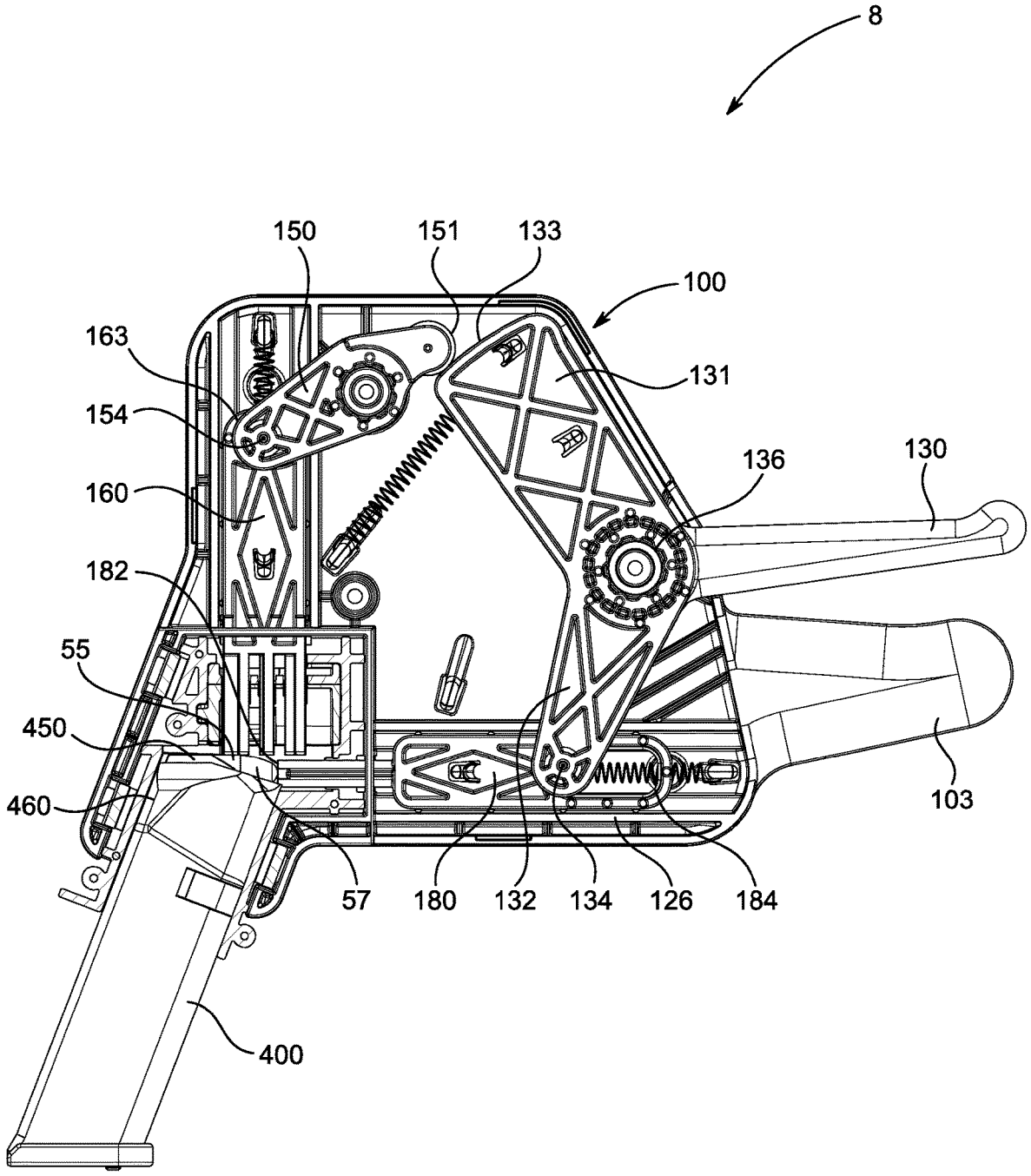

FIGS. 21A-21C illustrate a loading operation using the loader system 8 including the loader 100 of FIGS. 5-7 with an inserted adapter 200, feeder 300, and magazine 400 as described with respect to FIGS. 20A-20D. In particular, FIGS. 21A-21C illustrate a top view of the loader body 102 (without a cover) including the coupled adapter 300, coupled loaded feeder 200, and magazine 400 inserted into the adapter 300. The feeder 200 and adapter 300 are shown in cross-section to better illustrate how pistons 160, 180 maneuver a cartridge 55 from the feeder 200, through adapter 300, and into magazine 400 during operation.

For the loading operation, the loader 100 may be placed on the pedestals, or feet 122, on a flat, and preferably level surface. Rubber, felt or other material can be used on the feet 122 to prevent or promote sliding, or absorb shock. In some embodiments, the loader 100 may be screwed/bolted down to a surface for use using the mounting holes.

While firmly holding the magazine 400, the user may begin to squeeze the lever 130, rotating it in a clockwise direction, using the body handle 103 to generate leverage. While, in some embodiments, the magazine 400 may be fully retained by the loader 100 without the user holding the magazine 400 during the loading operation, it has been found that holding a magazine 400 in place during the loading operation provides preferable results as it avoids potential damage to the loading system 6 or loader 100. For example, if a user is not aware that a magazine 400 is full, and keeps cycling the pistons 160, 180, the magazine retention structures may be damaged if the magazine 400 is jettisoned from the loader by the force of the pistons 160, 180. Alternately, the pistons 160, 180 and/or other components may be damaged if the magazine 400 is not jettisoned. Thus, in some embodiments, the magazine fitting 306/129 may include tensioners, e.g., finger springs 129*a* (FIG. 18), finger springs 310 (FIGS. 19A & 19B), to assist in positioning of the magazine 400 but that also allows the magazine to be easily released into the hand of the user when loaded without damaging the loader 100. In some embodiments, sensors may be used to detect when the magazine is nearing capacity or when force is too high such that damage is likely. For example, the embodiment described with respect to FIG. 3 may include a sensor, such as a contact micro switch that detects if the magazine 400 is properly seated. If not enough pressure is applied by a user to allow the piston 160 to compress the spring of the magazine follower 440, or maximum capacity is exceeded, the magazine 400 will push out of its seat in the magazine well 129*b* (FIG. 18), 308 (FIGS. 19A & 19B). In some instances, even a fraction of a millimeter of separation will cause the loading operation to stop to prevent damage.

During the first stage of rotation, the rocker arm 150 rides along the lever cam plate 131, rotating the rocker arm 150, which directs the case piston 160 and engagement surface 162 through the adapter 300 and feeder openings 220. The case piston 160/engagement surface 162 makes contact with the cartridge 55 in the cartridge tunnel 210 at the bottom of the feeder 200, pushing against the cartridge case 56, driving it through the cartridge stop 214.

The case piston 160 presses against the cartridge case 56, directly or indirectly compressing the magazine follower spring by pushing the magazine follower 440 and/or cartridges already within the magazine 400 downwardly or toward the base of the magazine 400 to create room for the current cartridge being loaded. The case piston 160, extended through the feeder base 208, prevents the remaining cartridges in the feeder 200 from dropping to the bottom of the feeder 200.

The swing arm 132 of the lever 130 rotates during the first stage of rotation. However, the elongated socket of the lever coupling 184 allows the projectile piston 180 coupling 134 attached to the swing arm 132 to travel freely within the socket from a first end 188 to a second end 189 without moving the projectile piston 180 until engaged therewith along the second end 189 of the socket.

The user may continue to squeeze the lever 130, rotating the cam plate 131, forcing the rocker arm 150 to ride along the cam plate surface 133, driving the case piston 160 to its final position, as shown in FIG. 21B. At this point, the lever 130 has been rotated approximately 20° and the first stage of rotation has completed. The case piston 160 has maneuvered a cartridge 55 from the feeder 200, through the adapter 300, into the opening of the magazine, forward or otherwise offset from the feed lips 450, compressing the magazine follower 440. The cartridge 55 must now be forced to the back 460 of the magazine 400 where it can be contained by the feed lips 450. The second stage of rotation typically commences when the case piston 160 has reached a final position and the projectile piston coupling 134 makes contact with the projectile piston coupling 134 socket. As the user continues to squeeze the lever 130, the swing arm 132 of the lever 130 continues to rotate in a clockwise direction. The projectile piston coupling 134 makes contact with the second end of the socket 189 of the lever coupling 184 and pushes the projectile piston 180 and engagement surface 182 in a direction approximately perpendicular to the translation axis of the case piston 160 and engagement surface 162. The projectile piston 180 travels through the adapter 300 opening and engages the cartridge projectile 57 and begins to push the cartridge toward the back 460 of the magazine 400.

The dimensions of the cam plate 131 are configured to maintain the position of the rocker arm 150 at the end of the first stage during the second stage of lever 130 rotation. The portion of the cam plate surface 133 that contacts the rocker arm 150 during the second stage of rotation is concentric to the lever 130 shaft, neither rotating the rocker arm 150 nor allowing it to return to its resting position. For example, the rocker arm 150 is held in place by the pie-shaped cam plate 131 of the lever 130, holding the case piston 160 in place with the cartridge 55 pushed toward the bottom of the magazine 400, compressing the magazine follower 440. With the case piston 160 unable to move, movement of the cartridge 55 is limited to parallel to the projectile piston 180 and engagement surface 182 translation path and the engagement surface 162. The shaft of the projectile piston coupling 134, now making contact with the second end of the slot 189 of the lever coupling 184, pushes the projectile piston engagement surface 182 against the projectile, sliding the cartridge 55 to the back 460 of the magazine 400 where it will be contained by the magazines feed lips 450 at a top of the magazine 400.

The lever 130 will stop rotating when the projectile piston engagement surface 182 pushes the cartridge all the way to the back 460 of the magazine 400, completing the loading process. The degree of rotation may generally depend on the length of the cartridge 55 being loaded. In the illustrated embodiment, the lever 130 has rotated to completion at approximately a maximum of 40° in this embodiment or when the cartridge 55 can be no longer be pushed to the back 460 of the magazine 400. The user releases pressure on the lever 130, allowing the return bias member 120 to rotate the lever 130 counterclockwise to its initial resting position. With the cam plate surface 133 no longer preventing the rocker arm 150 from rotating, the case piston return bias member 115 can force the case piston 160 and attached rocker arm 150 to their initial resting positions. The lever swing arm 132 and projectile piston return bias member 118 will return the projectile piston 180 to its initial resting position.

As the case piston 160 exits the base 208 of the feeder 200, the remaining cartridges 55 in the feeder 200, no longer blocked by the case piston 160, are free to slide down into the cartridge tunnel 210, ready for extraction by the case piston 160 during the next cycle.

The process can be repeated until the magazine is loaded to capacity or the desired number of cartridges 55 are loaded. Upon reaching the desired count, the magazine 400 may be removed from the adapter magazine well 308. Additional magazines 400 can be inserted and loaded by repeating the loading process of squeezing the lever 130. When all cartridges in the feeder 200 have been loaded into magazines 400, the feeder 200 may be removed and refilled. In various embodiments, the loader 100*a* described with respect to FIG. 18 may receive a feeder 200 and magazine 400 in a manner similar to that described with respect to FIGS. 20A-20D and may be operated in a manner similar to that described with respect to the loading operation depicted in FIGS. 21A-21C to load the magazine 400.

Cartridge wells 430 of magazines 400 in which cartridges are stacked may be placed at different angles relative the projectile piston 180. Additionally or alternatively, the projectile piston 180 may be placed at varying angles to the case piston 160 and/or the magazine opening 410, base 430, feed angle of the magazine well 430, feed lips 450, and/or back 460 to allow smoother cartridge insertion. In the illustrated embodiment, the projectile piston 180 translates approximately perpendicular to the case piston 160, and the feed angle of the magazine is approximately 21° relative the case piston 160. In one embodiment, the projectile piston 180 may urge cartridges 45 into magazines 400 designed with a 20° feed angle, like the 1911, on approximately a 1° angle to its feed lips 450. In another embodiment, the projectile piston 180 may urge cartridges 55 into magazines 400 with a 19° feed angle at approximately a 2° angle relative to its feed lips 450. It will be appreciated that other angles may be used. For example, in some embodiments the projectile piston 180 may be configured to push cartridges at angles between approximately 0° to approximately 5°, such as approximately 5°, approximately 4°, approximately 3°, approximately 2°, approximately 1° relative to feed lips 450 of a magazine. As used herein, approximately can include +/−10%.

FIGS. 22A-22D illustrates a loader system 6 including a loader 100*a* for performing a loading operation according to various embodiments described herein. The loader system 6 includes a case piston 160*a* and a projectile piston 180*a*, each comprising a respective engagement surface 162, 182 for engaging a cartridge 55 to load into a magazine 400. The magazine 400 is shown in cross-section and includes a magazine feed opening 410 into which cartridges 55 may be inserted. A well 420 extends from a base 430 to the opening 410 and feed lips 450, which prevent loaded cartridges 55 from being ejected from the opening 410 by a follower 440. The follower 440 is biased toward the opening 410, typically by a spring (not shown) that attaches between the base 430 and the follower 440.

Figure 22A:
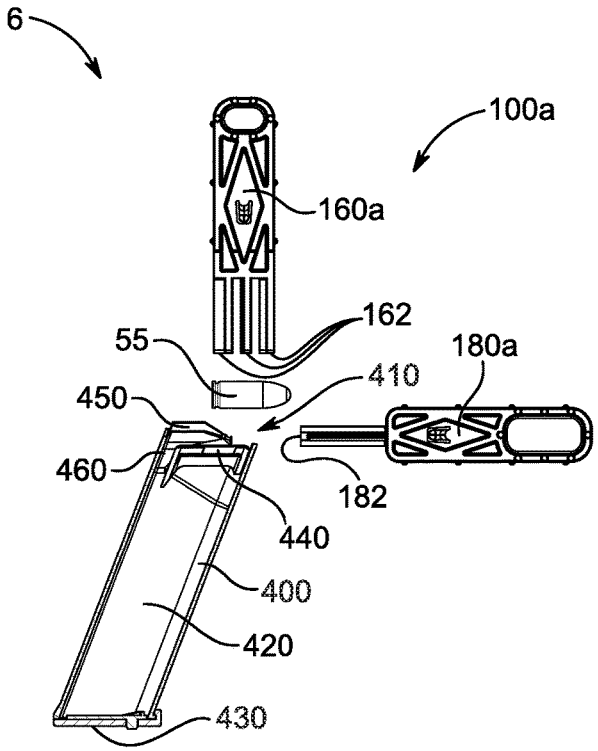
FIGS. 22A-22D illustrate a loading operation of a loader system according to various embodiments described herein.
Figure 22B:
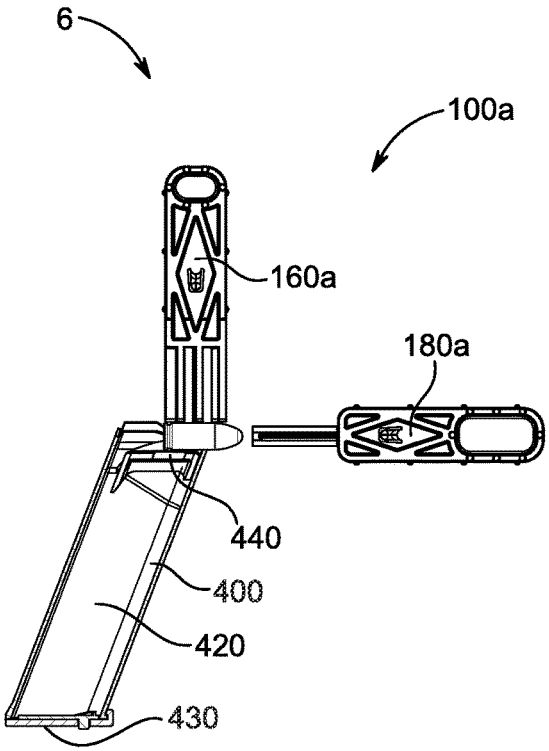
Figure 22C:
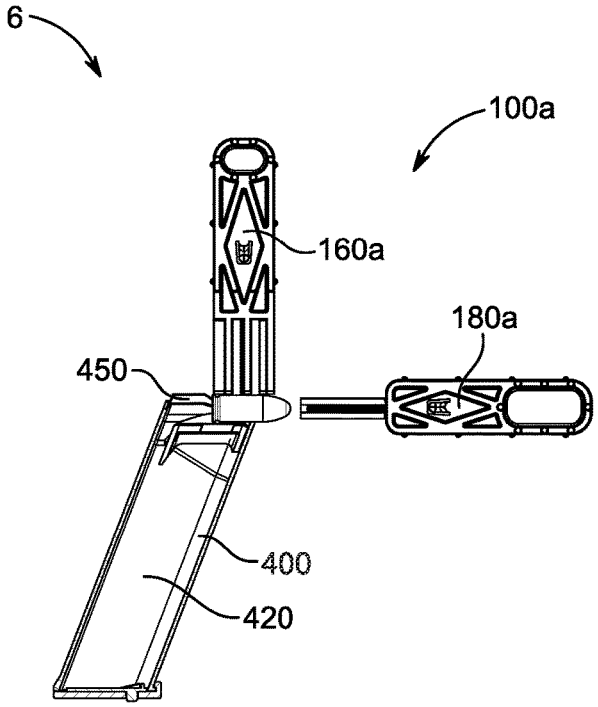
Figure 22D:
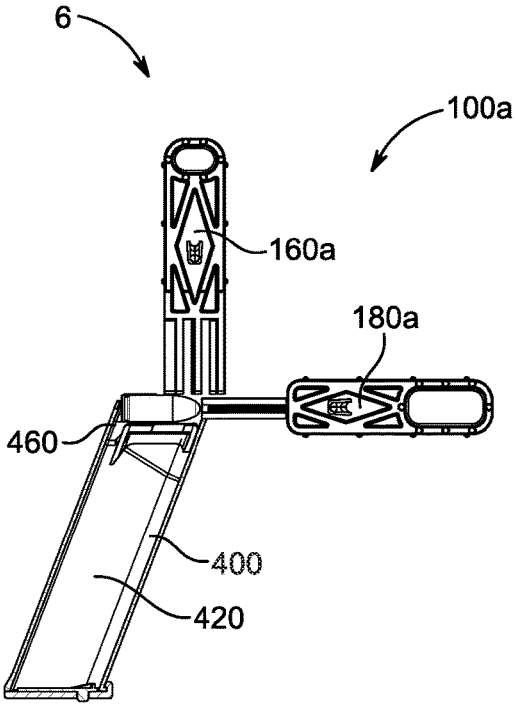
Figure 23A:
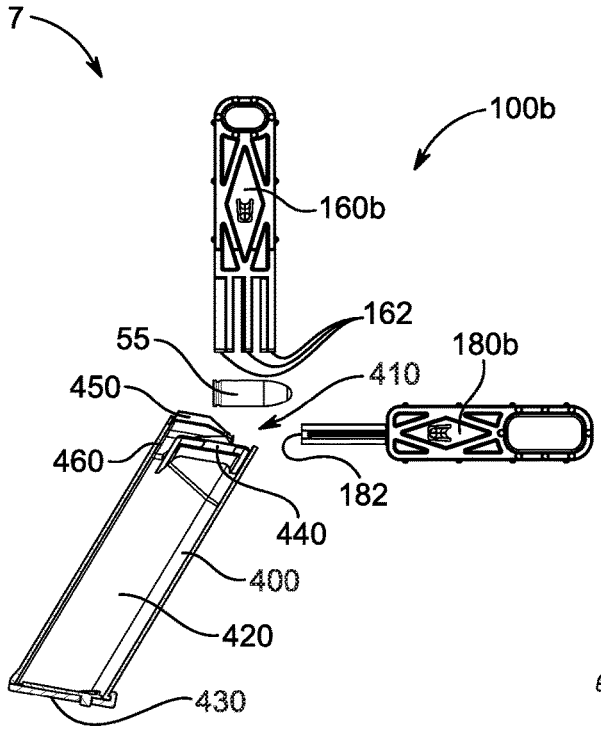
FIGS. 23A-23D illustrate a loading operation of a loader system according to various embodiments described herein.
Figure 23B:
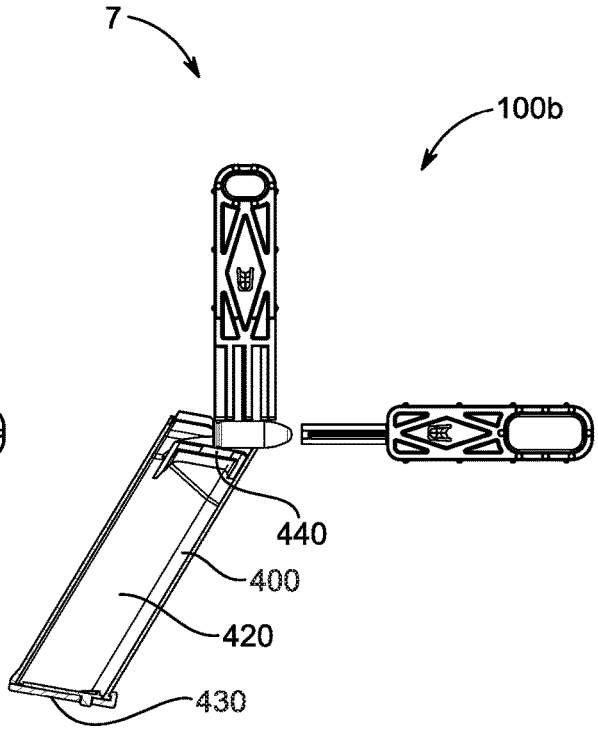
Figure 23C:
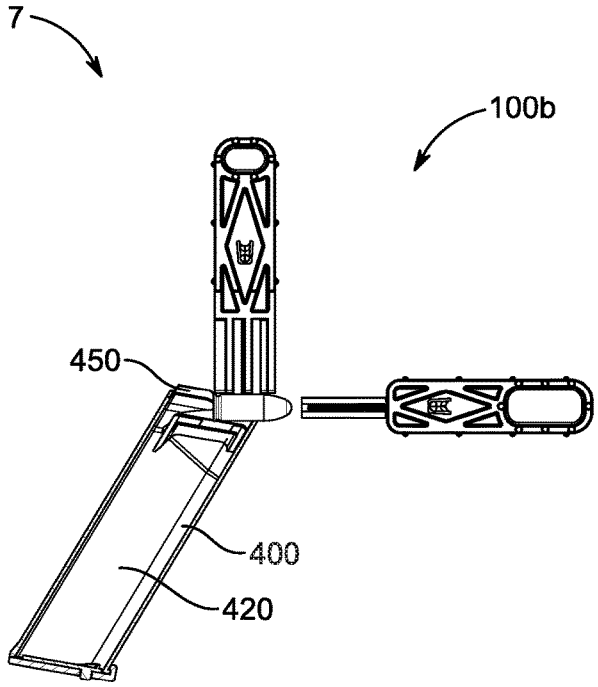
Figure 23D:
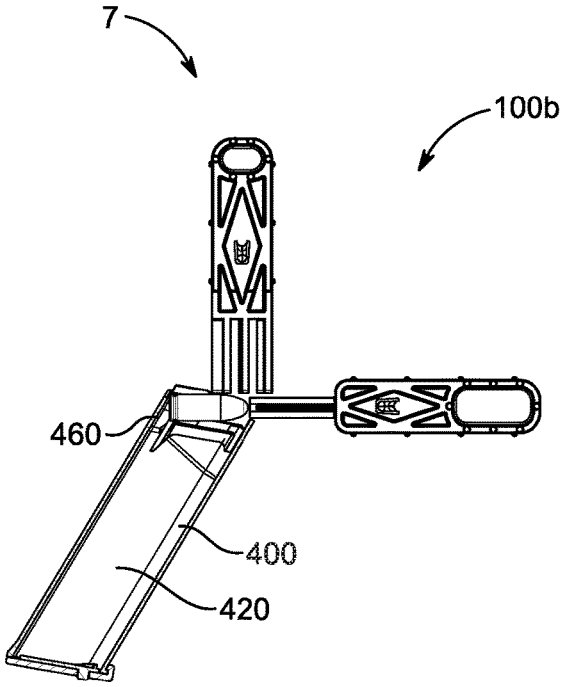

Each piston 160*a*, 180*a* is translatable to translate a respective engagement surface 162, 182 along a translation path along which the cartridge 55 is engaged and urged directly or indirectly against the follower 440 at an opening 410 between first and second positions of the translation path of the case piston engagement surface 162 (FIG. 22B) and, while held directly or indirectly against the follower 440 by the case piston engagement surface 162 in the second position (FIG. 22C), urged by the projectile piston engagement surface 182 toward a back 460 of the magazine 400 from its first position to its second position (FIG. 22D). The pistons 160*a*, 180*a* may also be configured to return the engagement surfaces 162, 182 to a pre-translation or resting position (FIG. 22A) following loading a cartridge 55 into the magazine 400. Translation of the pistons 160*a*, 180*b* may be driven by any mechanism, such as any mechanism described herein. While not shown for ease of understanding, the loader 100*a* may include a body along which the pistons 160*a*, 180*a* translate. In one embodiment, loader 100*a* is configured in a manner similar to loader 100 (FIGS. 5-7). In another embodiment, the loader 100*a* is configured in a manner similar to loader 10 (FIGS. 1A-1E or FIG. 2), loader 10*c* (FIG. 3), loader 10*d* (FIGS. 4A-4C), or other loader embodiment described herein. The magazine 400 may be retained relative to the pistons 160*a*, 180*a* directly or indirectly by the body, which may be via any mechanism described herein. For example, the magazine 400 may be retained by clips to the body or by an adapter coupled to the body. The cartridges may be fed to the loader 100*a* by any suitable mechanism, e.g., by hand or utilizing a feeder.

In this embodiment, the pistons 160*a*, 180*a* are positioned to translate the engagement surfaces 162, 182 along translation paths approximately 90° (+/−3°) relative to each other. The magazine feed lips 450 are approximately parallel with the translation path of projectile piston engagement surface 182 and approximately perpendicular to the translation path of the case piston engagement surface 162. Translation of the case piston 160*a* pushes the cartridge 55 approximately perpendicular to the feed lips 450. Translation of the projectile piston 180*a* pushes cartridge 55 approximately parallel to feed lips 450. In some embodiments, greater deviation from 90°, e.g., +/−5° to 10° may be used.

FIGS. 23A-23D illustrates another loader system 7 including a loader 100*b* for performing a loading operation according to various embodiments described herein. Loader system 7 may be similar to loader system 6 described with respect to FIGS. 22A-22D, wherein like numbers identify like features. In this embodiment, the pistons 160*b*, 180*b* translate engagement surfaces 162, 182 along translation paths approximately 90° (+/−3°) relative to each other. The magazine feed lips 450 are approximately 10° relative to the translation path projectile piston 180*b* and engagement surface 162 and approximately 100° (+/−3°) relative to the translation path of the case piston 160*b* and engagement surface 162. The case piston engagement surface 162 pushes cartridge 55 approximately perpendicular (+/−3°) to projectile piston engagement surface 182 path but 100° (+/−3°) degrees relative to the feed lip angle. The projectile piston engagement surface 182 pushes the cartridge approximately 10° degrees relative to feed lips 450. In some embodiments, greater deviation from 90° or 100°, e.g., +/−5° to 10° may be used.

In some embodiments, the pistons and or engagement surfaces do not translate along perpendicular engagement paths. In this or another embodiment, one or both of the pistons include an angled engagement surface. In an above or another embodiment, the translation path of the projectile piston may not be parallel to feed lips of a magazine and/or the translation path of the case piston may not be perpendicular to the feed lips of the magazine.

FIGS. 24A-24D illustrates another loader system 9 including a loader 100*c* for performing a loading operation according to various embodiments described herein. Loader system 9 may be similar to loader system 6 described with respect to FIGS. 22A-22D, wherein like numbers identify like features.

Figure 24A:
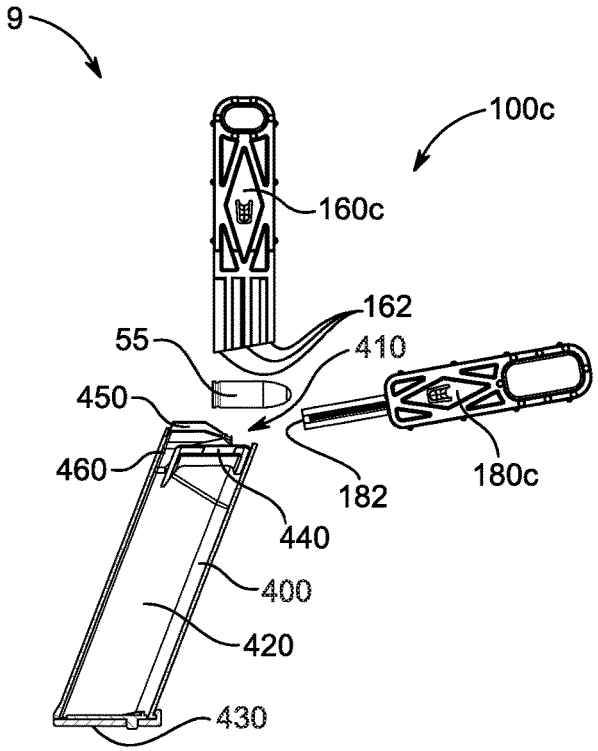
FIGS. 24A-24D illustrate a loading operation of a loader system according to various embodiments described herein.
Figure 24B:
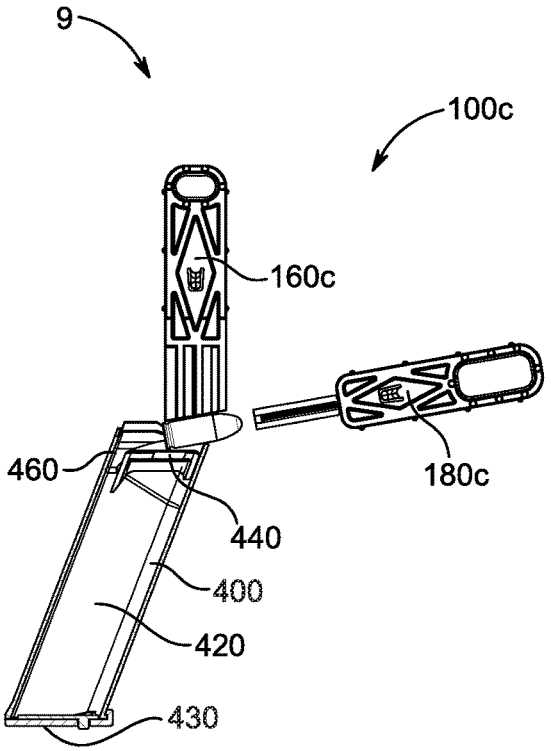
Figure 24C:
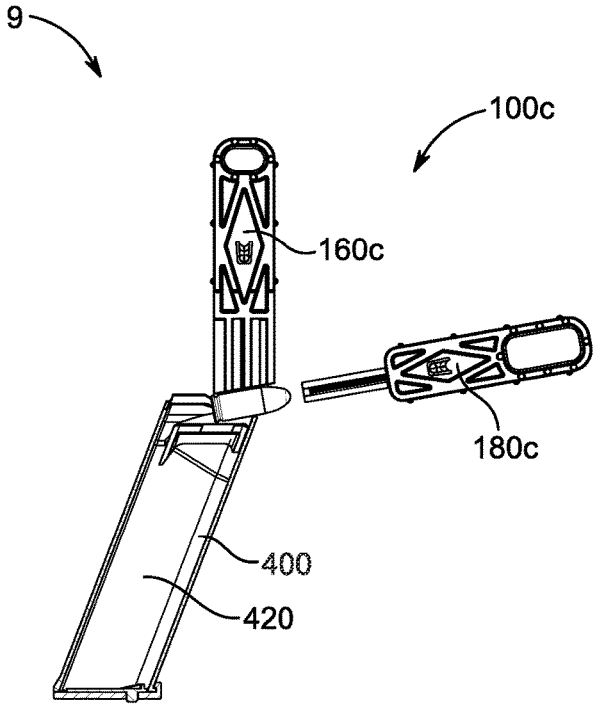
Figure 24D:
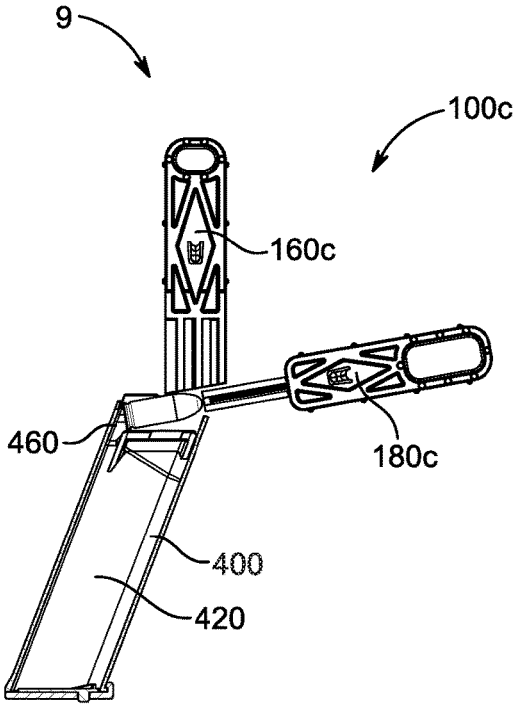

In this embodiment, the translation paths of the engagement surfaces 162, 182 are approximately 80° (+/−3°) relative to each other. The angle of magazine feed lips 450 are approximately 10° degrees relative to the translation path of the projectile piston engagement surface 182. The angle of the magazine feed lips 450 is also approximately perpendicular (+/−3°) to the translation path of case piston engagement surface 162, but approximately 10° relative to the engagement surface 162 of the case piston 160*c* (FIGS. 24A-24B). The angled engagement surface 162 of the case piston 160*c*, which is positioned along prongs in this embodiment, is approximately 10° relative to feed lips 450. The engagement surface 162 of the case piston 160*c* repositions the cartridge approximately 10° relative to the magazine feed lips 450 and approximately parallel to the translation path of the projectile piston 180*c* (FIG. 24C). The projectile piston 180*c* inserts the cartridge 55 on angle approximately 10° relative to feed lips 450 (FIG. 24D). While the case pistons illustrated in FIGS. 22A-24D and elsewhere herein include engagement surfaces located along multiple prongs, in other embodiments, the case pistons may include engagement surfaces on additional prongs or fewer prongs, such as two or one prong.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. For example, in the illustrated embodiments, single body designs are depicted; however, in some embodiments, the body may comprise a multiple body component design. For example, a first body portion housing one or more components, such as a first piston, may be positioned relative to a second body portion housing one or more components, such a second piston, to position associated components for loading operations. A magazine may be attached to the first and/or second body portion or the body may include a third body portion for attaching a magazine, which may be attached to the first and/or second body portion. In one embodiment, body portions may be modular such that body portions may be coupled for operation. In one example, body portions may be couplable in multiple orientations to achieve a different translation path for one or more of the pistons. For example, to accommodate different magazine and/or cartridge configurations, a first body portion housing a first piston may be couplable to a second body portion housing a second piston in a plurality of orientations wherein the orientations alter relative translation paths of the first and second pistons, which may include modification in distance between translation paths, modification in relative angles of translation, and/or modification in a translation distance of a piston while in contact with a cartridge. Similarly, in some embodiments, the loader may include multiple case pistons and/or projectile pistons that may be interchanged to modify translation paths and/or engagement surfaces, for example. In some embodiments, the body may include adjustable anchor points. For example, pivot points may be movable to adjust relative locations of pivoting of components to modify translation paths. In embodiment, the system may include a plurality of interchangeable guides that may be selected for modifying translation parameters of components and/or cartridges. It is also to be appreciated that while the illustrated embodiments may include various features, such features are not intended to be essential unless indicated otherwise. For example, while the illustrated embodiments generally include piston guides for guiding pistons. In some embodiments, piston guides are not included and the translation paths of the pistons are suitably rigid such that guides are not necessary. Similarly, engagement surfaces may extend along a single or multiple surfaces and an entire engagement surface need not engage a cartridge. Feeders may take many forms, and the loaders described herein may be modified to couple to any feeder. Further, loader systems need not include adapters and/or feeders. Loaders according to the present description need not couple to the feeder embodiments described herein or other feeder. In some examples, a loader may be feed cartridges by hand by positioning the cartridge at a location between pistons.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" generally refers to "x", "y", or both "x" and "y", and may be considered to be generally synonymous with "and/or," whereas "either x or y" refers to exclusivity.

The present disclosure may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the various embodiments, and they are not intended to serve as a complete description. Many other arrangements will be apparent to those of skill in the art upon reviewing the above description. Other arrangements may be utilized and derived therefrom, such that logical substitutions and changes may be made without departing from the scope of this disclosure.

What is claimed is:

1. A loader system for loading an ammunition magazine, the loader system comprising:

a loader, the loader comprising:

a first piston comprising a first engagement surface translatable along a first translation path that extends along a first axis and is configured to engage and urge a cartridge during translation from at least a first position to a second position of the first translation path;

a second piston comprising a second engagement surface translatable along a second translation path that extends along a second axis, distinct from the first axis, and is configured to engage the cartridge during translation from at least a third position to a fourth position of the second translation path; and a feeder configured to retain a plurality of the cartridges and to sequentially feed the cartridges to the loader along a third axis, distinct from the first and second axes, wherein the first piston engagement surface is configured to urge the cartridge from the feeder and directly or indirectly against a magazine follower of a magazine when the first piston engagement surface translates from the first position to the second position, and wherein the second piston engagement surface is configured to urge the cartridge to a back of the magazine such that the cartridge is retained within the magazine below feed lips of the magazine when the second piston engagement surface translates from the third position to the fourth position.

2. The loader system of claim 1, wherein the first translation path extending between the first and second positions is approximately perpendicular to the second translation path extending between the third and fourth positions.

3. The loader system of claim 1, wherein the second translation path between the third position and the fourth position extends within 10° of parallel relative to a magazine feed lip angle.

4. The loader system of claim 1, wherein the first piston engagement surface translates from the first position to the second position before the second piston engagement surface translates from the third position toward the fourth position.

5. The loader system of claim 1, wherein the first piston engagement surface translates from the first position to the second position before the second piston engagement surface translates along the second translation path.

6. The loader system of claim 1, wherein, after the first piston engagement surface translates along the first translation path from the first position to the second position, the first piston remains at approximately the second position wherein, while in the second position, the first piston engagement surface is positioned to provide a guide surface along which the cartridge is guided when urged toward the back of the magazine by the translation of the second piston engagement surface from the third position to the fourth position.

7. The loader system of claim 1, wherein the loader comprises a body that houses the first and second pistons, and wherein the body includes a magazine interface for interfacing a magazine to be loaded with the loader at a magazine fitting that positions the magazine in a loading position relative to the first and second engagement surfaces.

8. The loader system of claim 7, wherein the magazine interface comprises an adapter interface for interchangeably coupling adapters comprising the magazine fitting to the body.

9. The loader system of claim 8, further comprising a plurality of adapters, the adapters comprising magazine fittings specific to different magazine types and/or calibers.

10. The loader system of claim 7, wherein the loader further comprising one or more drives housed by the body and operable to drive translation of the first and second piston engagement surfaces along the respective first and second translation paths, and wherein the one or more drives comprise a lever, crank, knob, slide bar, pneumatic solenoid, solenoid actuator, motorized linear actuator, stepper motor, servo motor, or combination thereof.

11. The loader system of claim 10, wherein the loader further comprises one or more force translators to direct force provided by the operation of the one or more drives to translate the first and second piston engagement surfaces, wherein the one or more force translators are selected from a swing, ring and pinion gear, rack and pinion gear, worm gear, rocker arm, cam lobe, cam plate, or combination thereof.

12. The loader system of claim 1, wherein the feeder comprises a cartage path extending between a feeder mouth and a feeder exit, and wherein the feeder further comprises a stop positioned to prevent cartridges from exiting through the feeder exit prior to the first piston engagement surface urging the cartridge from the feeder.

13. The loader system of claim 1, wherein the feeder comprises a cartage path extending between a feeder entrance and a feeder exit, and wherein one or more extractor groove rails extend along the cartridge path and are positioned to be received in an extractor groove of the cartridges when retained in the feeder.

14. The loader system of claim 13, wherein the feeder includes a transition sweep that curves through a drop angle toward the feeder exit to sequentially position the cartridges along the first translation path for removal by the first piston engagement surface.

15. A method of loading an ammunition magazine, the method comprising:

causing translation of a first piston engagement surface of a first piston along a first translation path that extends along a first axis;

causing translation of a second piston engagement surface of a second piston along a second translation path that extends along a second axis distinct from the first axis; and providing a feeder configured to retain a plurality of cartridges and to sequentially feed the cartridges to the loader along a third axis, distinct from the first and second axes, wherein each of the first and second piston engagement surfaces engages and thereafter urges one of the cartridges toward a magazine opening during translation, and wherein the first piston engagement surface urges the cartridge from the feeder and directly or indirectly against a magazine follower of the magazine when the first piston engagement surface translates from a first position to a second position along the first translation path and the second piston engagement surface urges the cartridge toward a back of the magazine to position the cartridge below feed lips of the magazine when the second piston engagement surface translates from a third position to a fourth position along the second translation path.

16. The method of claim 15, wherein the first piston engagement surface urges the cartridge along a first translation path and the second piston engagement surface urges the cartridge along a second translation path, and wherein the first translation path is approximately perpendicular to the second translation path.

17. The method of claim 15, wherein the second engagement surface urges the cartridge along a translation path that extends within 10° of parallel to an angle of the magazine feed lips.

18. The method of claim 15, wherein the first engagement surface urges the cartridge directly or indirectly against the follower before the second piston engagement surface urges the cartridge below the magazine feed lips.

19. The method of claim 15, further maintaining a position of the first piston engagement surface when the first piston engagement surface urges the cartridge directly or indirectly against the magazine follower while the second piston engagement surface urges the cartridge toward the back of the magazine.

20. The method of claim 15, wherein causing translation of the first and second piston engagement surfaces comprises actuating a lever operatively coupled to the first and second pistons directly or indirectly via force translators.

* * * * *